US009927746B2

(12) United States Patent
Kuroda

(10) Patent No.: US 9,927,746 B2
(45) Date of Patent: Mar. 27, 2018

(54) HEATER UNIT, FIXING DEVICE, AND IMAGE FORMING APPARATUS

(71) Applicant: OKI DATA CORPORATION, Tokyo (JP)

(72) Inventor: Teruaki Kuroda, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 427 days.

(21) Appl. No.: 14/662,286

(22) Filed: Mar. 19, 2015

(65) Prior Publication Data

US 2015/0277309 A1 Oct. 1, 2015

(30) Foreign Application Priority Data

Mar. 27, 2014 (JP) ..... 2014-066791

(51) Int. Cl.
*H05B 1/02* (2006.01)
*G03G 15/20* (2006.01)

(52) U.S. Cl.
CPC . *G03G 15/2053* (2013.01); *G03G 2215/2029* (2013.01)

(58) Field of Classification Search
CPC ..... G03G 15/2053; G03G 2215/2029; H05B 1/0241; H05B 3/0066
USPC ..... 219/216, 497, 494, 505; 355/69
See application file for complete search history.

(56) References Cited

U.S. PATENT DOCUMENTS 4,550,961 A * 11/1985 Aicher ..... H01R 13/627 439/348
4,555,155 A * 11/1985 Drake ..... A61B 5/0416 439/492
6,062,915 A * 5/2000 Costello ..... H01R 11/24 439/729
9,423,757 B2 * 8/2016 Mizuta ..... G03G 21/1867
2002/0011476 A1 1/2002 Otsuka
2014/0105633 A1 * 4/2014 Takahashi ..... G03G 15/2053 399/90
2014/0105634 A1 * 4/2014 Tanaka ..... G03G 15/2042 399/90

FOREIGN PATENT DOCUMENTS

JP S63-165787 U 10/1988
JP H04-332655 A 11/1992
JP H06-026179 U 4/1994
JP 2000-268902 A 9/2000
JP 2000-284619 A 10/2000
JP 2002-015839 A 1/2002
JP 2008-010252 A 1/2008

* cited by examiner

*Primary Examiner* — Mark Paschall
(74) *Attorney, Agent, or Firm* — Kubotera & Associates, LLC

(57) ABSTRACT

A heater unit includes a heater in which a heating resistor member and an electrode electrically connected to the heating resistor member are disposed on a board; a connector having a connection terminal and attached to the heater at a specific connector attaching position thereof for electrically connecting the connection terminal to the electrode; a heater side engaging portion disposed on the heater; and a connector side engaging portion for engaging with the heater side engaging portion. The heater side engaging portion is provided for restricting the connector attached to the heater at the specific connector attaching position from shifting relative to the specific connector attaching position.

17 Claims, 52 Drawing Sheets

HEATER UNIT, FIXING DEVICE, AND IMAGE FORMING APPARATUS

BACKGROUND OF THE INVENTION AND RELATED ART STATEMENT

The present invention relates to a heater unit, a fixing device, and an image forming apparatus. More specifically, the present invention relates to a heater unit, a fixing device, and an image forming apparatus suitable for being applied to an electro-photography type printer (also referred to as a printer in the following description).

A conventional image forming apparatus includes a fixing heater for fixing a toner image transferred to a surface of a print medium. The fixing heater is formed in a heating resistor pattern disposed on a board with insulation having a flat plate shape along a longitudinal direction of the board. Further, an electrode is disposed on the board, so that the electrode is electrically connected to an end portion of the heating resistor pattern. An end portion of the board is formed in a substantially U-character shape, so that the fixing heater is inserted into a connector having a spring property. With the configuration described above, in the conventional image forming apparatus, the electrode of the fixing heater is electrically connected to a connection terminal of the connector (refer to Patent Reference).

Patent Reference: Japanese Patent Publication No. 2000-284619

In the conventional image forming apparatus disclosed in Patent Reference, the end portion of the board of the fixing heater is simply inserted into the connector. Accordingly, the connection terminal of the connector may be shifted relative to the electrode of the board, thereby causing poor contact with the electrode.

In view of the problems described above, an object of the present invention is to provide a heater unit, a fixing device, and an image forming apparatus, in which it is possible to prevent contact malfunction of a connection terminal relative to an electrode.

Further objects and advantages of the invention will be apparent from the following description of the invention.

SUMMARY OF THE INVENTION

In order to attain the objects described above, according to an aspect of the present invention, a heater unit includes a heater in which a heating resistor member and an electrode electrically connected to the heating resistor member are disposed on a board; a connector having a connection terminal and attached to the heater at a specific connector attaching position thereof for electrically connecting the connection terminal to the electrode; a heater side engaging portion disposed on the heater; and a connector side engaging portion for engaging with the heater side engaging portion. The heater side engaging portion is provided for restricting the connector attached to the heater at the specific connector attaching position from shifting relative to the specific connector attaching position.

Accordingly, in the aspect of the present invention, even when the specific connector attaching position of the heater is shifted due to a change in an entire length of the heater caused by thermal expansion of the heater, or an external impact, it is possible to prevent the connector attached to the specific connector attaching position of the heater from shifting relative to the specific connector attaching position.

As described above, according to the aspect of the present invention, the heater unit includes the heater in which the heating resistor member and the electrode electrically connected to the heating resistor member are disposed on the board; the connector having the connection terminal and attached to the heater at the specific connector attaching position thereof for electrically connecting the connection terminal to the electrode; the heater side engaging portion disposed on the heater; and the connector side engaging portion for engaging with the heater side engaging portion. The heater side engaging portion is provided for restricting the connector attached to the heater at the specific connector attaching position from shifting relative to the specific connector attaching position. Accordingly, even when the specific connector attaching position of the heater is shifted due to a change in an entire length of the heater caused by thermal expansion of the heater, or an external impact, it is possible to prevent the connector attached to the specific connector attaching position of the heater from shifting relative to the specific connector attaching position. As a result, it is possible to provide the heater unit, a fixing device, and an image forming apparatus capable of preventing contact malfunction of the connection terminal relative to the electrode.

BRIEF DESCRIPTION OF THE DRAWINGS

FIGS. 6(A) and 6(B) are schematic views showing a configuration of a left side connector of the heater unit of the printer according to the first embodiment of the present invention, wherein FIG. 6(A) is a schematic perspective view showing the left side connector, and FIG. 6(B) is a schematic sectional view showing the left side connector;

FIGS. 7(A) and 7(B) are schematic views showing a configuration of a left side holder of the heater unit of the printer according to the first embodiment of the present invention, wherein FIG. 7(A) is a schematic perspective view showing the left side holder, and FIG. 7(B) is a schematic sectional view showing the left side holder;

FIGS. 15(A) and 15(B) are schematic views showing a configuration of a left side connector of the heater unit of the printer according to the second embodiment of the present invention, wherein FIG. 15(A) is a schematic perspective view showing the left side connector, and FIG. 15(B) is a schematic sectional view showing the left side connector;

FIGS. 24(A) and 24(B) are schematic views showing a configuration of a left side connector of the heater unit of the printer according to the third embodiment of the present invention, wherein FIG. 24(A) is a schematic perspective view showing the left side connector, and FIG. 24(B) is a schematic sectional view showing the left side connector;

DETAILED DESCRIPTION OF PREFERRED EMBODIMENTS

Hereunder, embodiments of the present invention will be explained with reference to the accompanying drawings. It should be noted that the present invention is not limited to the following description, and the embodiments can be modified within a scope of the present invention.

First Embodiment

Figure 1:
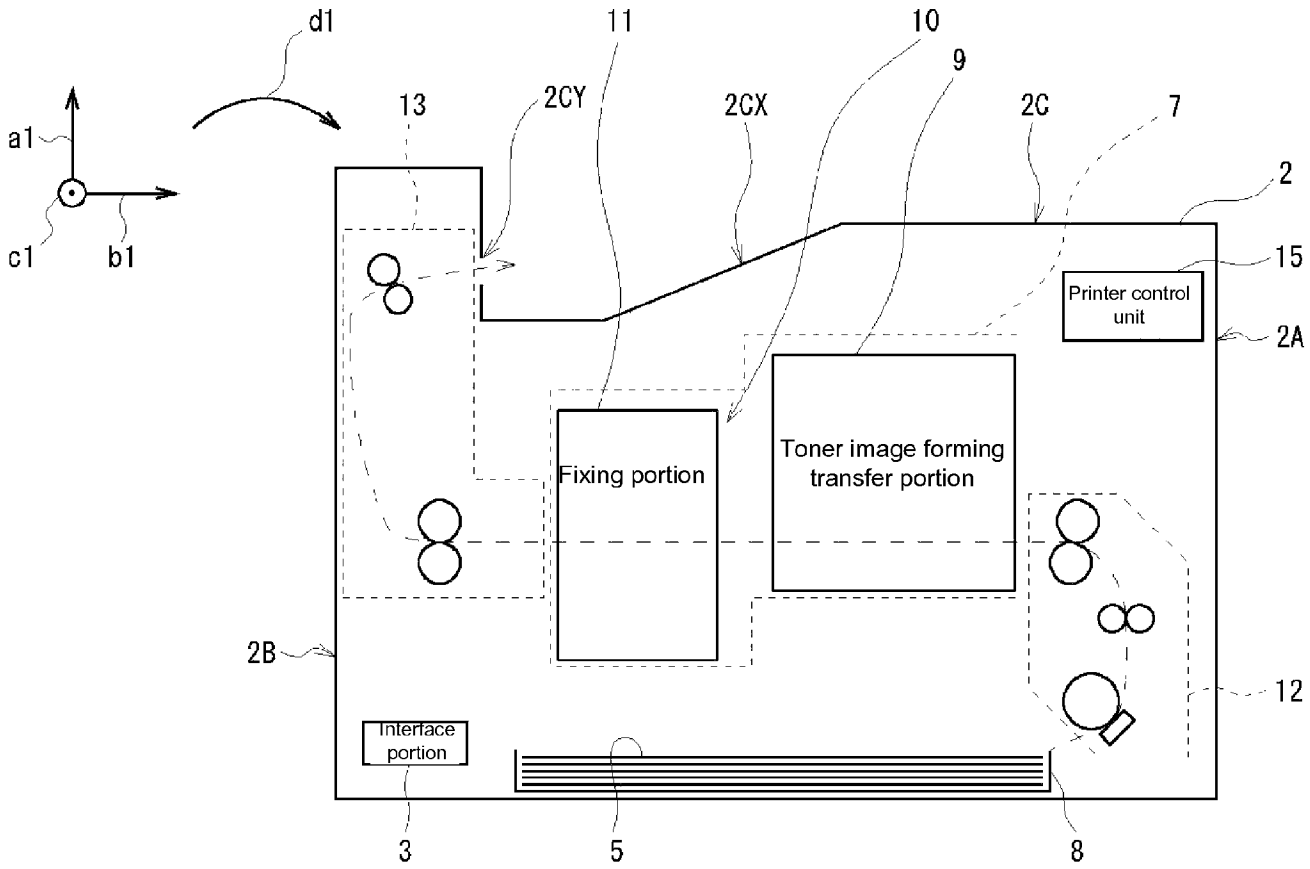
FIG. 1 is a schematic sectional view showing a configuration of a printer according to a first embodiment of the present invention.

A first embodiment of the present invention will be explained. FIG. 1 is a schematic sectional view showing a configuration of a printer 1 according to the first embodiment of the present invention.

As shown in FIG. 1, the printer 1 includes a casing body 2 (referred to as a printer casing body 2 in the following description) having a substantially box shape and a front surface 2A as a right edge surface in FIG. 1. It should be noted that, in the following description, when the printer 1 is viewed from the front surface 2A thereof, an upper direction of the printer 1 indicated with an arrow al is referred to as a printer upper direction; a direction opposite to the printer upper direction is referred to as a printer lower direction; and both directions are collectively referred to as a printer upper lower direction when it is not necessary to differentiate the both directions or indicate the both directions.

Further, in the following description, when the printer 1 is viewed from the front surface 2A thereof, a front direction of the printer 1 indicated with an arrow b1 is referred to as a printer front direction; a direction opposite to the printer front direction is referred to as a printer backside direction; and both directions are collectively referred to as a printer front backside direction when it is not necessary to differentiate the both directions or indicate the both directions.

Further, in the following description, when the printer 1 is viewed from the front surface 2A thereof, a left direction of the printer 1 indicated with an arrow c1 is referred to as a printer left direction; a direction opposite to the printer left direction is referred to as a printer right direction; and both directions are collectively referred to as a printer left right direction when it is not necessary to differentiate the both directions or indicate the both directions.

In the first embodiment, an interface portion 3 is disposed on the printer casing body 2 at, for example, a specific location at a lower edge portion of a backside surface 2B. The interface portion 3 is provided for connecting with an upper device (not shown) such as an external personal computer through a wire or wirelessly. Further, a medium receiving portion 2CX is disposed in the printer casing body 2 at a rear edge portion of an upper surface 2C for placing a print medium 5 such as an ordinary sheet with a print image formed on a surface thereof. Further, the printer casing body 2 includes a medium discharging outlet 2CY for discharging the print medium 5 from inside the printer casing body 2 to the medium receiving portion 2CX with the print image formed thereon.

In the first embodiment, an image forming portion 7 is disposed in the printer casing body 2 for forming the print image in colors or monochrome on the surface of the print medium 5. Further, a medium cassette 8 is disposed in the printer casing body 2 at a lower edge portion thereof for retaining the print medium 5 for forming the print image in a stacked state. The image forming portion 7 includes a toner image forming transfer portion 9 for forming a toner image as a base of the print image, and a fixing portion 10 for forming the print image on the surface of the print medium 5 from the toner image.

In the first embodiment, the toner image forming transfer portion 9 may have a configuration in which there is one single toner image forming portion for forming the toner image having toner in one single color (black), or there is a plurality of toner image forming portions for forming the toner images using toner in a plurality of colors (black, yellow, magenta, cyan, and the like) without overlapping with each other. Further, the fixing portion 10 includes a frame 11 (also referred to as a fixing portion frame 11 in the following description) having a substantially box shape extending in the printer right left direction. The fixing portion frame 11 is provided for receiving the print medium 5 with the toner image transferred to the surface thereof from the toner image forming transfer portion 9, and for transporting the print medium 5 from inside the fixing portion 10. Further, the fixing portion 10 includes various components therein for heating and pressing the toner image on the surface of the print medium 5 to fix and form the print image. The configuration of the fixing portion 10 will be explained later in more detail.

In the first embodiment, a medium supply transportation portion 12 is disposed in the printer casing body 2 for transporting the print medium 5 from the medium cassette 8 to the toner image forming transfer portion 9. The medium supply transportation portion 12 includes various transportation path forming components such as a plurality of transportation roller pairs and a plurality of transportation guides, so that a medium supply transportation path is formed for transporting the print medium 5 picked up from the medium cassette 8 to the toner image forming transfer portion 9. Further, a medium discharging transportation portion 13 is disposed in the printer casing body 2 for transporting the print medium 5 with the print image formed on the surface thereof from the fixing portion 10 to the medium discharging outlet 2CY. The medium discharging transportation portion 13 includes various transportation path forming components such as a plurality of transportation roller pairs and a plurality of transportation guides, so that a medium discharging transportation path is formed for transporting the print medium 5 transported from the fixing portion 10 to the medium discharging outlet 2CY.

In the first embodiment, a printer control unit 15 is disposed in the printer casing body 2 as a control unit such as a micro computer and a CPU (Central Processing Unit) for controlling an entire operation of the printer 1. The printer control unit 15 is configured to be able to communicate with the upper device through the interface portion 3. Accordingly, the printer control unit 15 receives image data of an image to be printed from the upper device. When the printer control unit 15 is instructed to print the image to be printed, the printer control unit 15 performs a print image forming process for forming the print image on the surface of the print medium 5.

More specifically, the printer control unit 15 is configured to drive the image forming portion 7 for forming the print image. Further, the printer control unit 15 is configured to drive the medium supply transportation portion 12 and the medium discharging transportation portion 13, so that a feeding portion (not shown) is driven to feed the print medium 5 from the medium cassette 8 one by one, and to transport the print medium 5 to the toner image forming transfer portion 9 through the medium supply transportation path. At this moment, the printer control unit 15 is configured to generate one or a plurality of head control data corresponding to one or a plurality of color components of the image to be printed according to the image data, and transmits one or a plurality of head control data thus generated to one or a plurality of LED (Light Emitting Diode) heads of the toner image forming portions. Through the process described above, the toner image forming transfer portion 9 forms the toner image.

Figure 2:
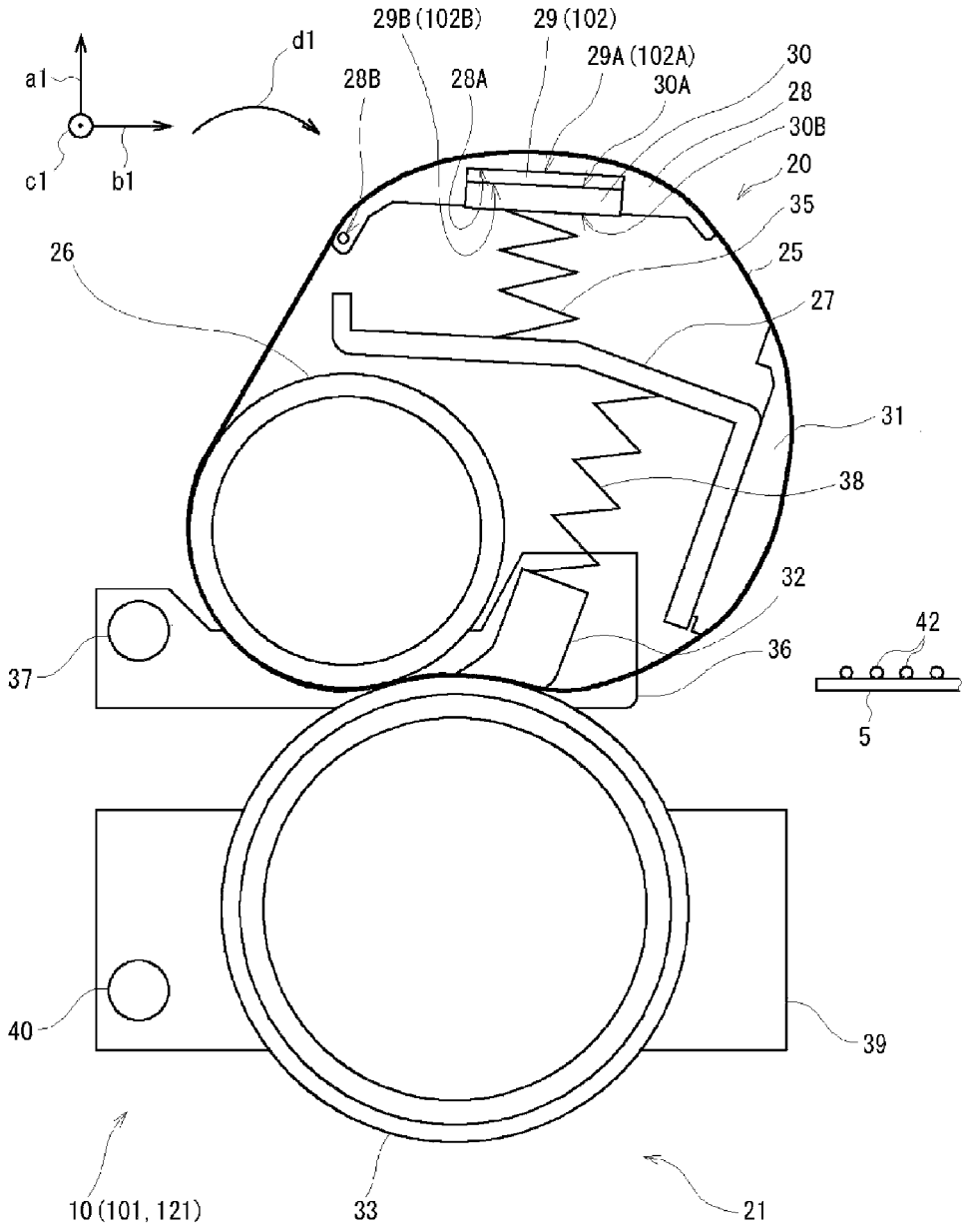
FIG. 2 is a schematic sectional view showing a configuration of a fixing device of the printer according to the first embodiment of the present invention.

A configuration of the fixing portion 10 will be explained next with reference to FIG. 2. FIG. 2 is a schematic sectional view showing the configuration of the fixing device 10 of the printer 1 according to the first embodiment of the present invention.

As described above, the fixing portion 10 includes the fixing portion frame 11 (not shown in FIG. 2). The fixing portion frame 11 includes a left side plate (not shown) and a right side plate (not shown) at a left edge and a right edge thereof, respectively. The left side plate and the right side plate are arranged such that inner surfaces thereof are separated by a specific length greater than a lateral width of the print medium 5 (referred to as a medium lateral width in the following description) when the print medium 5 is transported. It should be noted that the medium lateral width is a length of a side of the print medium 5 in a direction perpendicular to the transportation direction of the print medium 5 (that is, a length of a side of the print medium 5 in parallel to the printer left right direction) when the print medium 5 is transported.

In the first embodiment, the fixing portion 10 further includes a heating portion 20 for heating the print medium 5, and a pressing portion 21 arranged adjacent to the heating portion 20 in the vertical direction for pressing the print medium 5 together with the heating portion 20. The heating portion 20 mainly includes a heating pressing belt 25 as an endless belt for heating and pressing the print medium 5; a belt drive roller 26 for rotating the heating pressing belt 25; a beam 27; a heat conducting portion 28; a heater 29; a temperature sensor (not shown in FIG. 2) such as a thermistor; a pressing plate 30; a belt guide 31; and a belt pressing portion 32. The pressing portion 21 mainly includes a pressing roller 33 for pressing the print medium 5.

In the first embodiment, the belt drive roller 26 of the heating portion 20 is formed to have a roller rotational shaft with one end portion and the other end portion protruding from one end surface and the other end surface of a roller main body having a specific length greater than the medium lateral width. Further, the belt drive roller 26 has a roller rotational shaft having one end portion and the other end portion fixed to a pair of bearings disposed on the left side plate and the right side plate of the frame 11 in a state that a longitudinal direction of the belt drive roller 26 is aligned with the printer left right direction.

Accordingly, the frame 11 is configured to support the belt drive roller 26 with the left side plate and the right side plate thereof to be rotatable in one rotational direction indicated with an arrow dl around the roller rotational shaft extending in parallel to the printer left right direction. Further, in the heating portion 20, the other end portion of the roller rotational shaft of the belt drive roller 26 is connected to an output axis of a drive motor (not shown) for driving the fixing portion (also referred to as a fixing portion drive motor), so that the belt drive roller 26 is capable of rotating in one rotational direction according to an operation of the fixing portion drive motor.

In the first embodiment, the beam 27 is formed of a plate member having a substantially rectangular shape with a specific length greater than the medium lateral width. One edge portion and the other edge portion of the plate member are bent in opposite directions with each other, so that a sectional shape thereof becomes a substantially S-character shape.

More specifically, when a longitudinal direction of the beam 27 is aligned with the printer left right direction, the beam 27 has the one edge portion situated on a front side (that is, one of the bent edge portions, and referred to as a front side bent portion), and the front side bent portion protrudes downwardly. Further, the beam 27 has the other edge portion situated on a rear side of the front side bent portion (that is, the other of the bent edge portions, and referred to as a rear side bent portion), and the rear side bent portion protrudes upwardly. The beam 27 has one end portion and the other end portion fixed to the inner surfaces of the left side plate and the right side plate of the frame 11, so that the one end portion and the other end portion are arranged on a diagonal front upper side of the belt drive roller 26.

In the first embodiment, the heat conducting portion 28 is formed of a metal such as aluminum having a relatively high thermal conductivity, and is formed in a substantially half circular column shape having a specific length greater than the medium lateral width. More specifically, the heat conducting portion 28 is formed to have a front surface extending from one end surface to the other end surface thereof, and the surface is formed in an arc shape or a bow shape for pressing an inner surface of the heating pressing belt 25. Further, the heat conducting portion 28 is formed to have a backside surface having a flat shape. A heater holding groove portion 28A extending from one end surface to the other end surface of the heat conducting portion 28 is formed at a central portion of the backside surface, and the heater holding groove portion 28A is formed in a rectangular shape having a specific depth and a specific width.

In the first embodiment, the heat conducting portion 28 has rotational axes 28B (one thereof is shown, and the other one thereof is not shown) protruding from the one end surface and the other end surface thereof at specific opposite locations near one edge thereof, respectively. Further, the beam 27 has a pair of supporting plates (not shown) near the rear side bent portion thereof protruding upwardly from the one end portion and the other end portion thereof, respectively. The supporting plates have axis insertion holes corresponding to the rotational axes 28B of the heat conducting portion 28 at specific opposite locations thereof, respectively.

Accordingly, when the longitudinal direction of the heat conducting portion 28 is aligned with the printer left right direction, the heat conducting portion 28 is arranged such that the front surface thereof faces upwardly; one end portion thereof is situated on the rear side; the other end portion thereof is situated on the front side; and the rotational axes 28B thereof are inserted into the axis insertion holes formed in the supporting plates of the beam 27. As a result, the beam 27 supports the heat conducting portion 28 with the supporting plates to be rotatable in one rotational direction and the other rotational direction opposite to the one rotational direction (that is, a rotational direction to be an anticlockwise direction viewed from the left side).

In the first embodiment, the heater 29 is formed in a substantially rectangular shape having a specific length greater than a length between outer surfaces of the left side plate and the right side plate disposed on the frame 11. In the following description, the longitudinal direction of the heater 29 is referred to as a heater longitudinal direction, and a direction perpendicular to the heater longitudinal direction is referred to as a heater width direction. Further, in the flowing description, a length of the heater 29 from one end portion to the other end portion along the heater longitudinal direction is referred to as a heater overall length, and a width of the heater 29 from one edge portion to the other edge portion along the heater width direction is referred to as a heater width.

In the first embodiment, a central portion of the heater 29 except the one end portion and the other end portion thereof in the heater longitudinal direction is fitted into the heater holding groove portion 28A of the heat conducting portion 28 with the heater longitudinal direction aligned with the printer left right direction. Further, a central portion of one surface 29A of the heater 29 abuts against a bottom surface of the heater holding groove portion 28A.

Further, a central portion of the pressing plate 30 is fitted into the heater holding groove portion 28A of the heat conducting portion 28 with the plate longitudinal direction aligned with the printer left right direction, so that the pressing plate 30 covers the heater 29 (that is, the pressing plate 30 is overlapped with the heater 29). Further, a central portion of one surface 30A of the pressing plate 30 abuts against the other surface 29B of the heater 29. Accordingly, in the state that the heater 29 is overlapped with the pressing plate 30, one end portion of the heater 29 in the heater longitudinal direction protrudes together with one end portion of the pressing plate 30 in the plate longitudinal direction from the one end surface of the heat conducting portion 28 toward the left side. Further, the other end portion of the heater 29 in the heater longitudinal direction protrudes together with the other end portion of the pressing plate 30 in the plate longitudinal direction from the other end surface of the heat conducting portion 28 toward the right side.

In the first embodiment, the frame 11 includes hole portions having a specific size and a specific shape formed in the left side plate and the right side plate thereof at locations facing the one end surface and the other end surface of the heat conducting portion 28. Accordingly, in the state that the heater 29 is overlapped with the pressing plate 30, one end portion of the heater 29 protrudes toward outside (that is, the left side of the left side plate) together with one end portion of the pressing plate 30 through the hole portion formed in the left side plate. Further, the other end portion of the heater 29 protrudes toward outside (that is, the right side of the right side plate) together with the other end portion of the pressing plate 30 through the hole portion formed in the right side plate.

In the first embodiment, the heating portion 20 further includes a plurality of compression coil springs 35 (one thereof is shown, and others are not shown) for urging the heat conducting portion 28 to rotate in the other rotational direction such that one end portions of the compression coil springs 35 are engaged with one surface of the beam 27 facing upwardly along the printer left right direction with a specific interval in between. Further, in the heating portion 20, the other end portions of the compression coil springs 35 are pressed against the central portion of the other surface 30B of the pressing plate 30 facing downwardly along the printer left right direction with the specific interval in between.

Accordingly, in the heating portion 20, the heat conducting portion 28 holds the heater 29 and the pressing plate 30 such that the central portion of the one surface 29A of the heater 29 is pressed against the bottom surface of the heater holding groove portion 28A of the heat conducting portion 28 through the pressing plate 30 with the compression coil springs 35. Further, the compression coil springs 35 urge the heat conducting portion 28 to rotate in the other rotational direction around the rotational axes 28B.

In the first embodiment, the belt guide 31 is formed in, for example, a substantially half circular column shape having a specific length greater than the medium lateral width. Further, the belt guide 31 is fixed to one surface of the front side bent portion of the beam 27 on the front side at a flat backside surface thereof, so that a front surface of the belt guide 31 having an arc shape or a bow shape faces the front side with a longitudinal direction of the belt guide 31 aligned with the printer left right direction.

In the first embodiment, the belt pressing portion 32 is formed in a bar shape having a specific length greater than the medium lateral width and a curved character sectional shape. Further, the heating portion 20 includes a pair of pressing portion holding plates 36 (one thereon is shown, and the other one thereof is not shown) for holding the belt pressing portion 32. Further, the frame 11 includes a pair of rotational shafts 37 (one thereon is shown, and the other one thereof is not shown) disposed on the inner surfaces of the left side plate and the right side plate at specific opposite locations on the rear side of the belt drive roller 26.

Accordingly, in the state one surface of one of the pressing portion holding plates 36 faces the inner surface of the left side plate substantially in parallel, the frame 11 supports the one of the pressing portion holding plates 36 to be rotatable one rotational direction and other rotational direction around one of the rotational shafts 37. Further, in the state one surface of the other one of the pressing portion holding plates 36 faces the inner surface of the right side plate substantially in parallel, the frame 11 supports the other one of the pressing portion holding plates 36 to be rotatable one rotational direction and other rotational direction around the other one of the rotational shafts 37.

In the first embodiment, the heating portion 20 further includes a plurality of compression coil springs 38 (one thereof is shown, and others are not shown) for urging the belt pressing portion 32 to rotate in one rotational direction such that one end portions of the compression coil springs 38 are engaged with the other surface of the beam 27 facing downwardly along the printer left right direction with a specific interval in between. Further, in the heating portion 20, the other end portions of the compression coil springs 38 are engaged with the backside surface of the belt pressing portion 32 facing upwardly along the printer left right direction with the specific interval in between. Accordingly, in the heating portion 20, the compression coil springs 38 together with the pressing portion holding plates 36 are arranged to urge the belt pressing portion 32 to be rotatable in one rotational direction.

In the first embodiment, the heating pressing belt 25 has a lateral width from one opening portion to the other opening portion, having a specific width, for example, greater than the medium lateral width. Further, it is configured such that the heating pressing belt 25 is extended over the surface of the belt drive roller 26, the surface of the heat conducting portion 28, the surface of the belt guide 31, and the surface of the belt pressing portion 32. Accordingly, in the heating portion 20, when the belt drive roller 26 is rotated one revolution according to the operation of the fixing portion drive motor upon forming the print image, it is possible to rotate the heating pressing belt 25 in one rotational direction following the rotation of the belt drive roller 26.

In the first embodiment, the heating portion 20 further includes a sensor arrangement groove portion (not shown) formed in the surface of the belt guide 31 at a specific location. The temperature sensor is disposed in the sensor arrangement groove portion such that a temperature detection surface thereof contacts with the inner surface of the heating pressing belt 25 for being able to detect a temperature of the heating pressing belt 25. Accordingly, in the heating portion 20, a heater power source (not shown) turns on the heater 29 to heat the heater 29 according to a detection result of the temperature of the heating pressing belt 25 with the temperature sensor upon forming the print image (described later). As a result, in the heating portion 20, heat generated with the heater 29 is conducted to the heating pressing belt 25 through the heat conducting portion 28, so that the heating pressing belt 25 is heated while rotating in one rotational direction.

In the first embodiment, in the heating portion 20, the pressing roller 33 has rotational shafts protruding from the one end surface and the other end surface of a roller main body thereof having a specific length greater than, for example, the medium lateral width, respectively. Further, the heating portion 20 includes a pair of roller supporting plates 39 (one thereon is shown, and the other one thereof is not shown) for supporting the pressing roller 33 to be rotatable. Further, the frame 11 includes a pair of rotational shafts 40 (one thereon is shown, and the other one thereof is not shown) disposed on the inner surfaces of the left side plate and the right side plate at specific opposite locations on the diagonal rear lower side of the belt drive roller 26.

Accordingly, in the state one surface of one of the roller supporting plates 39 faces the inner surface of the left side plate substantially in parallel, the frame 11 supports the one of the roller supporting plates 39 to be rotatable one rotational direction and other rotational direction around one of the rotational shafts 40. Further, in the state that one surface of the other one of the roller supporting plates 39 faces the inner surface of the right side plate substantially in parallel, the frame 11 supports the other one of the roller supporting plates 39 to be rotatable one rotational direction and other rotational direction around the other one of the rotational shafts 40.

In the first embodiment, the pressing roller 33 has a roller rotational shaft having one end portion and the other end portion fixed to a pair of bearings disposed on the roller supporting plates 39 in a state that a longitudinal direction of the pressing roller 33 is aligned with the printer left right direction. Accordingly, the frame 11 supports the pressing roller 33 with the left side plate and the right side plate thereof through the roller supporting plates 39 to be rotatable in the other rotational direction around the roller rotational shaft extending in parallel to the printer left right direction. Further, the frame 11 supports the pressing roller 33 to be moved upwardly and downwardly while the roller rotational shaft is maintained in parallel to the printer left right direction.

In the first embodiment, the pressing portion 21 further includes a pair of compression coil springs (not shown) for urging the roller supporting plates 39 to rotate in the other rotational direction. In the pressing portion 21, one end portions of the compression coil springs are engaged with spring engaging protrusions formed on the inner surfaces of the left side plate and the right side plate of the frame 11 respectively. Further, in the heating portion 20, the other end portions of the compression coil springs are engaged with lower front edge portions of the roller supporting plates 39.

Accordingly, in the pressing portion 21, the compression coil springs are arranged to urge the roller supporting plates 39 to be rotatable in the other rotational direction around the rotational shafts 40. As a result, an upper portion of the surface of the pressing plate 30 is pressed against a lower portion of the surface of the belt drive roller 26 and the surface of the belt pressing portion 32 through the lower portion of the heating pressing belt 25.

In the first embodiment, in the pressing portion 21, the other end portion of the roller rotational shaft of the pressing roller 33 is connected to the output axis of the fixing portion drive motor, so that the pressing roller 33 is capable of rotating in the other rotational direction according to the operation of the fixing portion drive motor). Accordingly, in the pressing portion 21, when the heating pressing belt 25 is rotated one revolution together with the belt drive roller 26 according to the operation of the fixing portion drive motor upon forming the print image, it is possible to rotate the pressing roller 33 in the other rotational direction while the pressing roller 33 is being pressed against the lower portion of the outer surface of the heating pressing belt 25.

As described above, the pressing portion 21 is configured to form a sandwiching portion for sandwiching and transporting the print medium 5 for heating and pressing the print medium 5. The sandwiching portion is formed of the upper portion of the surface of the pressing roller 33 and the lower portion of the outer surface of the heating pressing belt 25 over the range corresponding to from the lower portion of the surface of the belt drive roller 26 to the surface of the belt pressing portion 32.

With the configuration described above, when the print image is formed, the fixing portion 10 draws the print medium 5 transported from the toner image forming transfer portion 9 into the frame 11. Then, in the fixing portion 10, the sandwiching portion formed of the surface of the pressing roller 33 and the outer surface of the heating pressing belt 25 rotating in the opposite directions sandwiches and transports the print medium 5, so that a toner image 42 in one color or a plurality of colors formed on the print medium 5 is heated and pressed. Accordingly, the toner image 42 is melted and fixed to the print medium 5, and then, the print medium 5 is transported from the frame 11 to the medium discharging transportation path. As a result, the fixing portion 10 is capable of forming the print image in monochrome or color on the surface of the print medium 5.

Figure 3:
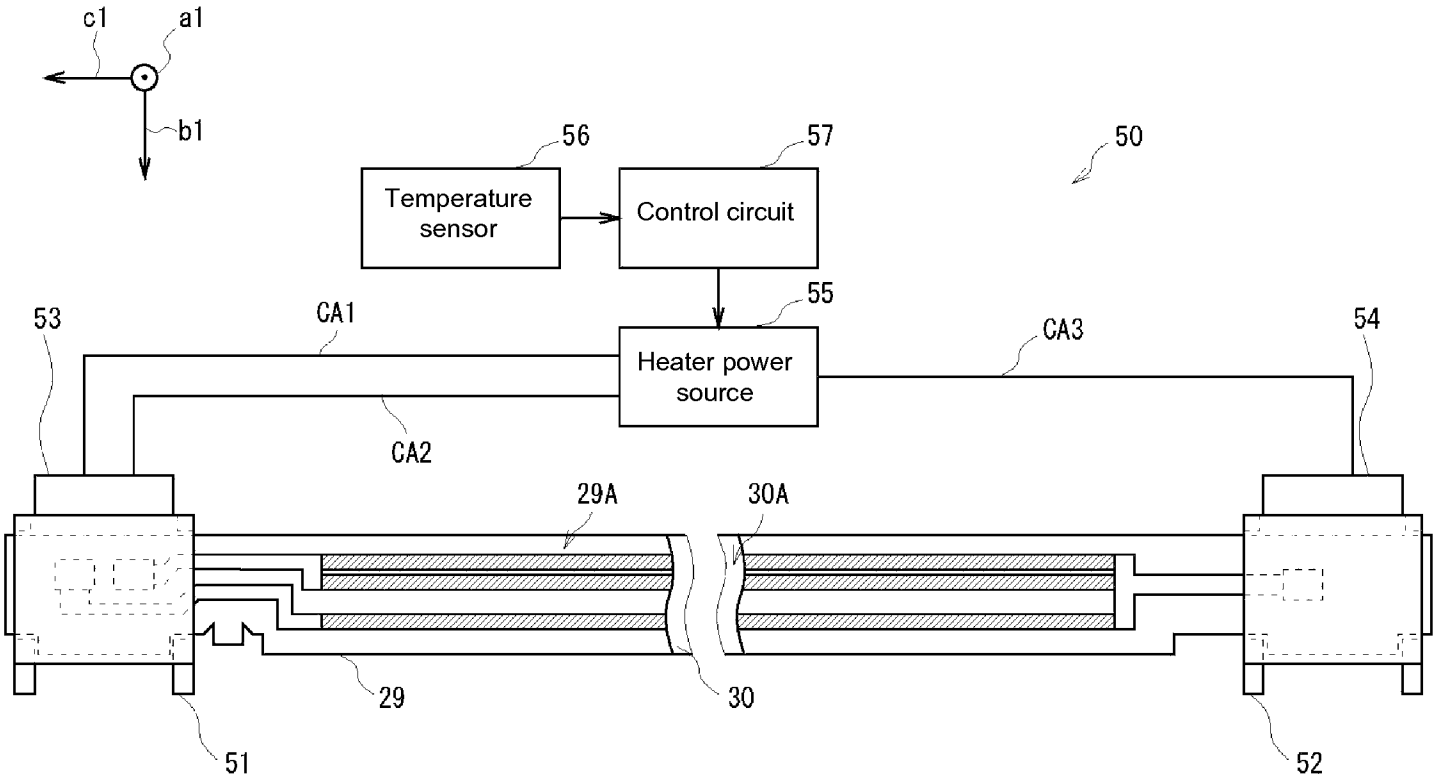
FIG. 3 is a schematic view showing a configuration of a heater unit of the printer according to the first embodiment of the present invention.

A configuration of a heater unit 50 disposed in the fixing portion 10 for heating the toner image 42 on the surface of the print medium 5 will be explained next with reference to FIG. 3. FIG. 3 is a schematic view showing the configuration of the heater unit 50 of the printer 1 according to the first embodiment of the present invention.

As shown in FIG. 3, the heater unit 50 includes the heater 29 and the pressing plate 30. Further, the heater unit 50 includes holders 51 and 52 and connectors 53 and 54. The holders 51 and 52 are directly attached to the one end portions and the other end portions of the heater 29 and the pressing plate 30 protruding outside the frame 11 (that is, the left side of the left side plate and the right side of the right side plate) in the state that the heat conducting portion 28 holds the heater 29 and the pressing plate 30 in the overlapped state. The connectors 53 and 54 are attached to the one end portions and the other end portions of the heater 29 and the pressing plate 30 through the holders 51 and 52.

In the following description, when the heat conducting portion 28 holds the heater 29 and the pressing plate 30, the one end portions of the heater 29 and the pressing plate 30 protruding outside the left side plate of the frame 11 (the left side) are referred to as left side end portions thereof, and the other end portions of the heater 29 and the pressing plate 30 protruding outside the right side plate of the frame 11 (the right side) are referred to as right side end portions thereof. Further, in the following description, the holder 51 and the connector 53 attached to the left end portions of the heater 29 and the pressing plate 30 in the overlapped state are referred to as the left side holder 51 and the left side connector 53, and the holder 52 and the connector 54 attached to the right end portions of the heater 29 and the pressing plate 30 in the overlapped state are referred to as the right side holder 52 and the right side connector 54.

In the first embodiment, the heater unit 50 further includes a heater power source 55, and each of the left side connector 53 and the right side connector 54 includes a connection terminal (not shown in FIG. 3) for electrically connecting to the heater power source 55. Accordingly, a power supply terminal of the heater power source 55 is electrically connected to the connection terminals of the left side connector 53 and the right side connector 54 through cables CA1 and CA2, respectively. Further, the heater unit 50 includes a temperature sensor 56 and a control circuit 57 for controlling the heater power source 55 to heat the heater 29. When the print image is formed, the control circuit 57 controls the heater power source 55 according to the temperature of the heating pressing belt 25 detected with the temperature sensor 56, so that the heating pressing belt 25 is heated at a desirable temperature.

Figure 4:
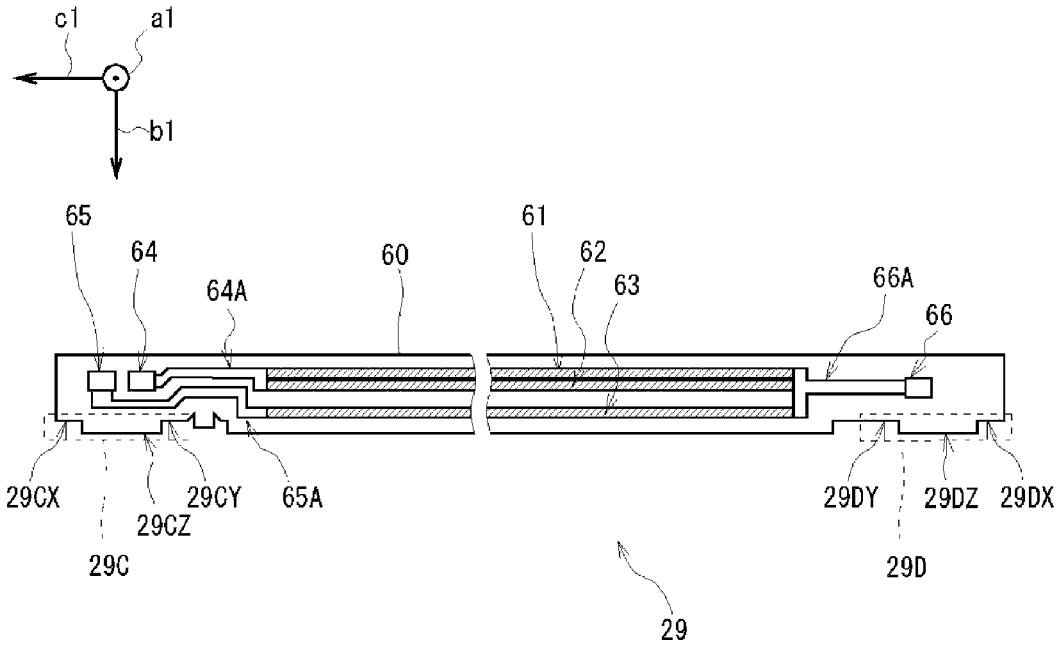
FIG. 4 is a schematic plan view showing a configuration of a heater of the heater unit of the printer according to the first embodiment of the present invention.

FIG. 4 is a schematic plan view showing a configuration of the heater 29 of the heater unit 55 of the printer 1 according to the first embodiment of the present invention. As shown in FIG. 4, the heater 29 includes a base board 60 formed in, for example, a substantially rectangular shape made of stainless steel. It should be noted that the base board 60 has a relatively thin thickness, so that a heat capacity of the base board 60 is minimized to easily raise the temperature when the heater 29 is heated. Further, the heater 29 includes a first insulation layer formed in a relatively thin film shape. The first insulation layer is disposed on an entire surface of the base board 60, and is formed of an insulation material such as glass.

In the first embodiment, the heater 29 further includes first to third heating resistor members 61 to 63 at a central portion of a surface of the first insulation layer (that is, a portion within a specific range having a length greater than the medium lateral width except a left end portion and a right end portion of the first insulation layer along the heater longitudinal direction). The first to third heating resistor members 61 to 63 are formed in a narrow linear shape, and are arranged along the heater longitudinal direction (that is, in parallel to the heater longitudinal direction). It should be noted that the first to third heating resistor members 61 to 63 are formed in a same specific conductive metal having a relatively high electric resistivity. When the first to third heating resistor members 61 to 63 are energized, the first to third heating resistor members 61 to 63 generate heat to heat the heating pressing belt 25.

In the first embodiment, the heater 29 further includes a first electrode 64 and a second electrode 65 formed in a substantially square shape and arranged along the heater longitudinal direction near the left end portion of the surface of the first insulation layer. Further, the heater 29 includes a third electrode 66 formed in a substantially square shape near the right end portion of the surface of the first insulation layer. It should be noted that the first electrode 64, the second electrode 65, and the third electrode 66 are formed of a same specific conductive metal having an electric resistivity smaller than the electric resistivity of the first to third heating resistor members 61 to 63 (that is, a resistivity thereof is relatively small), so that the first electrode 64, the second electrode 65, and the third electrode 66 do not excessive heat upon being energized.

In the first embodiment, in the heater 29, among the first electrode 64 and the second electrode 65 disposed near the left end portion of the surface of the first insulation layer, the first electrode 64 is situated at a position being plane symmetry with that of the third electrode 66 relative to an imaginary plane (referred to as a center position imaginary plane) perpendicular to the heater longitudinal direction and passing through a center position of the heater 29 (that is, a center position in the heater longitudinal direction).

In the first embodiment, the heater 29 further includes two conductive lines, i.e., a first conductive line 64A and a second conductive line 65A, arranged at the left end portion of the surface of the first insulation layer. The first conductive line 64A and the second conductive line 65A are formed of a conductive metal the same as that of the first electrode 64 and the third electrode 66, and are formed in a specific pattern. The first conductive line 64A is provided for electrically connecting the first electrode 64 to one end portions of the first heating resistor member 61 and the second heating resistor member 62, and the second conductive line 65A is provided for electrically connecting the second electrode 65 to one end portion of the third heating resistor member 63.

In the first embodiment, the heater 29 further includes one conductive line, i.e., a third conductive line 66A, arranged at the right end portion of the surface of the first insulation layer. The third conductive line 66A is formed of a conductive metal the same as that of the first electrode 64 and the third electrode 66, and is formed in a specific pattern. The third conductive line 66A is provided for electrically connecting the third electrode 66 to the other end portions of the first heating resistor member 61 and the third heating resistor member 63.

In the first embodiment, the heater 29 further includes a second insulation layer disposed on the surface of the first insulation layer. The second insulation layer is formed of a heat resistance insulation material such as a specific heat resistance glass, and is formed in a relatively thin film shape. The second insulation layer is arranged to cover the first heating resistor member 61, the second heating resistor member 62, the third heating resistor member 63, the first conductive line 64A, the second conductive line 65A, and the third conductive line 66A, so that only the first electrode 64, the second electrode 65, and the third electrode 66 are exposed.

With the configuration described above, the heater 29 is formed of the four-layer structure, in which the first insulation layer, the first heating resistor member 61, the second heating resistor member 62, the third heating resistor member 63, and the second insulation layer are sequentially laminated on the one surface of the base board 60. It should be noted that, the surface of the second insulation layer corresponds to one surface 29A of the heater 29, and the other surface of the base board 60 corresponds to the other surface 29B of the heater 29.

In addition to the configuration described above, the heater 29 further includes a first cut portion 29CX and a second cut portion 29CY in the left end portion thereof at one edge portion thereof situated on the front side when the heat conducting portion 28 holds the heater 29. A protruding portion 29CZ is formed between the first cut portion 29CX and the second cut portion 29CY to protrude toward the front side beyond the first cut portion 29CX and the second cut portion 29CY. Accordingly, the heater 29 includes a heater side engaging portion 29C (also referred to as a heater side left engaging portion 29C) formed of the first cut portion 29CX, the second cut portion 29CY, and the protruding portion 29CZ on the left end portion thereof. It should be noted that when the left side connector 53 is attached to the heater 29 at the specific connector attaching position of the left end portion thereof, the heater side left engaging portion 29C is engaged with a connector side engaging portion (described later), so that the left side connector 53 is restricted from being shifted relative to the specific connector attaching position.

In the first embodiment, the heater 29 further includes a first cut portion 29DX, a second cut portion 29DY, and a protruding portion 29DZ in the right end portion thereof at positions plane symmetry with the positions of the heater side left engaging portion 29C formed of the first cut portion 29CX, the second cut portion 29CY, and the protruding portion 29CZ relative to the center position imaginary plane. Accordingly, similar to the left end portion, the heater 29 includes a heater side engaging portion 29D (also referred to as a heater side right engaging portion 29D) formed of the first cut portion 29DX, the second cut portion 29DY, and the protruding portion 29DZ on the right end portion thereof. It should be noted that when the right side connector 54 is attached to the heater 29 at the specific connector attaching position of the right end portion thereof, the heater side right engaging portion 29D is engaged with a connector side engaging portion (described later), so that the left side connector 53 is restricted from being shifted relative to the specific connector attaching position.

In should be noted that the heater 29 has narrowed portions through forming the first cut portion 29CX, the second cut portion 29CY, the first cut portion 29DX, and the second cut portion 29DY. In the following description, the narrowed portions are referred to as a first narrowed portion and a second narrowed portion. It should be noted that the first narrowed portion and the second narrowed portion extend from the other edge of the heater 29 at the rear side thereof (also referred to as a rear edge) to bottoms of the first cut portion 29CX, the second cut portion 29CY, the first cut portion 29DX, and the second cut portion 29DY along the heater width direction. It should be also noted that the protruding portion 29CZ formed on the left end portion of the heater 29 and the protruding portion 29DZ formed on the right end portion of the heater 29 have a length in the heater longitudinal direction referred to as a protruding portion lateral width.

Figure 5:
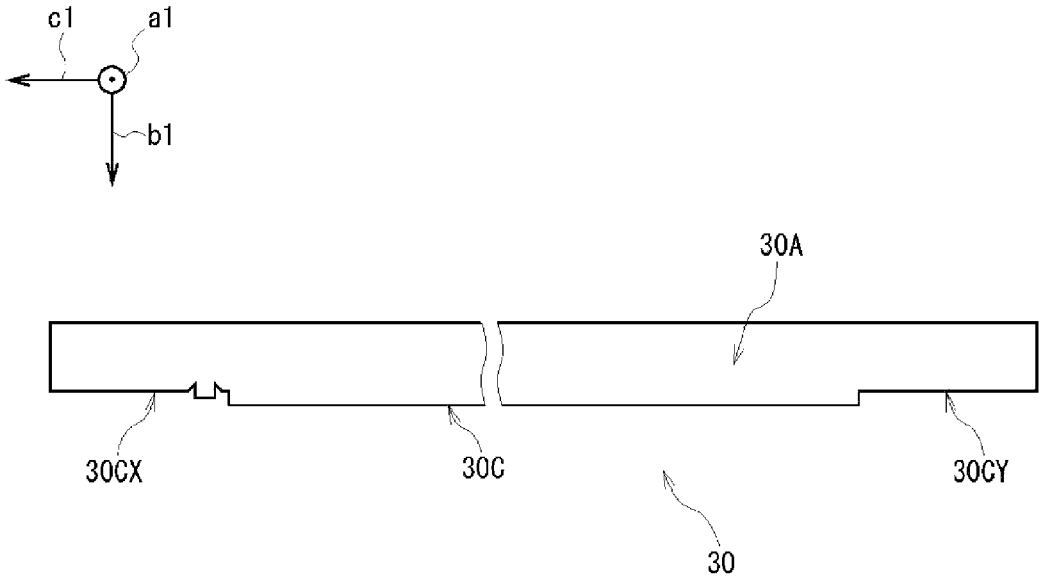
FIG. 5 is a schematic plan view showing a configuration of a pressing plate of the heater unit of the printer according to the first embodiment of the present invention.

FIG. 5 is a schematic plan view showing a configuration of the pressing plate 30 of the heater unit 50 of the printer 1 according to the first embodiment of the present invention.

As shown in FIG. 5, the pressing plate 30 is formed in a substantially rectangular band shape formed of aluminum and having a specific thickness, so that heat generated with the heater 29 is easily conducted to the heat conducting portion 28. Further, the pressing plate 30 has a specific size, so that the pressing plate 30 functions as a reinforcing member for preventing the heater 29 from being deformed when the pressing plate 30 is overlapped with the heater 29 having the relatively thin thickness.

More specifically, the pressing plate 30 has a length in the plate longitudinal direction substantially equal to the length of the heater 29 in the heater longitudinal direction. Further, the pressing plate 30 has a plate width substantially equal to the length width of the central portion of the heater 29.

In the first embodiment, the pressing plate 30 includes a first cut portion 30CX in the left end portion thereof. The first cut portion 30CX is disposed on one edge of the pressing plate 30 (also referred to as a front edge) situated on the front side when the heat conducting portion 28 holds the pressing plate 30, and is disposed at a position corresponding to the heater side left engaging portion 29C of the heater 29. Accordingly, the plate width of the pressing plate 30 at the first cut portion 30CX becomes smaller than the heater width of the heater 29 at the first narrowed portion of the heater 29. Further, the pressing plate 30 includes a first cut portion 30CY in the right end portion thereof. The first cut portion 30CY is disposed on the front edge of the pressing plate 30, and is disposed at a position corresponding to the heater side right engaging portion 29D of the heater 29. Accordingly, the plate width of the pressing plate 30 at the first cut portion 30CY becomes smaller than the heater width of the heater 29 at the first narrowed portion of the heater 29.

Accordingly, when the pressing plate 30 is held with the heat conducting portion 28 together with the heater 29, a central portion of the pressing plate 30 is completely overlapped with the central portion of the heater 29 such that the central portion of the pressing plate 30 does not protrude from the central portion of the heater 29 in the heater width direction. Further, the front edges of the pressing plate 30 at the left end portion and the right end portion do not protrude toward the front side from the heater side left engaging portion 29C and the heater side right engaging portion 29D.

Next, configurations of the left side connector 53, the right side connector 54, the left side holder 51, and the right side holder 52 will be explained. It should be noted that the left side connector 53 has a configuration similar to that of the right side connector 54, and the left side holder 51 has a configuration similar to that of the right side holder 52. Accordingly, in the following description, the configuration of the left side connector 53 and the configuration of the left side holder 51 will be explained consecutively, and explanations of the configuration of the right side connector 54 and the configuration of the right side holder 52 are omitted.

Figure 6:
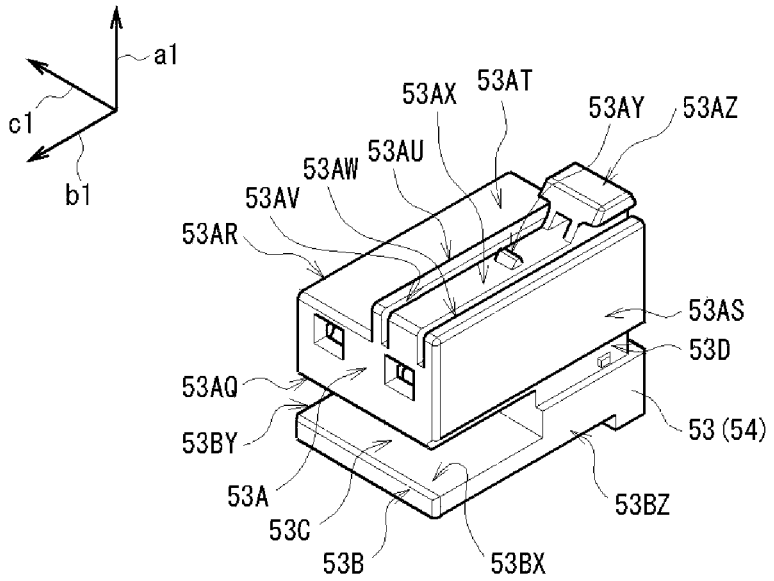
Figure 6:
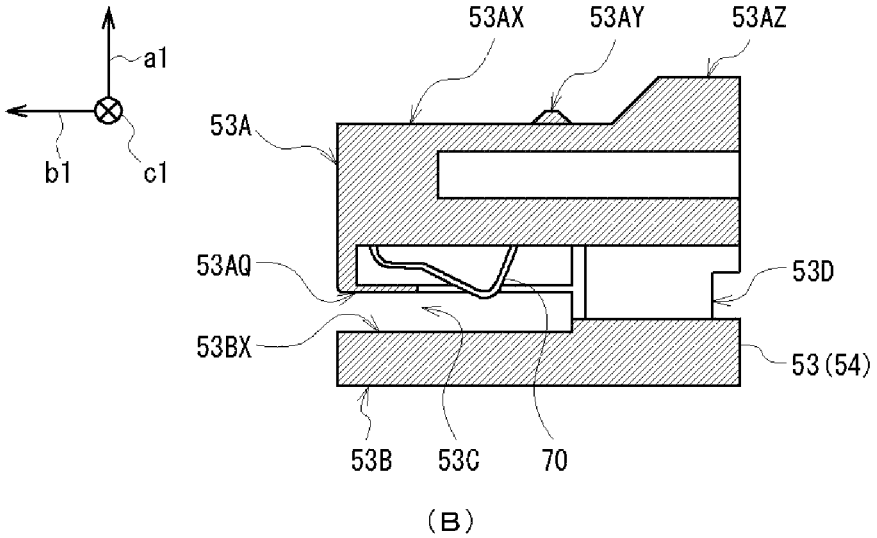

FIGS. 6(A) and 6(B) are schematic views showing the configuration of the left side connector 53 of the heater unit 50 of the printer 1 according to the first embodiment of the present invention. More specifically, FIG. 6(A) is a schematic perspective view showing the left side connector 53, and FIG. 6(B) is a schematic sectional view showing the left side connector 53.

As shown in FIGS. 6(A) and 6(B), the left side connector 53 is integrally formed in a substantially U-character shape as a whole, and formed of a specific resin material. The left side connector 53 includes a terminal holding portion 53A having a substantially rectangular block shape and a terminal protecting portion 53B having a substantially flat rectangular band shape. The left side connector 53 further includes a connecting portion 53D for connecting the terminal holding portion 53A and the terminal protecting portion 53B at one end portions of one surfaces 53AX and 53BX of the terminal holding portion 53A and the terminal protecting portion 53B, so that the one surfaces 53AX and 53BX face with each other at the other end portions with a specific distance (also referred to as a connector groove portion 53C) in between.

In the first embodiment, the connector groove portion 53C of the left side connector 53 has a specific depth substantially equal to the heater width of the heater 29 at the protruding portion 29CZ on the left end portion of the heater 29, where the heater width becomes greater than that of the first narrowed portion (that is, the portion from the rear edge of the heater 29 to the front edge as the distal end portion of the protruding portion 29C along the heater width direction). Further, the connector groove portion 53C of the left side connector 53 has a specific width (that is, a distance between the one surface 53AQ of the terminal holding portion 53A and the one surface 53BX of the terminal protecting portion 53B) greater than double of the total thickness of the heater 29 and the pressing plate 30 (also referred to as a heater plate thickness) when the heater 29 is overlapped with the pressing plate 30.

In the first embodiment, the connector groove portion 53C of the left side connector 53 has a specific width between one side surface 53AR of the terminal holding portion 53A (also referred to as a holding portion one side surface 53AR) and the other side surface 53AS of the terminal holding portion 53A (also referred to as a holding portion other side surface 53AR) substantially equal to the protruding portion lateral width of the heater 29. It should be noted that the left side connector 53 has a specific width between one side surface 53BY of the terminal protecting portion 53B (also referred to as a protecting portion one side surface 53BY) and the other side surface 53BZ of the terminal protecting portion 53B (also referred to as a protecting portion other side surface 53BZ) substantially equal to the protruding portion lateral width of the heater 29.

In the first embodiment, the left side connector 53 further includes a connection terminal 70. The connection terminal 70 is formed of a conductive metal having a narrow band shape and being curved in a specific shape, so that the connection terminal 70 is provided with a spring property. It should be noted that the left side connector 53 includes the connection terminal 70 and a connection terminal 71 having an identical configuration at two locations in the terminal holding portion 53A (one thereof is shown, and the other one thereof is not shown in FIG. 6(B)). The connection terminal 70 and the connection terminal 71 are arranged along a direction perpendicular to a depth direction of the connector groove portion 53A with a specific interval in between. Further, the connection terminal 70 and the connection terminal 71 include contact portions protruding inside the connector groove portion 53C.

In the first embodiment, the connector protecting portion 53B of the left side connector 53 is provided for protecting the contact portions of the connection terminals 70 and 71 until the heater 29 is inserted into the connector groove portion 53C together with the pressing plate 30 (that is, in a state that the heater 29 and the pressing plate 30 are not inserted into the connector groove portion 53C). When the heater 29 is inserted into the connector groove portion 53C together with the pressing plate 30, the one surface 29A of the heater 29 faces the one surface 53AQ of the terminal holding portion 53A, and the other surface 30B of the pressing plate 30 faces the one surface 53BX of the terminal protecting portion 53B.

As described above, the heater 29 includes the first electrode 64 and the second electrode 65 near the left end portion thereof where the left side connector 53 is to be attached, so that the connection terminal 70 and the connection terminal 71 are electrically connected to the first electrode 64 and the second electrode 65. Further, the connection terminal 70 and the connection terminal 71 of the left side connector 53 are electrically connected to the power supply terminals of the heater power source 55 through the cables CA1 and CA2.

In the first embodiment, the right side connector 54 has the configuration similar to that of the left side connector 53 as described above. Accordingly, the terminal holding portion of the right side connector 54 holds the two connection terminals in the state that the connection terminals are separated. As described above, the heater 29 includes only one electrode, i.e., the third electrode 66 near the right end portion thereof, so that only one of the connection terminals is electrically connected to the third electrode 66. Accordingly, only one of the connection terminals of the right side connector 54 is electrically connected to the power supply terminal of the heater power source 55 through the cable CA3.

In the first embodiment, the left side connector 53 further includes a protruding portion 53AU having a substantially rectangular column shape below the other surface 53AT of the terminal holding portion 53A along an edge between the other surface 53AT and the holding portion other side surface 53AS. Further, the left side connector 53 includes two slits 53AV and 53AW in the protruding portion 53AU of the terminal holding portion 53A. The slits 53AV and 53AW extend in parallel to the edge of the holding portion other side surface 53AS, and are separated with each other with a specific interval in between.

In the first embodiment, the left side connector 53 further includes an engaging arm 53AX between the slits 53AV and 53AW for engaging with the left side holder 51. The engaging arm 53AX includes a base portion one the side of the connector groove portion 53AC as a fixed end relative to the terminal holding portion 53A, and a distal end portion one a side of the connecting portion 53D as a free end portion. Accordingly, the engaging arm 53AX is configured to have a spring property capable of approaching or separating from the connecting portion 53D. The engaging arm 53AX includes an engaging protruding portion 53AY at a specific location of a surface thereof, and an operation protrusion 53Az at a distal end portion of the surface thereof for a pushing down operation.

Figure 7:
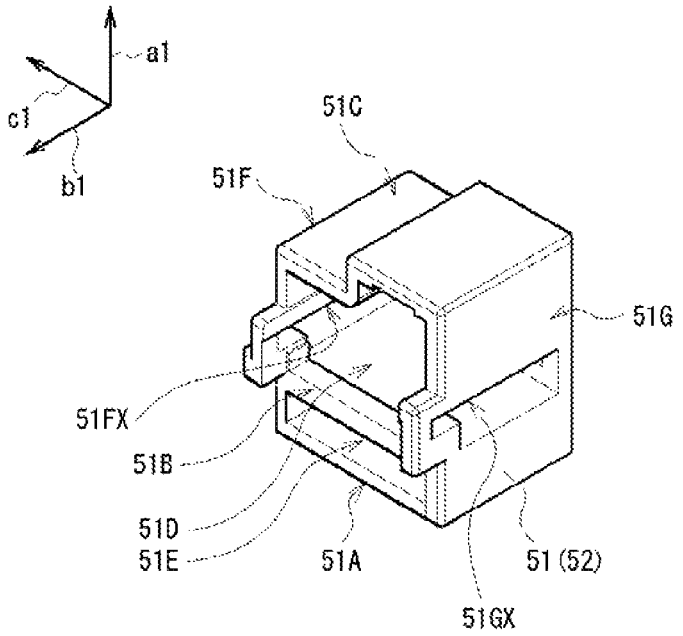
Figure 7:
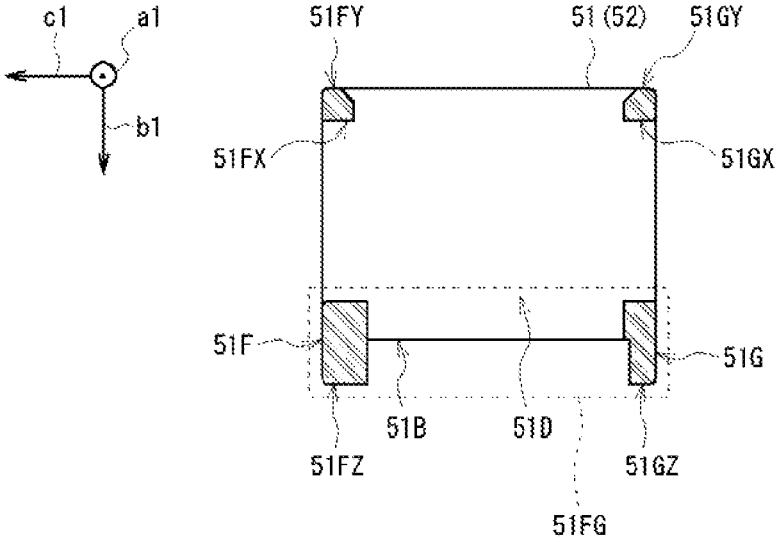

FIGS. 7(A) and 7(B) are schematic views showing a configuration of the left side holder 51 of the heater unit 50 of the printer 1 according to the first embodiment of the present invention. More specifically, FIG. 7(A) is a schematic perspective view showing the left side holder 51, and FIG. 7(B) is a schematic sectional view showing the left side holder 51.

As shown in FIGS. 7(A) and 7(B), the left side holder 51 is formed in a cylindrical shape having a substantially L-character sectional shape, and formed of a specific resin material. A dividing plate 51B is disposed at a specific location near a bottom plate 51A, and extends in parallel to the bottom plate 51A. Accordingly, the dividing plate 51B divides the left side holder 51 into two upper and lower stages, i.e., an upper hole portion 51D and a lower hole portion 51E, on a side of a top plate 51C and a side of the bottom plate 51A, respectively, with the dividing plate 51B as a boundary.

In the first embodiment, an inner surface of the top plate 51C of the left side holder 51 is formed in a step shape corresponding to the other surface 53At of the terminal holding portion 53A of the left side connector 53. Further, the dividing plate 51B of the left side holder 51 has a specific thickness, for example, smaller than the width of the connector groove portion 53C of the left side connector 53 by the heater plate thickness. Further, the upper hole portion 51D of the left side holder 51 has a specific height (that is, a height from one surface of the dividing plate 51B to the inner surface of the top plate 51C) greater than a height from the one surface 53AQ to the other surface 53AT of the terminal holding portion 53A of the left side connector 53 by the heater plate thickness.

In the first embodiment, the upper hole portion 51D of the left side holder 51 has a specific width (that is, a distance from an inner surface of one side plate 51F to an inner surface of the other side plate 51G) substantially equal to the protruding portion lateral width of the heater 29 (or the width of the terminal holding portion 53A of the left side connector 53). Further, the lower hole portion 51E of the left side holder 51 has a specific height (that is, a height from one surface of the bottom plate 51A to the other surface of the dividing plate 51B) substantially equal to a height from the other surface to the one surface 53BX of the terminal protecting portion 53B of the left side connector 53.

In the first embodiment, the lower hole portion 51E of the left side holder 51 has a specific width (that is, a distance from the inner surface of one side plate 51F to the inner surface of the other side plate 51G) substantially equal to the protruding portion lateral width of the heater 29 (or the width of the terminal protecting portion 53B of the left side connector 53). Further, the upper hole portion 51D and the lower hole portion 51E of the left side holder 51 have a specific depth (that is, a distance from one opening portion to the other opening portion) greater than the heater width of the heater 29 at the wide width portion thereof.

With the configuration described above, when the left side connector 53 is attached to the left side holder 51, first, the dividing plate 51B is guided into the connector groove portion 53C of the left side connector 53 along the terminal protecting portion 53B. Then, the terminal holding portion 53A and the terminal protecting portion 53B of the left side connector 53 are inserted into the upper hole portion 51D and the lower hole portion 51E of the left side holder 51 through one opening portion. Accordingly, when the terminal holding portion 53A of the left side connector 53 is inserted into the upper hole portion 51D of the left side holder 51, the one surface of the dividing plate 51B is separated from the one surface 53AQ of the terminal holding portion 53A by substantially the heater plate thickness and substantially without any space at other portions. Further, when the terminal protecting portion 53B of the left side connector 53 is inserted into the lower hole portion 51E of the left side holder 51, the terminal protecting portion 53B is accommodated in the lower hole portion 51E without any space.

In the following description, the upper hole portion 51D of the left side holder 51 for retaining the terminal holding portion 53A of the left side connector 53 is also referred to as a holding portion insertion hole 51D. Further, the lower hole portion 51E of the left side holder 51 for retaining the terminal protecting portion 53B of the left side connector 53 is also referred to as a protecting portion insertion hole 51E. Further, the one side plate 51F of the left side holder 51 is also referred to as a first side plate 51F, and the other side plate 51G of the left side holder 51 is also referred to as a second side plate 51G. It should be noted that an engaging recessed portion (not shown) corresponding to the engaging protruding portion 53AY of the left side connector 53 is disposed on the inner surface of the top plate 51C of the left side holder 51.

In the first embodiment, the left side holder 51 further includes a first heater plate insertion hole 51FX and a second heater plate insertion hole 51GX formed in the first side plate 51F and the second side plate 51G, respectively. The first heater plate insertion hole 51FX and the second heater plate insertion hole 51GX are formed in a substantially L-character shape and penetrate through the holding portion insertion hole 51D over a range from the height position of the one surface of the dividing plate 51B to the height position corresponding to double of the heater plate thickness.

In the first embodiment, the first heater plate insertion hole 51FX and the second heater plate insertion hole 51GX have a width substantially equal to the heater width of the narrowed portions of the heater 29 in a range from the height position of the one surface of the dividing plate 51B to the height position of the heater plate thickness (that is, the length in the depth direction of the holding portion insertion hole 51D). Further, the first heater plate insertion hole 51FX and the second heater plate insertion hole 51GX have a width substantially equal to the heater width of the wide portion of the heater 29 greater than that of the narrowed portions in a height range from the portions of the first heater plate insertion hole 51FX and the second heater plate insertion hole 51GX having the width substantially equal to the heater width of the narrowed portions toward the top plate 51C by substantially the heater plate thickness.

In the following description, the portions of the first heater plate insertion hole 51FX and the second heater plate insertion hole 51GX having the narrow width (that is the portions having the width substantially equal to the heater width of the narrowed portions of the heater 29) are also referred to as insertion hole narrow width portions. Further, the portions of the first heater plate insertion hole 51FX and the second heater plate insertion hole 51GX having the wide width on the side of the top plate 51C (that is the portions having the width substantially equal to the heater width of the wide portions of the heater 29) are also referred to as insertion hole wide width portions.

In the first embodiment, the left side holder 51 further includes a first rear side corner portion 51FY and a second rear side corner portion 51GY formed on the first side plate 51F and the second side plate 51G at the rear side of the insertion hole narrow width portions thereof (on the side of the one opening portion). Further, the left side holder 51 further includes a first front side corner portion 51FZ and a second front side corner portion 51GZ formed on the first side plate 51F and the second side plate 51G at the front side of the insertion hole narrow width portions thereof (on the side of the other opening portion). It should be noted that the first front side corner portion 51FZ and the second front side corner portion 51GZ constitute a connector side engaging portion 51FG. The connector side engaging portion 51FG is provided for restricting the left side connector 53 attached to the left end portion of the heater 29 at the connector attaching position thereof from being shifted relative to the connector attaching position. The connector side engaging portion 51FG A process of attaching the left side holder 51, the left side connector 53, the right side holder 52, and the right side connector 54 to the heater 29 and the pressing plate 30 of the heater unit 50 will be explained with reference to FIGS. 8 to 12. AS described above, the left side connector 53 has the configuration similar to that of the right side connector 54, and the left side holder 51 has the configuration similar to that of the right side holder 52. Accordingly, the left side holder 51 and the left side connector 53 are attached to the heater 29 and the pressing plate 30 in a process similar to that of the right side holder 52 and the right side connector 54. Therefore, in the following description, only the process of attaching the left side holder 51 and the left side connector 53 to the left end portions of the heater 29 and the pressing plate 30 will be explained, and an explanation of the process of attaching the right side holder 52 and the right side connector 54 to the right end portions of the heater 29 and the pressing plate 30 is omitted.

Figure 8:
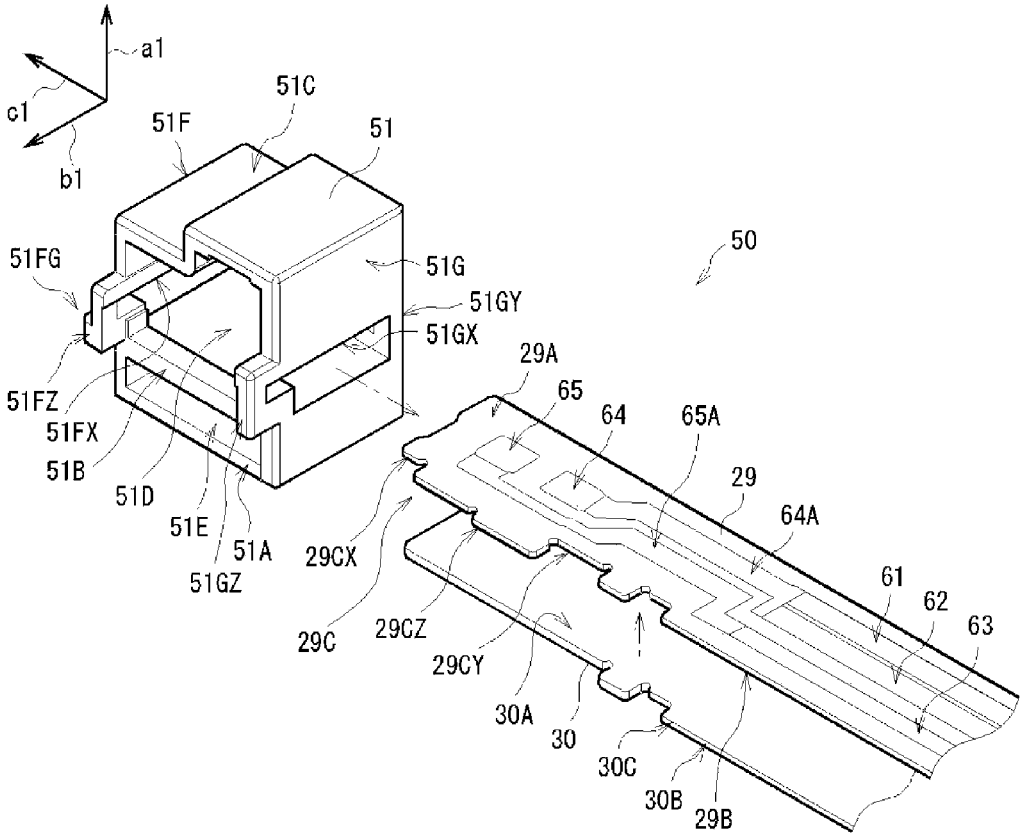
FIG. 8 is a schematic perspective view No. 1 showing the left side connector and the left side holder attached to left end portions of the heater and the pressing plate of the heater unit of the printer according to the first embodiment of the present invention.
Figure 9:
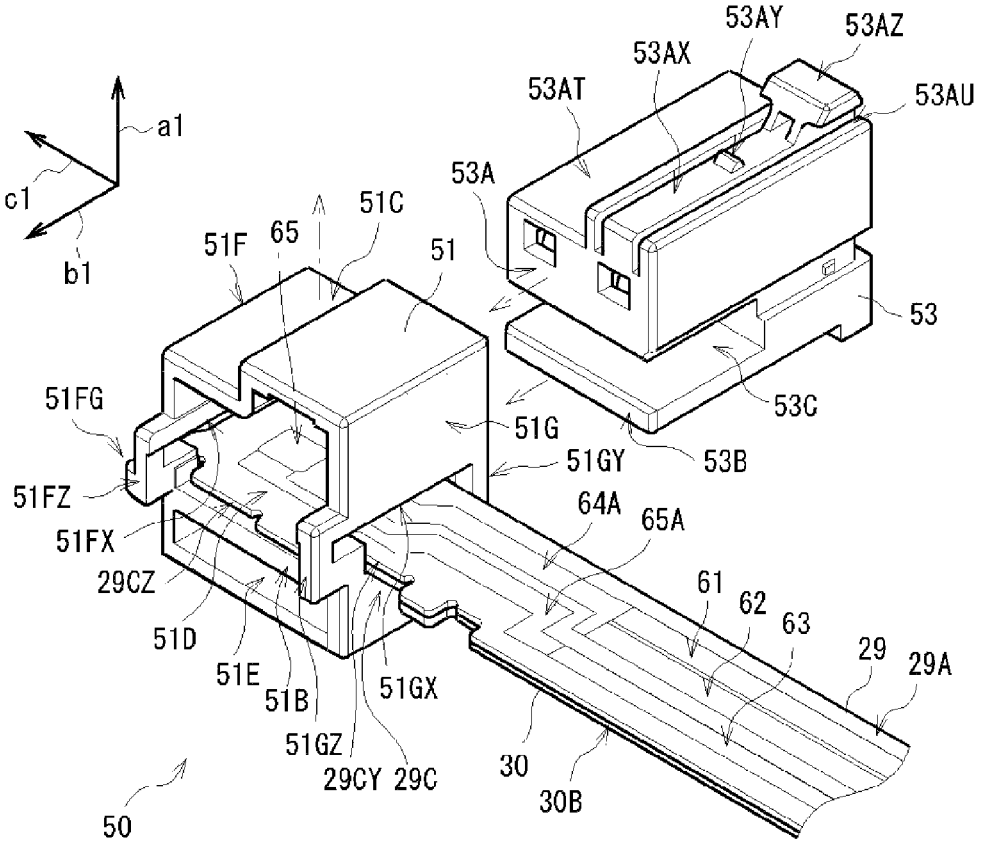
FIG. 9 is a schematic perspective view No. 2 showing the left side connector and the left side holder attached to the left end portions of the heater and the pressing plate of the heater unit of the printer according to the first embodiment of the present invention.
Figure 10:
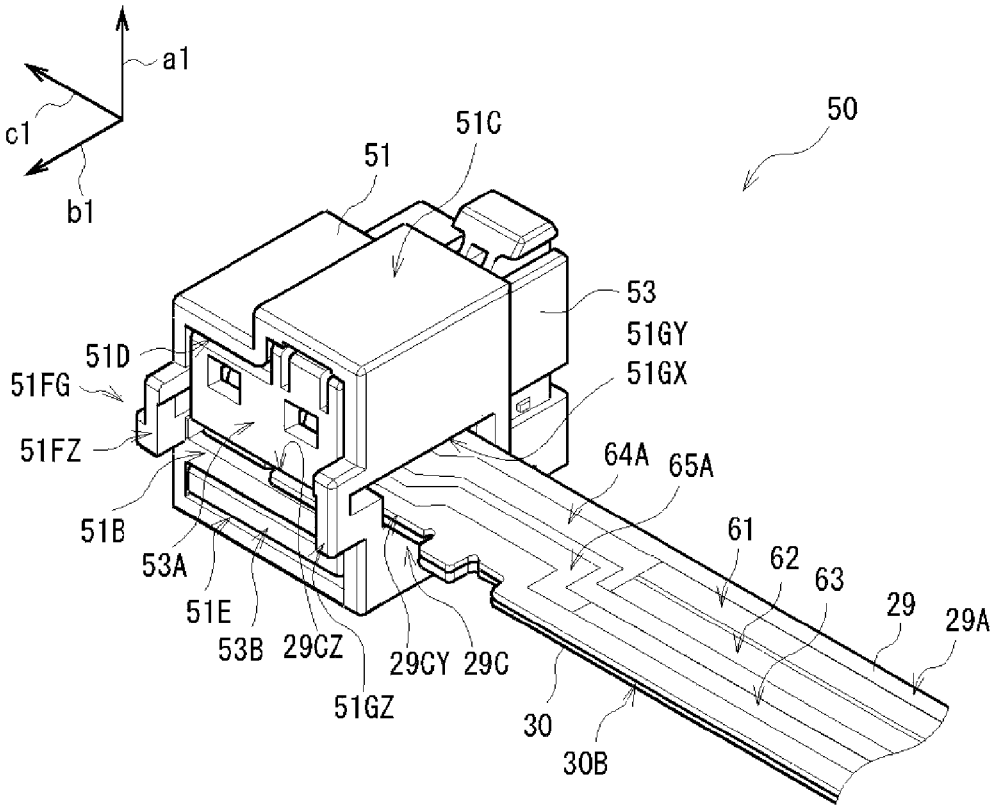
FIG. 10 is a schematic perspective view No. 3 showing the left side connector and the left side holder attached to the left end portions of the heater and the pressing plate of the heater unit of the printer according to the first embodiment of the present invention.

FIG. 8 is a schematic perspective view No. 1 showing the left side connector 53 and the left side holder 51 attached to the left end portions of the heater 29 and the pressing plate 30 of the heater unit 50 of the printer 1 according to the first embodiment of the present invention. FIG. 9 is a schematic perspective view No. 2 showing the left side connector 53 and the left side holder 51 attached to the left end portions of the heater 29 and the pressing plate 30 of the heater unit 50 of the printer 1 according to the first embodiment of the present invention. FIG. 10 is a schematic perspective view No. 3 showing the left side connector 53 and the left side holder 51 attached to the left end portions of the heater 29 and the pressing plate 30 of the heater unit 50 of the printer 1 according to the first embodiment of the present invention.

Figure 11:
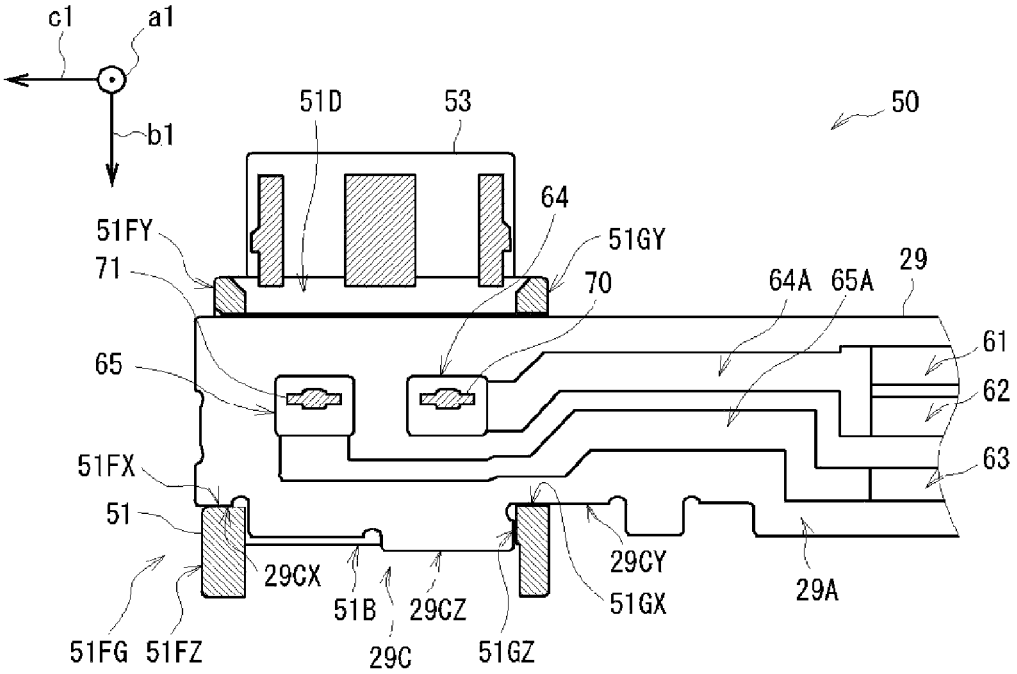
FIG. 11 is a schematic sectional view showing the left side connector and the left side holder attached to the left end portions of the heater and the pressing plate of the heater unit of the printer according to the first embodiment of the present invention.
Figure 12:
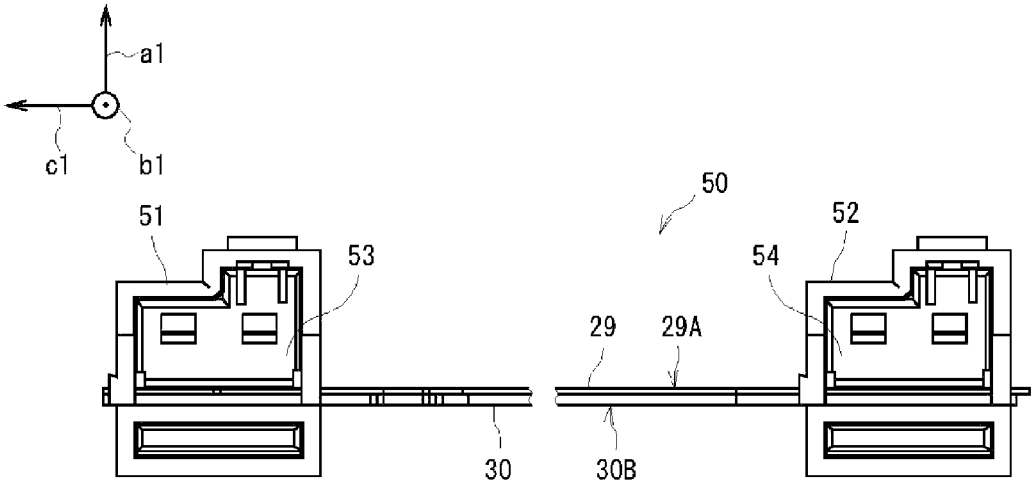
FIG. 12 is a schematic front view showing a right side connector, a right side holder, the left side connector and the left side holder attached to the heater and the pressing plate of the heater unit of the printer according to the first embodiment of the present invention.

FIG. 11 is a schematic sectional view showing the left side connector 53 and the left side holder 51 attached to the left end portions of the heater 29 and the pressing plate 30 of the heater unit 50 of the printer 1 according to the first embodiment of the present invention. FIG. 12 is a schematic front view showing the right side connector 54, the right side holder 52, the left side connector 53, and the left side holder 51 attached to the heater 29 and the pressing plate 30 of the heater unit 50 of the printer 1 according to the first embodiment of the present invention.

First, as shown in FIG. 8, when the heater 29 and the pressing plate 30 of the heater unit 50 are held on the heat conducting portion 28 of the fixing portion 10 in the overlapped state in which the heater longitudinal direction and the plate longitudinal direction are aligned in parallel to the printer left right direction, the left end portions and the right end portions of the heater 29 and the pressing plate 30 protrude outside the frame 11 (that is, outside the left side plate and the right side plate of the frame 11).

In the next step, in this state, the left side holder 51 of the heater unit 50 is guided toward the left end portions of the heater 29 and the pressing plate 30 from the left side along the heater longitudinal direction such that the second side plate 51G faces the left end portions of the heater 29 and the pressing plate 30. In the next step, the left end portions of the heater 29 and the pressing plate 30 are inserted into the insertion hole wide width portion of the first heater plate insertion hole 51FX and the insertion hole wide width portion of the second heater plate insertion hole 51GX.

In the next step, as shown in FIG. 9, in the heater unit 50, after the heater side left engaging portion 29C of the left end portion of the heater 29 and the left end portion of the pressing plate 30 are inserted into the holding portion insertion hole 51D of the left side holder 51, the left side holder 51 is lifted. Accordingly, the left end portion of the heater 29 and the left end portion of the pressing plate 30 are shifted from the insertion hole wide width portions of the first heater plate insertion hole 51FX and the second heater plate insertion hole 51GX to the insertion hole narrow width portions thereof. Further, the other surface 30B of the pressing plate 30 abuts against the one surface of the dividing plate 51B. Then, in the heater unit 50, the left side connector 53 is guided toward the one opening portion of the left side holder 51 along the heater width direction while the one end surface of the terminal holding portion 53A and the one end surface of the terminal protecting portion 53B face the one opening portion of the left side holder 51.

In the next step, as shown in FIG. 10, in the heater unit 50, the terminal holding portion 53A and the terminal protecting portion 53B of the left side connector 53 are inserted into the holding portion insertion hole 51D and the protecting portion insertion hole 51E of the left side holder 51. At this moment, the engaging protruding portion 53AY of the left side connector 53 is slid against the inner surface of the top plate 51C if the left side holder 51, so that the distal end portion of the engaging arm 53AX is pushed down. Then, the terminal holding portion 53A and the terminal protecting portion 53B of the left side connector 53 are inserted into the holding portion insertion hole 51D and the protecting portion insertion hole 51E of the left side holder 51 up to a specific standard position, so that the engaging protruding portion 53AY reaches the engaging recessed portion.

Accordingly, in the heater unit 50, the distal end portion of the engaging arm 53AX is raised with the spring property thereof, so that the engaging protruding portion 53AY is entered into and engaged with the engaging recessed portion. As a result, in the heater unit 50, the heater power source 551 is capable of holding the left side connector 53 without easily coming off. Through the process described above, in the heater unit 50, the left side connector 53 is attached to the left end portion of the heater 29 at the connector attaching position thereof through the left side holder 51.

As shown in FIG. 11, in the heater unit 50, when the terminal holding portion 53A and the terminal protecting portion 53B of the left side connector 53 are inserted into the holding portion insertion hole 51D and the protecting portion insertion hole 51E of the left side holder 51 up to the specific standard position, the contact portions of the connection terminal 70 and the connection terminal 71 of the left side connector 53 contact with the first electrode 64 and the second electrode 65 of the heater 29 on the left end portion thereof (that is, the contact portions of the connection terminal 70 and the connection terminal 71 are pushed against the first electrode 64 and the second electrode 65 through the spring property of the connection terminal 70 and the connection terminal 71). Accordingly, in the heater unit 50, the heater power source 55 is electrically connected to the first heating resistor member 61, the second heating resistor member 62, and the third heating resistor member 63 of the heater 29 through the cables CA1 and CA2, the connection terminal 70 and the connection terminal 71 of the left side connector 53, the first electrode 64 and the second electrode 65 of the heater 29 on the left end portion thereof, and the first and second conductive lines 64A and 65A of the heater 29.

As shown in FIG. 12, in the heater unit 50, the right side holder 52 and the right side connector 54 are attached to the right end portions of the heater 29 and the pressing plate 30 through a process similar to that of attaching the left side holder 51 and the left side connector 53 to the left end portions of the heater 29 and the pressing plate 30. More specifically, the right side connector 54 is attached to the right end portion of the heater 29 at the connector attaching position thereof through the right side holder 52. Accordingly, in the heater unit 50, the heater power source 55 is electrically connected to the first heating resistor member 61, the second heating resistor member 62, and the third heating resistor member 63 of the heater 29 through the cable CA3, the connection terminal of the right side connector 54, the third electrode 66 of the heater 29 on the right end portion thereof, and the third conductive line 66A of the heater 29.

In the first embodiment, in the heater unit 50, the operation protrusion 53AZ is operated and pushed down to push down the distal end portion of the engaging arm 53AX while the left side holder 51 is holding the left side connector 53, the engaging protruding portion 53AY is pulled out and disengaged from the engaging recessed portion. Then, the terminal holding portion 53A and the terminal protecting portion 53B of the left side connector 53 are pulled out backwardly from the holding portion insertion hole 51D and the protecting portion insertion hole 51E of the left side holder 51, so that the left side holder 51 is disconnected from the left side connector 53. It should be noted that, in the heater unit 50, the right side holder 52 can be pulled out from the right side connector 54 through the similar process when the right side holder 52 holds the right side connector 54.

In the first embodiment, when the left side holder 51, the left side connector 53, the right side holder 52, and the right side connector 54 are attached to the heater 29 and the pressing plate 30, the control circuit 57 of the heater unit 50 is capable of performing the heating control process for controlling the heating of the heater 29 upon forming the print image. More specifically, when the control circuit 57 of the heater unit 50 performs the heating control process, the temperature sensor 56 detects the temperature of the heating pressing belt 25, and transmits the detected temperature signal indicating the temperature thus detected to the control circuit 57. Accordingly, when the control circuit 57 of the heater unit 50 performs the heating control process, the control circuit 57 monitors the temperature of the heating pressing belt 25 according to the detected temperature signal transmitted from the temperature sensor 56, so that the control circuit 57 controls the heater power source 55.

More specifically, when the control circuit 57 starts performing the heating control process, the control circuit 57 controls the heater power source 55 to energize the first heating resistor member 61, the second heating resistor member 62, and the third heating resistor member 63 of the heater 29 through the left side connector 53 and the right side connector 54. Accordingly, all of the first heating resistor member 61, the second heating resistor member 62, and the third heating resistor member 63 are heated to heat the heating pressing belt 25, so that the temperature of the heating pressing belt 25 is quickly raised.

Further, when the temperature of the heating pressing belt 25 reaches a defined temperature for heating the toner image on the surface of the print medium 5 for fixing, the control circuit 57 controls the heater power source 55 to set the energizing period and the power termination period relative to the first heating resistor member 61, the second heating resistor member 62, and the third heating resistor member 63, and to switch the first heating resistor member 61, the second heating resistor member 62, and the third heating resistor member 63 (that is, select energizing the first heating resistor member 61 and the second heating resistor member 62, or only the third heating resistor member 63).

Accordingly, the control circuit 57 is capable of selectively heating the first heating resistor member 61, the second heating resistor member 62, and the third heating resistor member 63, so that the temperature of the heating pressing belt 25 is maintained substantially at the defined temperature. Through the heating control process described above, the control circuit 57 is capable of temporarily melting the toner image on the surface of the print medium 5 for fixing through the heating pressing belt 25 maintained substantially at the defined temperature.

In the first embodiment, when the heater power source 55 energizes the heater 29 to heat, the first electrode 64, the second electrode 65, the third electrode 66, the first conductive line 64A, the second conductive line 65A, and the third conductive line 66A disposed on the left end portion and the right end portion of the heater 29 are not heated to a great extent. Accordingly, upon being energized, in the heater 29, the left end portion and the right end portion of the base board 60 and the left end portions and the right end portions of the first insulation layer and the second insulation layer do not receive heat significantly from the first electrode 64, the second electrode 65, the third electrode 66, the first conductive line 64A, the second conductive line 65A, and the third conductive line 66A. As a result, upon being energized, the left end portion and the right end portion of the heater 29 (that is, the left end portion and the right end portion of the base board 60, the left end portions and the right end portions of the first insulation layer and the second insulation layer, the first electrode 64, the second electrode 65, the third electrode 66, the first conductive line 64A, the second conductive line 65A, and the third conductive line 66A) are not significantly exhibit thermal expansion.

On the other hand, when the heater power source 55 energizes the heater 29 to heat, the first heating resistor member 61, the second heating resistor member 62, and the third heating resistor member 63 disposed on the one surface 29A at the central portion thereof are heated. Accordingly, upon being energized, in the heater 29, the central portion of the base board 60 and the central portions of the first insulation layer and the second insulation layer receive heat generated from the first heating resistor member 61, the second heating resistor member 62, and the third heating resistor member 63. As a result, upon being energized, the central portion of the heater 29 (that is, the central portion of the base board 60, the central portions of the first insulation layer and the second insulation layer, the first heating resistor member 61, the second heating resistor member 62, and the third heating resistor member 63) exhibit thermal expansion.

As described above, in the first embodiment, the heat conducting portion 28 holds the center portion of the heater 29 such that the heater 29 is sandwiched between the bottom surface of the heater holding groove portion 28A and the pressing plate 30. Accordingly, when the central portion of the heater 29 exhibits thermal expansion due to heat, even though the central portion is not changed such as curving or deforming, the central portion expands in the heater longitudinal direction as opposed to the state that the center portion is not thermally expanded at the room temperature.

Accordingly, when the central portion of the heater 29 expands in the heater longitudinal direction due to thermal expansion, the total length of the heater 29 is increased as opposed to the room temperature. As a result, the left end portion and the right end portion of the heater 29 tend to be shifted from the frame 11 as opposed to the room temperature, so that the protruding amount of the left end portion and the right end portion protruding outside the frame 11 is increased.

Further, when the heater power source 55 stops energizing the heater 29 to heat, the temperature of the heater 29 is returned to the room temperature through natural cooling. Accordingly, the central portion of the heater 29 stops expanding in the heater longitudinal direction to return to the original state, and the total length of the heater 29 is returned to the original length before thermal expansion. As a result, the left end portion and the right end portion of the heater 29 tend to be shifted closer to the frame 11 to the original position, so that the protruding amount of the left end portion and the right end portion protruding outside the frame 11 is returned to the normal amount at the room temperature.

As described above, the total length of the heater 29 and the length of the central portion in the heater longitudinal direction are changed between the room temperature and the heated state. When the total length of the heater 29 is changed, the connector attaching position on the left end portion and the connector attaching position on the right end portion of the heater 29 tend to be shifted closer to or away from the frame 11 in the heater longitudinal direction. In other words, when the total length of the heater 29 is changed, the connector attaching position on the left end portion and the connector attaching position on the right end portion of the heater 29 are shifted to move closer to or away from each other with the heater longitudinal direction as the shifting direction.

As described above, in the first embodiment, the holding portion insertion hole 51D of the left side holder 51 has the width substantially the same as the protruding portion lateral width. Further, the first heater plate insertion hole 51FX and the second heater plate insertion hole 51GX of the left side holder 51 have the width substantially the same as the heater width of the heater 29 at the narrowed portions thereof. Accordingly, when the left side holder 51 is attached to the left end portions of the heater 29 and the pressing plate 30, the first heater plate insertion hole 51FX and the second heater plate insertion hole 51GX of the left side holder 51 are shifted relative to the left end portions of the heater 29 and the pressing plate 30, so that the left end portions of the heater 29 and the pressing plate 30 inserted into the insertion hole wide width portions are moved into the insertion hole narrow width portions.

Accordingly, the protruding portion 29CZ of the heater side left engaging portion 29C of the heater 29 is tightly fitted in between the first front side corner portion 51FZ and the second front side corner portion 51GZ of the connector side engaging portion 51FG. As a result, the first front side corner portion 51FZ and the second front side corner portion 51GZ of the connector side engaging portion 51FG function as the sandwiching portion. More specifically, the first front side corner portion 51FZ and the second front side corner portion 51GZ of the connector side engaging portion 51FG sandwich the protruding portion 29CZ of the heater side left engaging portion 29C of the heater 29 in the heater longitudinal direction, so that the connector side engaging portion 51FG of the left side holder 51 is engaged with the heater side left engaging portion 29C of the heater 29.

Accordingly, in the first embodiment, even when the total length of the heater 29 of the heater unit 50 is changed due to the thermal expansion at the central portion thereof, and the connector attaching position at the left end portion of the heater 29 is shifted, the left side holder 51 is capable of following the shift. Accordingly, it is possible to prevent the left side holder 51 from being shifted from the connector attaching position at the left end portion of the heater 29 along the heater longitudinal direction.

Further, in the first embodiment, the first narrowed portion and the second narrowed portion of the heater side left engaging portion 29C of the heater 29 are tightly fitted in between the first rear side corner portion 51FY and the first front side corner portion 51FZ of the connector side engaging portion 51FG of the left side holder 51, and between the second rear side corner portion 51GY and the second front side corner portion 51GZ of the connector side engaging portion 51FG of the left side holder 51. More specifically, the first rear side corner portion 51FY and the first front side corner portion 51FZ of the connector side engaging portion 51FG, and the second rear side corner portion 51GY and the second front side corner portion 51GZ of the connector side engaging portion 51FG sandwich the first narrowed portion and the second narrowed portion of the heater side left engaging portion 29C of the heater 29 in the heater width direction (that is, from the front and rear sides).

Accordingly, in the first embodiment, it is possible to prevent the left side holder 51 from being shifted from the connector attaching position at the left end portion of the heater 29 along the heater width direction. Further, it is possible to prevent the protruding portion 29CZ of the heater 29 from being pulled out from the space between the first front side corner portion 51FZ and the second front side corner portion 51GZ along the heater width direction. Accordingly, it is possible to prevent the connector side engaging portion 51FG from inadvertently being disengaged from the heater side left engaging portion 29C.

As described above, in the heater unit 50 in the first embodiment, it is possible to securely prevent the left side holder 51 from being shifted from the connector attaching position on the left end portion of the heater 29 in the heater longitudinal direction. Further, the left side holder 51 of the heater unit 50 is configured to hold the left side connector 53. Accordingly, even when the total length of the heater 29 is changed due to thermal expansion at the central portion of the heater 29, and the connector attaching position on the left end portion of the heater 29 is shifted, it is possible to securely prevent the left side connector 53 from being shifted from the connector attaching position on the left end portion of the heater 29 in the heater longitudinal direction.

Further, in the heater unit 50 in the first embodiment, in the state that the left side holder 51 holds the left side connector 53, the contact portions of the connection terminal 70 and the connection terminal 71 contact with the first electrode 64 and the second electrode 65 while the one surface 53AQ of the terminal holding portion 53A is situated close to the one surface 29A of the heater 29. Accordingly, in the heater unit 50, it is possible to prevent the terminal holding portion 53A of the left side connector 53 held with the left side holder 51 from shifting the left end portion of the heater 29 in the holding portion insertion hole 51D of the left side holder 51 toward the top plate 51C. As a result, it is possible to prevent the connector side engaging portion 51FG from inadvertently being disengaged from the heater side left engaging portion 29C. Therefore, in the heater unit 50, it is possible to securely prevent the left side connector 53 from being shifted together with the left side holder 51 from the connector attaching position on the left end portion of the heater 29 in the heater longitudinal direction.

Further, in the heater unit 50 in the first embodiment, similar to the left side holder 51, the right side holder 52 is attached to the connector attaching position on the right end portion of the heater 29, and the right side holder 52 holds the right side connector 54. Accordingly, even when the total length of the heater 29 is changed due to thermal expansion at the central portion of the heater 29, and the connector attaching position on the right end portion of the heater 29 is shifted, it is possible to securely prevent the right side connector 54 together with the right side holder 52 from being shifted from the connector attaching position on the right end portion of the heater 29 in the heater longitudinal direction.

It should be noted that, if an impact is accidentally applied to the printer 1 when the printer 1 is shipped out from a manufacturing plant thereof or during transportation thereof, the heater 29 may be shifted from the holding position relative to the heat conducting portion 28. As a result, the connector attaching position on the left end portion and the connector attaching position on the right end portion of the heater 29 may be shifted in the heater longitudinal direction.

To this end, in the heater unit 50 in the first embodiment, when the left side holder 51 is attached to the connector attaching position on the left end portion of the heater 29, the connector side engaging portion 51FG is engaged with the heater side left engaging portion 29C, so that the left side holder 51 holds the left side connector 53. Accordingly, even when the heater 29 is shifted from the holding position relative to the heat conducting portion 28, and the connector attaching position on the left end portion of the heater 29 is shifted in the heater longitudinal direction, it is possible to prevent the left side connector 53 together with the left side holder 51 from being shifted from the connector attaching position on the left end portion of the heater 29 in the heater longitudinal direction.

Further, in the heater unit 50 in the first embodiment, when the right side holder 52 is attached to the connector attaching position on the right end portion of the heater 29, the connector side engaging portion 51FG is engaged with the heater side right engaging portion 29D, so that the right side holder 52 holds the right side connector 54. Accordingly, even when the heater 29 is shifted from the holding position relative to the heat conducting portion 28, and the connector attaching position on the right end portion of the heater 29 is shifted in the heater longitudinal direction, it is possible to prevent the right side connector 54 together with the right side holder 52 from being shifted from the connector attaching position on the right end portion of the heater 29 in the heater longitudinal direction.

An effect of the first embodiment will be explained next. As described above, in the printer 1, the heater unit 50 of the fixing portion 10 includes the heater 29. Further, the first electrode 64 and the second electrode 65 are disposed on the left end portion of the heater 29, and the third electrode 66 is disposed on the right end portion of the heater 29. Further, the heater side left engaging portion 29C having the protruding portion 29CZ protruding in the heater width direction is disposed on the left end portion of the heater 29, and the heater side right engaging portion 29D having the protruding portion 29DZ protruding in the heater width direction is disposed on the right end portion of the heater 29.

Further, in the printer 1 in the first embodiment, the heater unit 50 includes the left side holder 51 and the right side holder 52 as well as the left side connector 53 and the right side connector 54 for holding the left side holder 51 and the right side holder 52, respectively. Further, in the printer 1, the left side holder 51 includes the connector side engaging portion 51FG having the first front side corner portion 51FZ and the second front side corner portion 51GZ capable of sandwiching the protruding portion 29CZ of the heater side left engaging portion 29C of the heater 29. Further, the right side holder 52 includes the connector side engaging portion having the first front side corner portion and the second front side corner portion capable of sandwiching the protruding portion 29DZ of the heater side right engaging portion 29D of the heater 29.

Further, in the heater unit 50 of the printer 1 in the first embodiment, when the left side holder 51 is attached to the left end portion of the heater 29 at the connector attaching position thereof, the first front side corner portion 51FZ and the second front side corner portion 51GZ of the connector side engaging portion 51FG sandwich the protruding portion 29CZ of the heater side left engaging portion 29C in the heater longitudinal direction. Accordingly, the connector side engaging portion 51FG of the left side holder 51 is engaged with the heater side engaging portion 29C of the heater 29, so that the left side holder 51 holds the left side connector 53. As a result, the contact portions of the connection terminal 70 and the connection terminal 71 of the left side holder 51 contact with the first electrode 64 and the second electrode 65 of the heater 29, respectively.

Further, in the heater unit 50 of the printer 1 in the first embodiment, when the right side holder 52 is attached to the right end portion of the heater 29 at the connector attaching position thereof, the first front side corner portion and the second front side corner portion of the connector side engaging portion sandwich the protruding portion 29DZ of the heater side right engaging portion 29D in the heater longitudinal direction. Accordingly, the connector side engaging portion of the right side holder 52 is engaged with the heater side right engaging portion 29D of the heater 29, so that the right side holder 52 holds the right side connector 54. As a result, the contact portion of the connection terminal of the right side holder 52 contacts with the third electrode 66 of the heater 29.

Accordingly, in the heater unit 50 of the printer 1 in the first embodiment, even when the total length of the heater 29 is changed due to thermal expansion, or an external impact is applied to the printer 1, and the connector attaching positions on the left and right end portions of the heater 29 are shifted, it is possible to securely prevent the left side holder 51 and the right side holder 52 attached to the connector attaching positions on the left and right end portions of the heater 29 from being shifted in the heater longitudinal direction. As a result, in the printer 1, at the left and right end portions of the heater 29, even when and the connector attaching positions on the left and right end portions of the heater 29 are shifted, it is possible to securely prevent the left side connector 53 held with the left side holder 51 and the right side connector 54 held with the right side holder 52 from being shifted from the connector attaching positions on the left and right end portions of the heater 29 in the heater longitudinal direction.

With the configuration described above, in the heater unit 50 of the fixing portion 10 of the printer 1 in the first embodiment, when the left side holder 51 is attached to the left end portion of the heater 29 at the connector attaching position thereof, the first front side corner portion 51FZ and the second front side corner portion 51GZ of the connector side engaging portion 51FG sandwich the protruding portion 29CZ of the heater side left engaging portion 29C in the heater longitudinal direction. Accordingly, the connector side engaging portion 51FG of the left side holder 51 is engaged with the heater side engaging portion 29C of the heater 29, so that the left side holder 51 holds the left side connector 53. As a result, the contact portions of the connection terminal 70 and the connection terminal 71 of the left side holder 51 contact with the first electrode 64 and the second electrode 65 of the heater 29, respectively.

Further, in the heater unit 50 of the fixing portion 10 of the printer 1 in the first embodiment, when the right side holder 52 is attached to the right end portion of the heater 29 at the connector attaching position thereof, the first front side corner portion and the second front side corner portion of the connector side engaging portion sandwich the protruding portion 29DZ of the heater side right engaging portion 29D in the heater longitudinal direction. Accordingly, the connector side engaging portion of the right side holder 52 is engaged with the heater side right engaging portion 29D of the heater 29, so that the right side holder 52 holds the right side connector 54. As a result, the contact portion of the connection terminal of the right side holder 52 contacts with the third electrode 66 of the heater 29.

Accordingly, in the printer 1 in the first embodiment, even when the total length of the heater 29 is changed due to thermal expansion, or an external impact is applied to the printer 1, and the connector attaching positions on the left and right end portions of the heater 29 are shifted, it is possible to securely prevent the left side connector 53 held with the left side holder 51 and the right side connector 54 held with the right side holder 52 from being shifted from the connector attaching positions on the left and right end portions of the heater 29 in the heater longitudinal direction. Accordingly, even when the total length of the heater 29 is changed due to thermal expansion, or an external impact is applied to the printer 1, and the connector attaching positions on the left and right end portions of the heater 29 are shifted, it is possible to prevent the connection terminal 70, the connection terminal 71, and the connection terminal from being poorly contacted with the first electrode 64, the second electrode 65, and the third electrode 66 of the heater 29, respectively.

Further, in the printer 1 in the first embodiment, the left side holder 51 includes the first rear side corner portion 51FY and the second rear side corner portion 51GY disposed between the first front side corner portion 51FZ and the second front side corner portion 51GZ and capable of sandwiching the first and second narrowed portions of the heater side left engaging portion 29C of the heater 29. Further, the right side holder 52 includes the first rear side corner portion and the second rear side corner portion disposed between the first front side corner portion and the second front side corner portion and capable of sandwiching the first and second portions of the heater side right engaging portion 29D of the heater 29.

Further, in the first embodiment, when the left side holder 51 is attached to the left end portion of the heater 29 at the connector attaching position thereof, the first front side corner portion 51FZ, the first rear side corner portion 51FY, the second front side corner portion 51GZ, and the second rear side corner portion 51GY sandwich the first and second narrowed portions of the heater side left engaging portion 29C of the heater 29 in the heater width direction. Further, when the right side holder 52 is attached to the right end portion of the heater 29 at the connector attaching position thereof, the first front side corner portion, the first rear side corner portion, the second front side corner portion, and the second rear side corner portion sandwich the first and second narrowed portions of the heater side right engaging portion 29D of the heater 29 in the heater width direction.

Accordingly, in the printer 1 in the first embodiment, it is possible to prevent the left side holder 51 and the right side holder 52 attached to the left and right end portions of the heater 29 at the connector attaching positions thereof from being shifted in the heater width direction, and it is possible to securely prevent the connector side engaging portion 51FG from inadvertently being disengaged from the heater side left engaging portion 29C and the heater side right engaging portion 29D. Therefore, in the printer 1, it is possible to securely prevent the left side connector 53 held with the left side holder 51 and the right side connector 54 held with the right side holder 52 from being shifted from the connector attaching positions on the left and right end portions of the heater 29 in the heater longitudinal direction. Further, it is possible to prevent the connection terminal 70, the connection terminal 71, and the connection terminal from being poorly contacted with the first electrode 64, the second electrode 65, and the third electrode 66 of the heater 29, respectively.

As described above, in the printer 1 in the first embodiment, it is possible to securely prevent the left side holder 51, the left side connector 53, the right side holder 52, and the right side connector 54 attached to the left and right end portions of the heater 29 at the connector attaching positions thereof from being shifted from the connector attaching positions on the left and right end portions of the heater 29 in the heater longitudinal direction. As a result, it is possible to minimize the lengths of the first electrode 64, the second electrode 65, the third electrode 66, and the left and right end portions of the heater 29. Therefore, in the printer 1, it is possible to reduce the sizes of the left side holder 51, the left side connector 53, the right side holder 52, and the right side connector 54 in the width direction.

Further, in the printer 1 in the first embodiment, the left side holder 51 is arranged to hold the left side connector 53, while the one surface 53AQ of the terminal holding portion 53A is being situated close to the one surface 29A of the heater 29. Further, the right side holder 52 is arranged to hold the right side connector 54, while the one surface of the terminal holding portion thereof is being situated close to the one surface 29A of the heater 29. Accordingly, in the printer 1, it is possible to the left side holder 51 and the right side holder 52 attached to the left and right end portions of the heater 29 at the connector attaching positions thereof from being shifted toward the other surface 29B of the heater 29. As a result, it is possible to securely prevent the connector side engaging portion 51FG from inadvertently being disengaged from the heater side left engaging portion 29C and the heater side right engaging portion 29D.

Therefore, in the printer 1 in the first embodiment, it is possible to securely prevent the left side holder 51, the left side connector 53, the right side holder 52, and the left side connector 53 attached to the left and right end portions of the heater 29 at the connector attaching positions thereof from being shifted in the heater longitudinal direction. Accordingly, it is possible to securely prevent the connection terminal 70, the connection terminal 71, and the connection terminal from being poorly contacted with the first electrode 64, the second electrode 65, and the third electrode 66 of the heater 29, respectively.

As described above, in the printer 1 in the first embodiment, the left side holder 51 is arranged to hold the left side connector 53, while the one surface 53AQ of the terminal holding portion 53A is being situated close to the one surface 29A of the heater 29. Further, the right side holder 52 is arranged to hold the right side connector 54, while the one surface of the terminal holding portion thereof is being situated close to the one surface 29A of the heater 29. Accordingly, in the printer 1, it is possible to minimize sizes of the left side holder 51, the left side connector 53, the right side holder 52, and the right side connector 54 in the height direction thereof.

Further, in the printer 1 in the first embodiment, it is configured such that the left side connector 53 and the right side connector 54 are attached to the left and right end portions of the heater 29 at the connector attaching positions thereof through the left side holder 51 and the right side holder 52 in the heater width direction. Accordingly, when the left side connector 53 and the right side connector 54 are attached to the left and right end portions of the heater 29 at the connector attaching positions thereof through the left side holder 51 and the right side holder 52, the left side connector 53 and the right side connector 54 (or the left side holder 51 and the right side holder 52) protrude outside the left and right end portions of the heater 29. Accordingly, it is possible to prevent a size of the printer 1 from being excessively large in the printer left right direction (that is, the heater longitudinal direction).

Further, in the printer 1 in the first embodiment, when the left side connector 53 and the right side connector 54 are attached to the left and right end portions of the heater 29 at the connector attaching positions thereof, the cables CA1 to CA3 are drawn from the other end surfaces of the left side connector 53 and the right side connector 54 facing the heater width direction (that is, facing the rear side). Accordingly, in the printer 1, when the left side connector 53 and the right side connector 54 are attached to the left and right end portions of the heater 29 at the connector attaching positions thereof through the left side holder 51 and the right side holder 52, it is possible to extend around the cables CA1 to CA3 drawn from the other end surfaces of the left side connector 53 and the right side connector 54 along the left side plate and the right side plate of the frame 11.

As a result, in the printer 1, when the left side connector 53 and the right side connector 54 are attached to the left and right end portions of the heater 29 at the connector attaching positions thereof through the left side holder 51 and the right side holder 52, it is possible to prevent the cables CA1 to CA3 from extending toward outside the left and right end portions of the heater 29, thereby making it possible to prevent the size of the printer 1 as a whole from being excessively large in the printer left right direction.

It should be noted that, when the heater 29 is heated, the pressing plate 30 receives heat from the heating portion 20 to expand, so that the total length of the pressing plate 30 is increased as opposed to that in the room temperature. Further, in the printer 1, when the heater 29 stops being heated, the pressing plate 30 is cooled naturally and the temperature of the pressing plate 30 is returned to the room temperature to recover the thermal expansion, the total length of the pressing plate 30 is returned to that in the room temperature. In the printer 1, the total length of the pressing plate 30 is changed due to thermal expansion. Because of a difference in the materials and thermal expansion coefficients of the heater 29 and the pressing plate 30, the total plate length of the pressing plate 30 is changed (an expansion ratio) differently from that of the total heater length of the heater 29 due to thermal expansion.

In the printer 1 in the first embodiment, when the heat conducting portion 28 holds the heater 29 and the pressing plate 30 in the overlapped state, the one surface 30A of the pressing plate 30 does not fixed to, and is simply pressed against the other surface 29B of the heater 29. Further, in the printer 1, when the left side connector 53 and the right side connector 54, as well as the left side holder 51 and the right side holder 52, are attached to the left and right end portions of the heater 29 and the pressing plate 30 in the overlapped state, the left side connector 53 and the right side connector 54, as well as the left side holder 51 and the right side holder 52, are not engaged with the left and right end portions of and the pressing plate 30.

Accordingly, in the printer 1, the total plate length of the pressing plate 30 can be separately (that is, independently from the change in the total heater length of the heater 29 due to thermal expansion) changed due to thermal expansion. As a result, even when the total plate length of the pressing plate 30 together with the total heater length of the heater 29 is changed due to thermal expansion, it is possible to securely prevent the heater 29 from being deformed such as curved or damaged due to the change in the total plate length of the pressing plate 30.

Second Embodiment

A second embodiment of the present invention will be explained next. First, an internal configuration of a printer 100 will be explained with reference to FIG. 1. In the second embodiment, the printer 100 has the internal configuration similar to that of the printer 1 in the first embodiment except a fixing portion 101 (refer to FIG. 1). Further, the printer 100 is configured to perform an operation for forming the print image on the surface of the print medium 5 through a process similar to that of the printer 1 in the first embodiment. Accordingly, the internal configuration of the printer 100 is referred to that of the printer 1 in the first embodiment shown in FIG. 1, and an explanation thereof is omitted.

In the second embodiment, the fixing portion 101 (refer to FIG. 2) has a configuration similar to that of the fixing portion 10 in the first embodiment except a heater 102 and a partial configuration of a heater unit 105. Further, the fixing portion 101 is configured to perform an operation for forming the print image on the surface of the print medium 5 through a process similar to that of the fixing portion 10 in the first embodiment. Accordingly, the configuration of the fixing portion 101 is referred to that of the fixing portion 10 of the printer 1 in the first embodiment shown in FIG. 2, and an explanation thereof is omitted.

Figure 13:
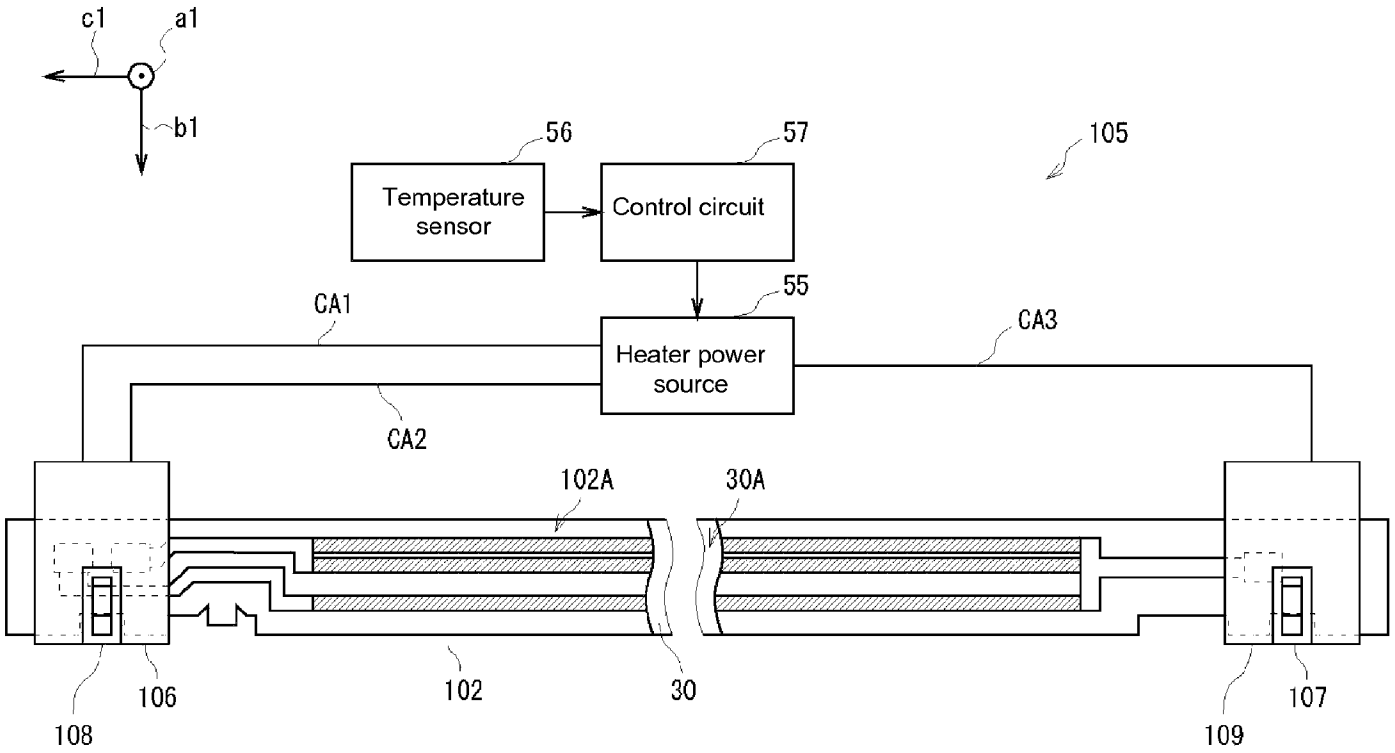
FIG. 13 is a schematic view showing a configuration of a heater unit of a printer according to a second embodiment of the present invention.

A configuration of the heater unit 105 will be explained next. FIG. 13 is a schematic view showing the configuration of the heater unit 105 of the printer 100 according to the second embodiment of the present invention. It should be noted that components shown in FIG. 13 and similar to the corresponding components in FIG. 3 are designated with the same reference numerals.

As shown in FIG. 13, the heater unit 105 includes the heater 102; a left side connector 106 and a right side connector 107 attached to a left end portion and a right end portion of the heater 102; and connector side engaging portions 108 and 109 attached to the left side connector 106 and the right side connector 107. It should be noted that the connector side engaging portions 108 and 109 are provided instead of the left side holder 51 and the right side holder 52. Other components of the heater unit 105 are similar to those of the heater unit 50 in the first embodiment.

Figure 14:
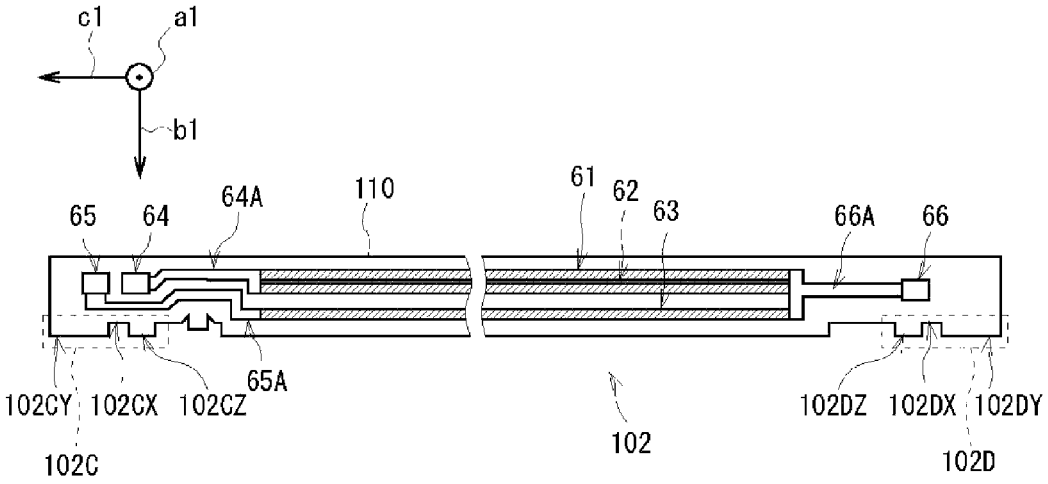
FIG. 14 is a schematic plan view showing a configuration of a heater of the heater unit of the printer according to the second embodiment of the present invention.

FIG. 14 is a schematic plan view showing a configuration of the heater 102 of the heater unit 105 of the printer 100 according to the second embodiment of the present invention. It should be noted that components shown in FIG. 14 and similar to the corresponding components in FIG. 4 are designated with the same reference numerals.

As shown in FIG. 14, the heater 102 includes a base board 110 formed in, for example, a substantially rectangular shape made of stainless steel. It should be noted that, similar to the base board 60 of the heater 29 in the first embodiment, the base board 110 has a relatively thin thickness, so that a heat capacity of the base board 110 is minimized to easily raise the temperature when the heater 102 is heated.

In the second embodiment, similar to the heater 29 in the first embodiment, the base board 110 is formed of the four-layer structure, in which the first insulation layer, the first heating resistor member 61, the second heating resistor member 62, the third heating resistor member 63, the first electrode 64, the second electrode 65, the third electrode 66, the first conductive line 64A, the second conductive line 65A, the third conductive line 66A, and the second insulation layer are sequentially laminated on the base board 110. The first insulation layer is disposed on an entire surface of the base board 110. It should be noted that the surface of the second insulation layer corresponds to one surface 102A of the heater 102, and the other surface of the base board 110 corresponds to the other surface 102B of the heater 102.

In addition to the configuration described above, the heater 102 further includes a cut portion 102CX having a substantially rectangular shape in a left end portion thereof at a specific location of one edge portion thereof, so that a heater width of the heater 102 is narrowed. A first protruding portion 102CY and a second protruding portion 102CZ are formed on both sides of the cut portion 102CX to protrude toward the front side beyond the cut portion 102CX. Accordingly, the heater 102 includes a heater side left engaging portion 102C formed of the cut portion 102CX, the first protruding portion 102CY, and the second protruding portion 102CZ on the left end portion thereof.

In the second embodiment, the heater 102 further includes a cut portion 102DX, a first protruding portion 102DY, and a second protruding portion 102DZ in the right end portion thereof at positions plane symmetry with the positions of the cut portion 102CX, the first protruding portion 102CY, and the second protruding portion 102CZ of the heater side left engaging portion 102C relative to the center position imaginary plane. Accordingly, similar to the left end portion, the heater 102 includes a heater side right engaging portion 102D formed of the cut portion 102DX, the first protruding portion 102DY, and the second protruding portion 102DZ on the right end portion thereof. It should be noted that a length of the cut portion 102CX and the cut portion 102DX formed in the left and right end portions of the heater 102 in the heater longitudinal direction is also referred to as a cut portion lateral width.

Next, configurations of the left side connector 106, the right side connector 107, the connector side engaging portion 108, and the connector side engaging portion 109 will be explained. It should be noted that the left side connector 106 has a configuration similar to that of the right side connector 107, and the connector side engaging portion 108 has a configuration similar to that of the connector side engaging portion 109. Accordingly, in the following description, the configuration of the left side connector 106 and the configuration of the connector side engaging portion 108 will be explained consecutively, and explanations of the configuration of the right side connector 107 and the configuration of the connector side engaging portion 109 are omitted.

Figure 15:
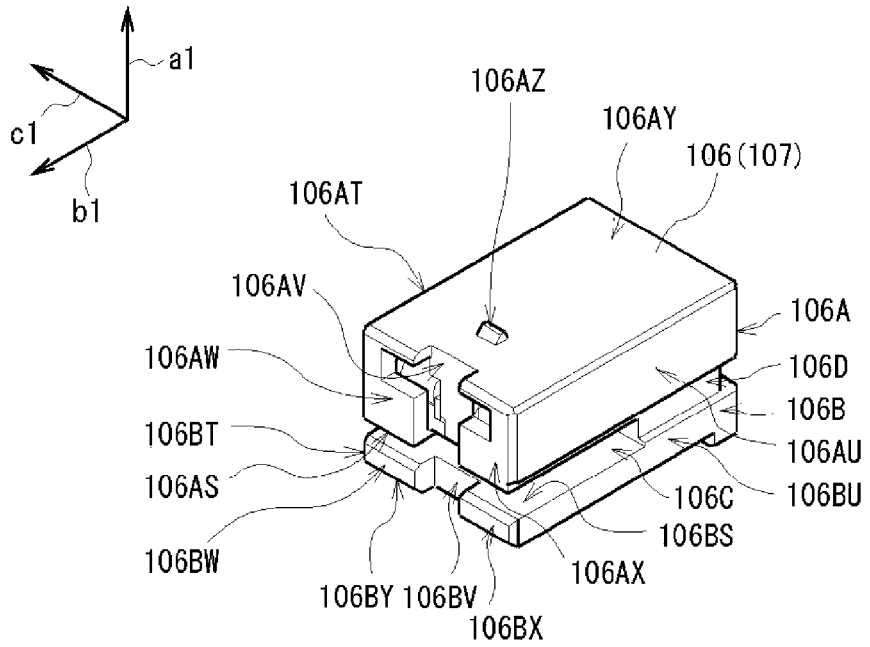
Figure 15:
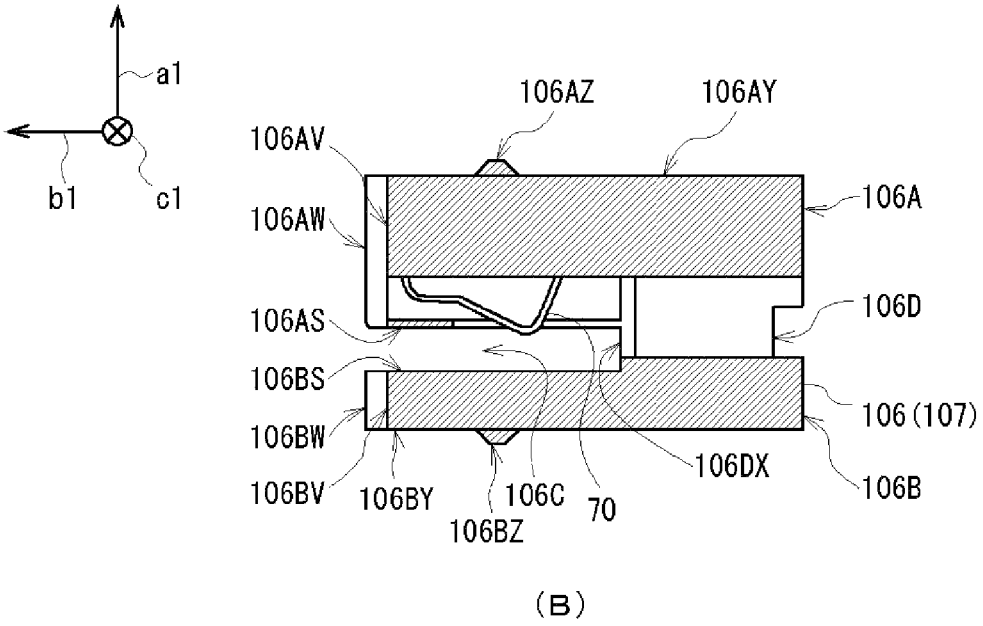

FIGS. 15(A) and 15(B) are schematic views showing the configuration of the left side connector 106 of the heater unit 105 of the printer 100 according to the second embodiment of the present invention. More specifically, FIG. 15(A) is a schematic perspective view showing the left side connector 106, and FIG. 15(B) is a schematic sectional view showing the left side connector 106.

As shown in FIGS. 15(A) and 15(B), the left side connector 106 is integrally formed in a substantially U-character shape as a whole, and is formed of a specific resin material. The left side connector 106 includes a terminal holding portion 106A and a terminal protecting portion 106B having a substantially flat rectangular block shape. The left side connector 106 further includes a connecting portion 106D having a column shape for connecting the terminal holding portion 106A and the terminal protecting portion 106B at one end portions of one surfaces 106AS and 106BS of the terminal holding portion 106A and the terminal protecting portion 106B, so that the one surfaces 106AS and 106BS face with each other at the other end portions thereof with a connector groove portion 106C in between.

In the second embodiment, the connector groove portion 106C of the left side connector 106 has a specific depth substantially equal to the heater width of the heater 102 at the wide width portion thereof. Further, the connector groove portion 106C of the left side connector 106 has a specific width (that is, a distance between the one surface 106AS of the terminal holding portion 106A and the one surface 106BS of the terminal protecting portion 106B) substantially equal to the heater plate thickness.

In the second embodiment, the connector groove portion 106C of the left side connector 106 has a specific width between a holding portion one side surface 106AT of the terminal holding portion 106A and a holding portion other side surface 106AS of the terminal holding portion 106A greater than the cut portion lateral width. Further, the connector groove portion 106C of the left side connector 106 has a specific width between a protecting portion one side surface 106BT of the terminal protecting portion 106B and a protecting portion other side surface 106BS of the terminal protecting portion 106B substantially equal to the width of the terminal holding portion 106A.

In the second embodiment, similar to the left side connector 53 in the first embodiment, the left side connector 106 further includes the connection terminal 70 and the connection terminal 71 in the terminal holding portion 106A (one thereof is shown, and the other one thereof is not shown in FIG. 15(B)). The connection terminals 70 and 71 are electrically connected to the power supply terminals of the heater power source 55 through the cables CA1 and CA2. Further, similar to the right side connector 54 in the first embodiment, the right side connector 107 includes two connection terminals in the terminal holding portion. Only one of the connection terminals is electrically connected to the power supply terminal of the heater power source 55 through the cable CA3.

In the second embodiment, the left side connector 106 further includes a groove portion 106AV in a one end surface of the terminal holding portion 106A at a central portion thereof, and a groove portion 106BV in a one end surface of the terminal protecting portion 106B at a central portion thereof along the height direction thereof. The groove portions 106AV and 106BV are provided for engaging with the connector side engaging portion 108, and have a width substantially equal to the cut portion lateral width and a specific dept greater than the depth of the cut portion 102CX. It should be noted that, in the following description, the groove portion 106AV formed in the end surface of the terminal holding portion 106A of the left side connector 106 is also referred to as a holing side engaging portion attaching groove 106AV, and the groove portion 106BV formed in the end surface of the terminal protecting portion 106B of the left side connector 106 is also referred to as a protecting side engaging portion attaching groove 106BV.

In the second embodiment, the left side connector 106 further includes a first holding side protruding portion 106AW and a second holding side protruding portion 106AX disposed on the one end surface of the terminal holding portion 106A on both sides of the holding side engaging portion attaching groove 106AV. Further, the left side connector 106 includes a first protecting side protruding portion 106BW and a second protecting side protruding portion 106BX disposed on the one end surface of the terminal protecting portion 106B on both sides of the protecting side engaging portion attaching groove 106BV.

In the second embodiment, the left side connector 106 further includes an engaging protrusion 106AZ (also referred to as a holding side engaging protrusion 106AZ) disposed on the other surface 106AY of the terminal holding portion 106A at the central portion thereof and near the holding side engaging portion attaching groove 106AV. Further, the left side connector 106 includes an engaging protrusion 106BZ (also referred to as a protecting side engaging protrusion 106BZ) disposed on the other surface 106BY of the terminal protecting portion 106B at the central portion thereof and near the protecting side engaging portion attaching groove 106BV.

Figure 16:
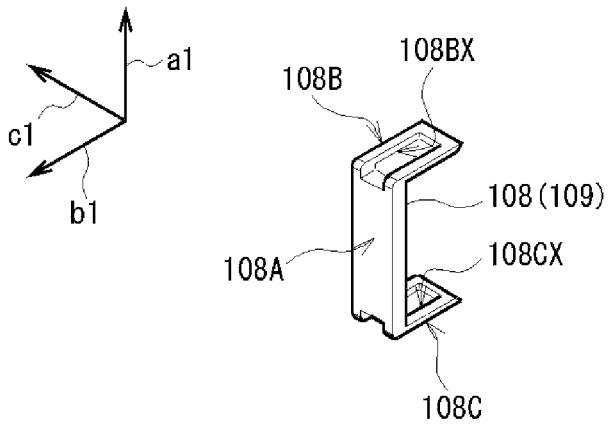
FIG. 16 is a schematic perspective view showing a configuration of a connector side engaging portion of the heater unit of the printer according to the second embodiment of the present invention.

A configuration of the connector side engaging portion 108 will be explained next. FIG. 16 is a schematic perspective view showing the configuration of the connector side engaging portion 108 of the heater unit 105 of the printer 100 according to the second embodiment of the present invention.

As shown in FIG. 16, the connector side engaging portion 108 is formed of a specific resin material, and is formed in a substantially U-character shape. The connector side engaging portion 108 includes a shoulder portion 108A having a specific length substantially equal to a height of the left side connector 106 (that is, a distance from the other surface 106AY of the terminal holding portion 106A to the other surface 106BY of the terminal protecting portion 106B). Further, the shoulder portion 108A of the connector side engaging portion 108 has a width and a thickness substantially equal to the width and the depth of the holding side engaging portion attaching groove 106AV and the protecting side engaging portion attaching groove 106BV of the left side connector 106 (that is, a width substantially equal to the cut portion lateral width).

In the second embodiment, the connector side engaging portion 108 further includes one arm portion 108B, in which an engaging hole portion 108BX (also referred to as a first engaging hole portion 108BX) having an elongated hole shape corresponding to the holding side engaging protrusion 106AZ of the left side connector 106 is formed. Further, the connector side engaging portion 108 includes the other arm portion 108C, in which an engaging hole portion 108CX (also referred to as a second engaging hole portion 108CX) having an elongated hole shape corresponding to the protecting side engaging protrusion 106BZ of the left side connector 106 is formed.

A process of attaching the left side connector 106, the connector side engaging portion 108, the right side connector 107, and the connector side engaging portion 109 to the heater 102 and the pressing plate 30 of the heater unit 105 will be explained with reference to FIGS. 17 to 22. As described above, the left side connector 106 has the configuration similar to that of the right side connector 107, and the connector side engaging portion 108 has the configuration similar to that of the connector side engaging portion 109. Accordingly, the left side connector 106 and the connector side engaging portion 108 are attached to the heater 102 and the pressing plate 30 in a process similar to that of the right side connector 107 and the connector side engaging portion 109. Therefore, in the following description, only the process of attaching the left side connector 106 and the connector side engaging portion 108 to the left end portions of the heater 102 and the pressing plate 30 will be explained, and an explanation of the process of attaching the right side connector 107 and the connector side engaging portion 109 to the right end portions of the heater 102 and the pressing plate 30 is omitted.

Figure 17:
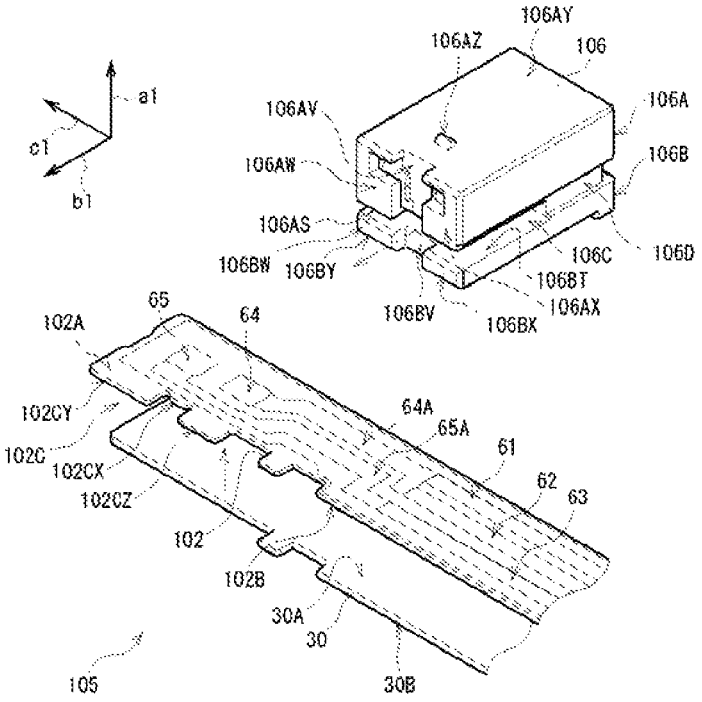
FIG. 17 is a schematic perspective view No. 1 showing the left side connector and the connector side engaging portion attached to left end portions of the heater and the pressing plate of the heater unit of the printer according to the second embodiment of the present invention.
Figure 18:
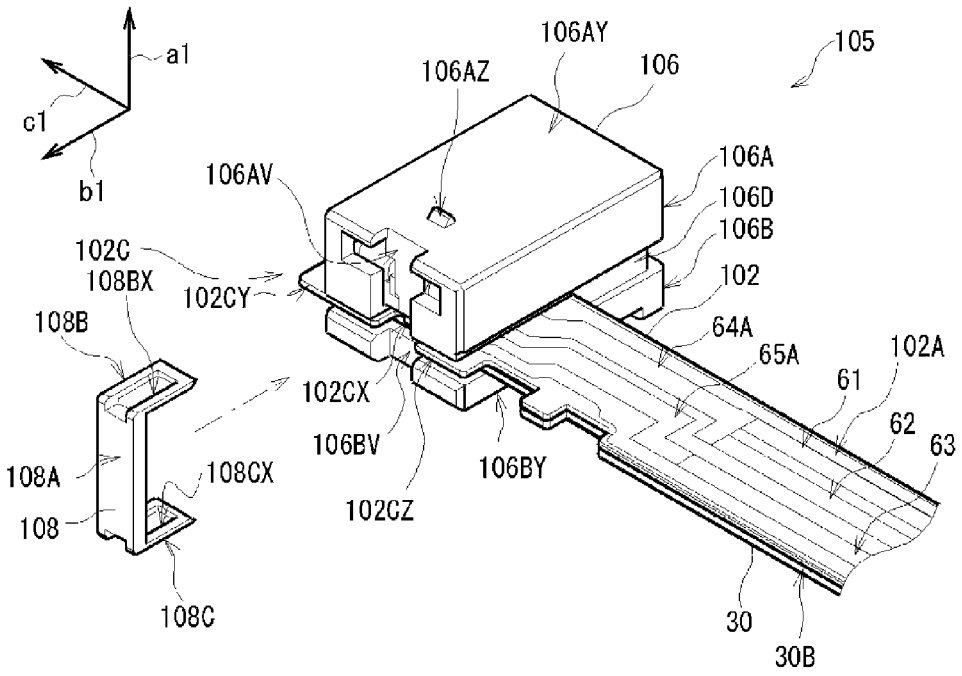
FIG. 18 is a schematic perspective view No. 2 showing the left side connector and the connector side engaging portion attached to the left end portions of the heater and the pressing plate of the heater unit of the printer according to the second embodiment of the present invention.

FIG. 17 is a schematic perspective view No. 1 showing the left side connector 106 and the connector side engaging portion 108 attached to the left end portions of the heater 102 and the pressing plate 30 of the heater unit 105 of the printer 100 according to the second embodiment of the present invention. FIG. 18 is a schematic perspective view No. 2 showing the left side connector 106 and the connector side engaging portion 108 attached to the left end portions of the heater 102 and the pressing plate 30 of the heater unit 105 of the printer 100 according to the second embodiment of the present invention.

Figure 19:
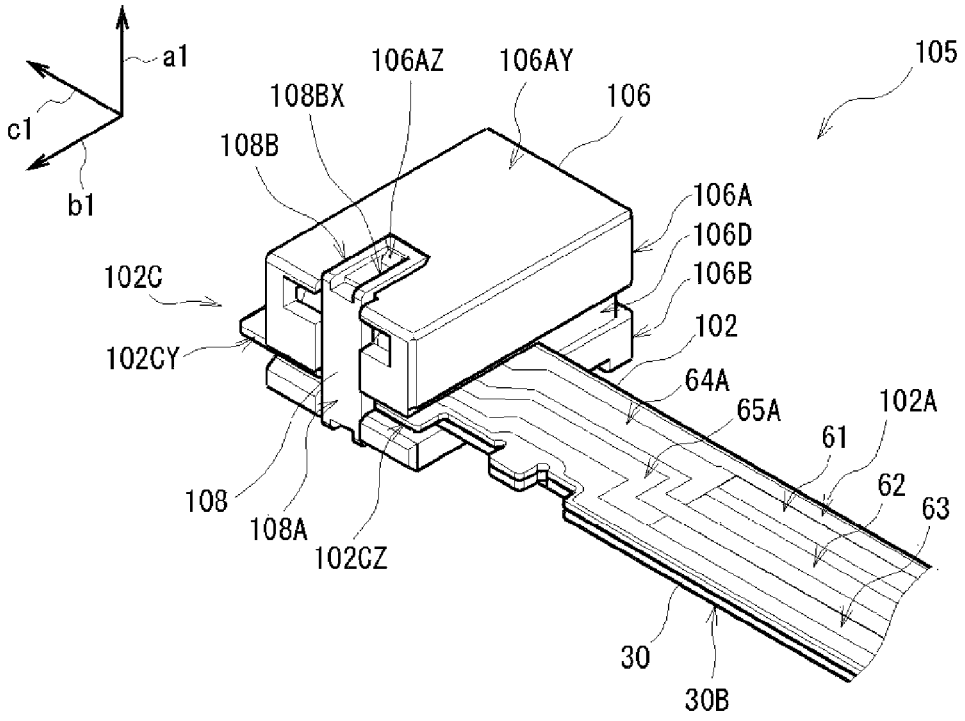
FIG. 19 is a schematic perspective view No. 3 showing the left side connector and the connector side engaging portion attached to the left end portions of the heater and the pressing plate of the heater unit of the printer according to the second embodiment of the present invention.
Figure 20:
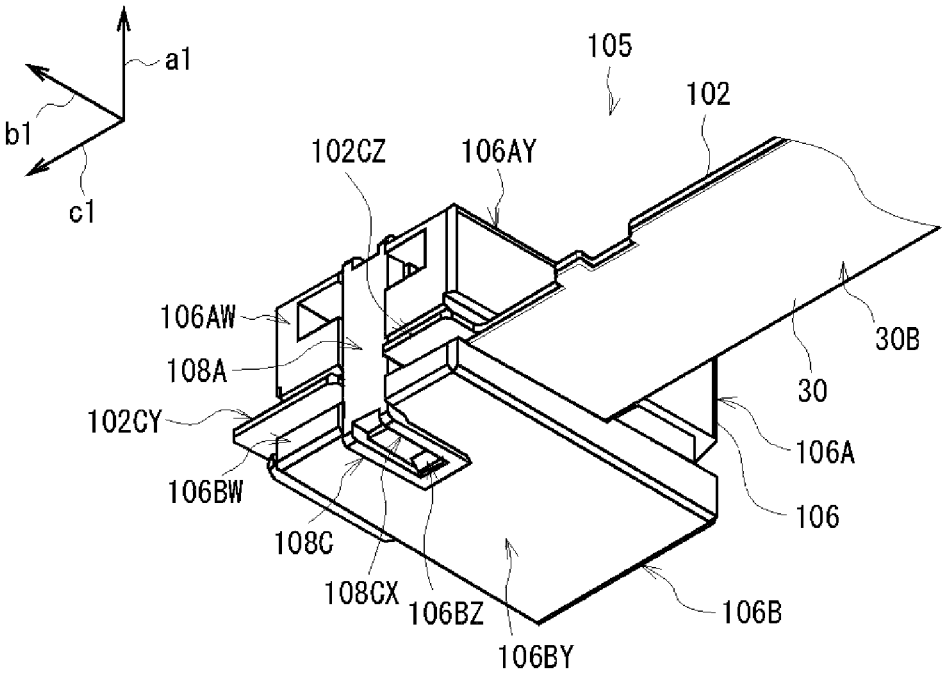
FIG. 20 is a schematic perspective view No. 4 showing the left side connector and the connector side engaging portion attached to the left end portions of the heater and the pressing plate of the heater unit of the printer according to the second embodiment of the present invention.

FIG. 19 is a schematic perspective view No. 3 showing the left side connector 106 and the connector side engaging portion 108 attached to the left end portions of the heater 102 and the pressing plate 30 of the heater unit 105 of the printer 100 according to the second embodiment of the present invention. FIG. 20 is a schematic perspective view No. 4 showing the left side connector 106 and the connector side engaging portion 108 attached to the left end portions of the heater 102 and the pressing plate 30 of the heater unit 105 of the printer 100 according to the second embodiment of the present invention.

Figure 21:
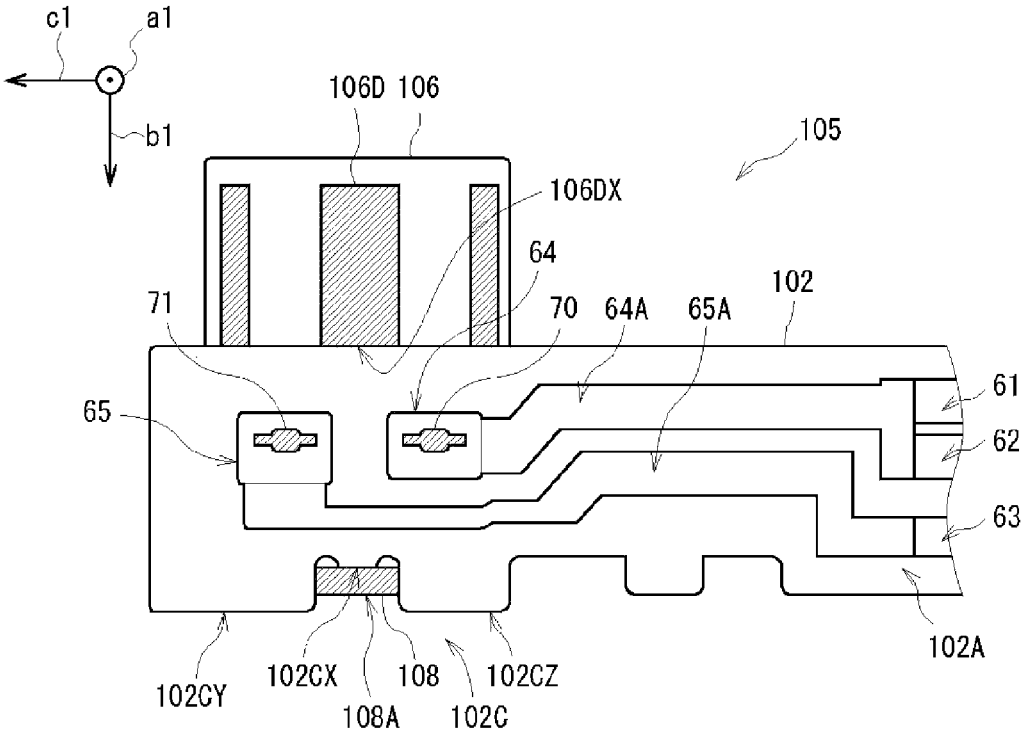
FIG. 21 is a schematic sectional view showing the left side connector and the connector side engaging portion attached to the left end portions of the heater and the pressing plate of the heater unit of the printer according to the second embodiment of the present invention.
Figure 22:
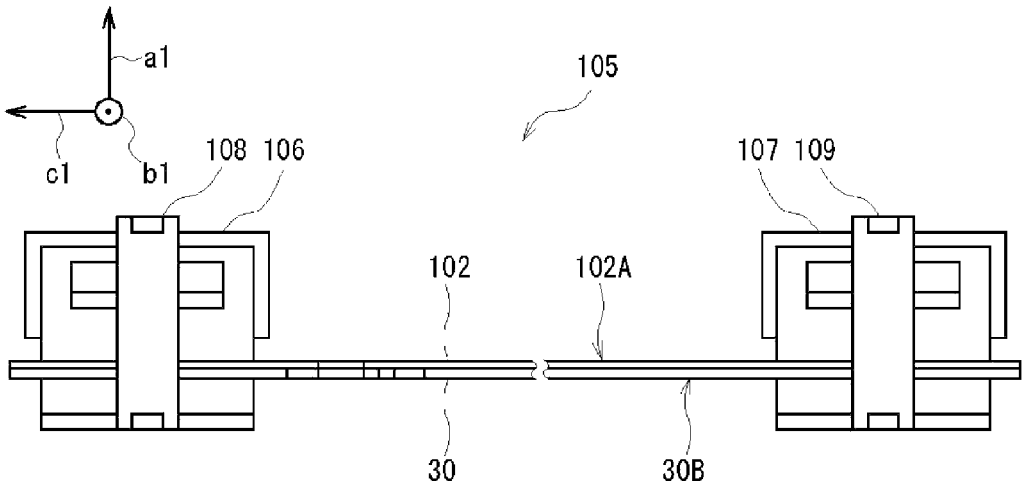
FIG. 22 is a schematic front view showing a right side connector, a connector side engaging portion, the left side connector, and the connector side engaging portion attached to the heater and the pressing plate of the heater unit of the printer according to the second embodiment of the present invention.

FIG. 21 is a schematic sectional view showing the left side connector 106 and the connector side engaging portion 108 attached to the left end portions of the heater 102 and the pressing plate 30 of the heater unit 105 of the printer 100 according to the second embodiment of the present invention. FIG. 22 is a schematic front view showing the right side connector 107, the connector side engaging portion 109, the left side connector 106, and the connector side engaging portion 108 attached to the heater 102 and the pressing plate 30 of the heater unit 105 of the printer 100 according to the second embodiment of the present invention.

First, as shown in FIG. 17, when the heater 102 and the pressing plate 30 of the heater unit 50 are held on the heat conducting portion 28 of the fixing portion 101 in the overlapped state in which the heater longitudinal direction and the plate longitudinal direction are aligned in parallel to the printer left right direction, the left end portions and the right end portions of the heater 102 and the pressing plate 30 protrude outside the frame 11 (that is, outside the left side plate and the right side plate of the frame 11). In the next step, in this state, the left side connector 106 of the heater unit 105 is guided toward the left end portions of the heater 102 and the pressing plate 30 from the rear side along the heater width direction such that the end surface of the left side connector 106 faces the left end portions of the heater 102 and the pressing plate 30.

Accordingly, as shown in FIG. 18, the left end portions of the heater 102 and the pressing plate 30 are inserted into the connector groove portion 106C of the left side connector 106 of the heater unit 105, so that the cut portion 102CX of the heater 102 is situated between the holding side engaging portion attaching groove 106AV and the protecting side engaging portion attaching groove 106BV of the left side connector 106. In the next step, the connector side engaging portion 108 of the heater unit 105 is guided toward the end surface of the left side connector 106 from the front side along the heater width direction such that the inner surface of the shoulder portion 108A of the connector side engaging portion 108 faces the end surface of the left side connector 106.

Accordingly, as shown in FIGS. 19 and 20, the shoulder portion 108A of the connector side engaging portion 108 is engaged with the holding side engaging portion attaching groove 106AV and the protecting side engaging portion attaching groove 106BV of the left side connector 106, as well as the cut portion 102CX of the heater 102. Further, the holding side engaging protrusion 106AZ and the protecting side engaging protrusion 106BZ of the left side connector 106 are inserted into and engaged with the first engaging hole portion 108BX and the second engaging hole portion 108CX of the connector side engaging portion 108. Through the process described above, it is possible to attach the left side connector 106 to the left end portion of the heater 102 at the connector attaching position thereof, and to attach the connector side engaging portion 108 to the left side connector 106 so that the left side connector 106 does not easily come off.

In the next step, when the left side connector 106 of the heater unit 105 is attached to the left end portion of the heater 102 at the connector attaching position thereof, and the connector side engaging portion 108 is attached to the left side connector 106, the contact portions of the connection terminal 70 and the connection terminal 71 of the left side connector 106 contact with the first electrode 64 and the second electrode 65 of the heater 102 on the left end portion thereof as shown in FIG. 21.

Further, as shown in FIG. 22, in the heater unit 105, after the left side connector 106 is attached to the left end portions of the heater 102 and the pressing plate 30, the right side connector 107 is attached to the right end portions of the heater 102 and the pressing plate 30 through a process similar to that of attaching the left side connector 106 to the left end portions of the heater 102 and the pressing plate 30. Afterward, the connector side engaging portion 109 is attached to the right side connector 107 through a process similar to that of attaching the connector side engaging portion 108 to the left side connector 106. Accordingly, in the heater unit 105, the contact portion of the connection terminal of the right side connector 107 contacts with the third electrode 66 of the heater 102 on the right end portion thereof.

In the second embodiment, in the heater unit 105, in the state that the connector side engaging portion 108 is attached to the left side connector 106, when the one arm portion 108B and the other arm portion 108C of the connector side engaging portion 108 are pushed away from each other, it is possible to disengage the first engaging hole portion 108BX and the second engaging hole portion 108CX from the holding side engaging protrusion 106AZ and the protecting side engaging protrusion 106BZ of the left side connector 106. Then, when the shoulder portion 108A of the connector side engaging portion 108 is pulled out toward the front side from the holding side engaging portion attaching groove 106AV and the protecting side engaging portion attaching groove 106BV of the left side connector 106, as well as the cut portion 102CX of the heater 102, it is possible to disengage the connector side engaging portion 108 from the left side connector 106. Further, in the heater unit 105, in the state that the connector side engaging portion 109 is attached to the right side connector 107, it is possible to disengage the connector side engaging portion 109 from the right side connector 107 through a process similar to the process described above.

In the second embodiment, when the left side connector 106 and the right side connector 107 are attached to the heater 102 and the pressing plate 30, and the connector side engaging portion 108 and the connector side engaging portion 109 are attached to the left side connector 106 and the right side connector 107, the control circuit 57 of the heater unit 105 is capable of performing the heating control process similar to that of the control circuit 57 of the heater unit 50 in the first embodiment.

As described above, in the second embodiment, the connector groove portion 106C of the left side connector 106 (refer to FIG. 21) has the depth substantially equal to the heater width of the narrowed portion of the heater 102. Accordingly, when the left end portions of the heater 102 and the pressing plate 30 are inserted into the connector groove portion 106C of the left side connector 106, and the rear edge of the heater 102 is pressed against the inner surface 106DX of the connecting portion 106D (also referred to as a connecting portion inner surface 106DX), bottom surfaces of the holding side engaging portion attaching groove 106AV and the protecting side engaging portion attaching groove 106BV of the left side connector 106 are flush with the bottom of the cut portion 102CX of the heater 102.

Further, in the second embodiment, when the connector side engaging portion 108 is attached to the left side connector 106, the shoulder portion 108D of the connector side engaging portion 108 is closely fitted into the holding side engaging portion attaching groove 106AV and the protecting side engaging portion attaching groove 106BV of the left side connector 106 and the cut portion 102CX of the heater 102 substantially without a space in between. Accordingly, it is possible to attach the connector side engaging portion 108 to the left side connector 106 without easily coming off in the heater width direction, and being shifted in the heater longitudinal direction.

In the second embodiment, in the heater unit 105, when the left side connector 106 is attached to the left end portion of the heater 102 at the connector attaching position thereof, and the connector side engaging portion 108 is attached to the left side connector 106, the shoulder portion 108D of the connector side engaging portion 108 is sandwiched between the first protruding portion 102CY and the second protruding portion 102CZ of the heater 102 in the heater longitudinal direction. Accordingly, the connector side engaging portion 108 is engaged with the neater side left engaging portion 102C. As a result, even when the total length of the heater 102 is changed due to thermal expansion, or an external impact is applied to the printer 100, and the connector attaching position on the left end portion of the heater 102 is shifted, it is possible to securely prevent the left side connector 106 at the connector attaching position on the left end portion of the heater 102 from being shifted in the heater longitudinal direction.

In the second embodiment, in the heater unit 105, when the left side connector 106 is attached to the left end portion of the heater 102 at the connector attaching position thereof, and the connector side engaging portion 108 is attached to the left side connector 106, the narrowed portion of the heater 102 is sandwiched between the shoulder portion 108D of the connector side engaging portion 108 and the connecting portion inner surface 106DX of the left side connector 106 in the heater width direction. Accordingly, it is possible to prevent the cut portion 102CX of the heater side left engaging portion 102C from being disengaged from the shoulder portion 108D of the connector side engaging portion 108, and it is possible to securely prevent the connector side engaging portion 108 from inadvertently being disengaged from the heater side left engaging portion 102C.

Accordingly, in the heater unit 105 in the second embodiment, it is possible to securely prevent the left side connector 106 from being shifted from the connector attaching position on the left end portion of the heater 102 in the heater longitudinal direction. As a result, in the heater unit 105, even when the total length of the heater 102 is changed due to thermal expansion, or an external impact is applied to the printer 100, and the connector attaching position on the left end portion of the heater 102 is shifted, it is possible to prevent the connection terminal 70 and the connection terminal 71 from being poorly contacted with the first electrode 64 and the second electrode 65 of the heater 102.

Further, in the heater unit 105 in the second embodiment, when the right side connector 107 is attached to the right end portion of the heater 102 at the connector attaching position thereof, and the connector side engaging portion 109 is attached to the right side connector 107, the connector side engaging portion 109 is engaged with the heater side right engaging portion 102D of the heater 102. Accordingly, in the heater unit 105, even when the total length of the heater 102 is changed due to thermal expansion, or an external impact is applied to the printer 100, and the connector attaching position on the right end portion of the heater 102 is shifted, it is possible to securely prevent the right side connector 107 from inadvertently being disengaged from the connector attaching position on the right end portion of the heater 102 in the heater longitudinal direction. As a result, even when the total length of the heater 102 is changed due to thermal expansion, or an external impact is applied to the printer 100, and the connector attaching position on the right end portion of the heater 102 is shifted, it is possible to prevent the connection terminal from being poorly contacted with the third electrode 66 of the heater 102.

An effect of the second embodiment will be explained next. As described above, in the printer 100, the heater unit 105 of the fixing portion 101 includes the heater 102. Further, the first electrode 64 and the second electrode 65 are disposed on the left end portion of the heater 102, and the third electrode 66 is disposed on the right end portion of the heater 102. Further, the heater side left engaging portion 102C having the first protruding portion 102CY and the second protruding portion 102CZ on the both sides of the cut portion 102CX protruding in the heater width direction is disposed on the left end portion of the heater 102, and the heater side right engaging portion 102D having the first protruding portion 102DY and the second protruding portion 102DZ on the both sides of the cut portion 102DX protruding in the heater width direction is disposed on the right end portion of the heater 102.

Further, in the printer 100 in the second embodiment, the heater unit 105 includes the left side connector 106 and the right side connector 107. Further, in the printer 100, the left side connector 106 includes the holding side engaging portion attaching groove 106AV on the one end surface of the terminal holding portion 106A, and the protecting side engaging portion attaching groove 106BV on the one end surface of the terminal protecting portion 106B. Similarly, the right side connector 107 includes the holding side engaging portion attaching groove on the one end surface of the terminal holding portion, and the protecting side engaging portion attaching groove on the one end surface of the terminal protecting portion. Further, in the printer 100, the heater unit 105 includes the connector side engaging portion 108 and the connector side engaging portion 109 attached to the left side connector 106 and the right side connector 107, respectively.

Further, in the heater unit 105 of the printer 100 in the second embodiment, when the left side connector 106 is attached to the left end portion of the heater 102 at the connector attaching position thereof, and the connector side engaging portion 108 is attached to the left side connector 106 through the holding side engaging portion attaching groove 106AV and the protecting side engaging portion attaching groove 106BV, the first protruding portion 102CY and the second protruding portion 102CZ of the heater side left engaging portion 102C of the heater 102 sandwich the shoulder portion 108A of the connector side engaging portion 108 in the heater longitudinal direction. Accordingly, the connector side engaging portion 108 is engaged with the heater side left engaging portion 102C of the heater 102. As a result, the contact portions of the connection terminal 70 and the connection terminal 71 of the left side connector 106 contact with the first electrode 64 and the second electrode 65 of the heater 102, respectively.

Further, in the heater unit 105 of the printer 100 in the second embodiment, when the right side connector 107 is attached to the right end portion of the heater 102 at the connector attaching position thereof, and the connector side engaging portion 109 is attached to the right side connector 107 through the holding side engaging portion attaching groove and the protecting side engaging portion attaching groove, the first protruding portion 102DY and the second protruding portion 102DZ of the heater side right engaging portion 102D of the heater 102 sandwich the shoulder portion of the connector side engaging portion 109 in the heater longitudinal direction. Accordingly, the connector side engaging portion 109 is engaged with the heater side right engaging portion 102D of the heater 102. As a result, the contact portion of the connection terminal of the right side connector 107 contacts with the third electrode 66 of the heater 102.

Accordingly, in the printer 100 in the second embodiment, in addition to the effects of the printer 1 in the first embodiment, it is possible to simplify the configuration of the heater unit 105 as compared with that of the heater unit 50. Further, in the printer 100, as compared with the heater unit 50 in the first embodiment, it is possible to simplify the operation of attaching the left side connector 106 and the right side connector 107 to the left and right end portions of the heater 102.

As described above, in the heater unit 105 of the fixing portion 101 of the printer 100 in the second embodiment, when the left side connector 106 is attached to the left end portion of the heater 102 at the connector attaching position thereof, and the connector side engaging portion 108 is attached to the one end surface of the left side connector 106, the first protruding portion 102CY and the second protruding portion 102CZ of the heater side left engaging portion 102C sandwich the connector side engaging portion 108 in the heater longitudinal direction. Accordingly, the connector side engaging portion 108 is engaged with the heater side left engaging portion 102C of the heater 102. As a result, the contact portions of the connection terminal 70 and the connection terminal 71 of the left side connector 106 contact with the first electrode 64 and the second electrode 65 of the heater 102, respectively.

Further, in the heater unit 105 of the fixing portion 101 of the printer 100 in the second embodiment, when the right side connector 107 is attached to the right end portion of the heater 102 at the connector attaching position thereof, and the connector side engaging portion 109 is attached to the one end surface of the right side connector 107, the first protruding portion 102DY and the second protruding portion 102DZ of the heater side right engaging portion 102D of the heater 102 sandwich the connector side engaging portion 109 in the heater longitudinal direction. Accordingly, the connector side engaging portion 109 is engaged with the heater side right engaging portion 102D of the heater 102. As a result, the contact portion of the connection terminal of the right side connector 107 contacts with the third electrode 66 of the heater 102.

Accordingly, in the printer 100, it is possible to simplify the configuration of the heater unit 105 as compared with that of the heater unit 50 in the first embodiment. Further, in the printer 100, as compared with the heater unit 50 in the first embodiment, it is possible to simplify the operation of attaching the left side connector 106 and the right side connector 107 to the left and right end portions of the heater 102. As a result, it is possible to improve the operability of the heater unit 105 as compared with the heater unit 50 in the first embodiment.

Third Embodiment

A third embodiment of the present invention will be explained next. First, an internal configuration of a printer 120 will be explained with reference to FIG. 1. In the third embodiment, the printer 120 has the internal configuration similar to those of the printer 1 in the first embodiment and the printer 100 in the second embodiment except a fixing portion 121 (refer to FIG. 1). Further, the printer 120 is configured to perform an operation for forming the print image on the surface of the print medium 5 through a process similar to that of the printer 1 in the first embodiment and the printer 100 in the second embodiment. Accordingly, the internal configuration of the printer 120 is referred to those of the printer 1 in the first embodiment shown in FIG. 1, and an explanation thereof is omitted.

In the third embodiment, the fixing portion 121 (refer to FIG. 2) has a configuration similar to that of the fixing portion 101 in the second embodiment except a partial configuration of a heater unit 125. Further, the fixing portion 121 is configured to perform an operation for forming the print image on the surface of the print medium 5 through a process similar to that of the fixing portion 10 of the printer 1 in the first embodiment and the fixing portion 101 of the printer 100 in the first embodiment. Accordingly, the configuration of the fixing portion 121 is referred to that of the fixing portion 10 of the printer 1 in the first embodiment shown in FIG. 2, and an explanation thereof is omitted.

Figure 23:
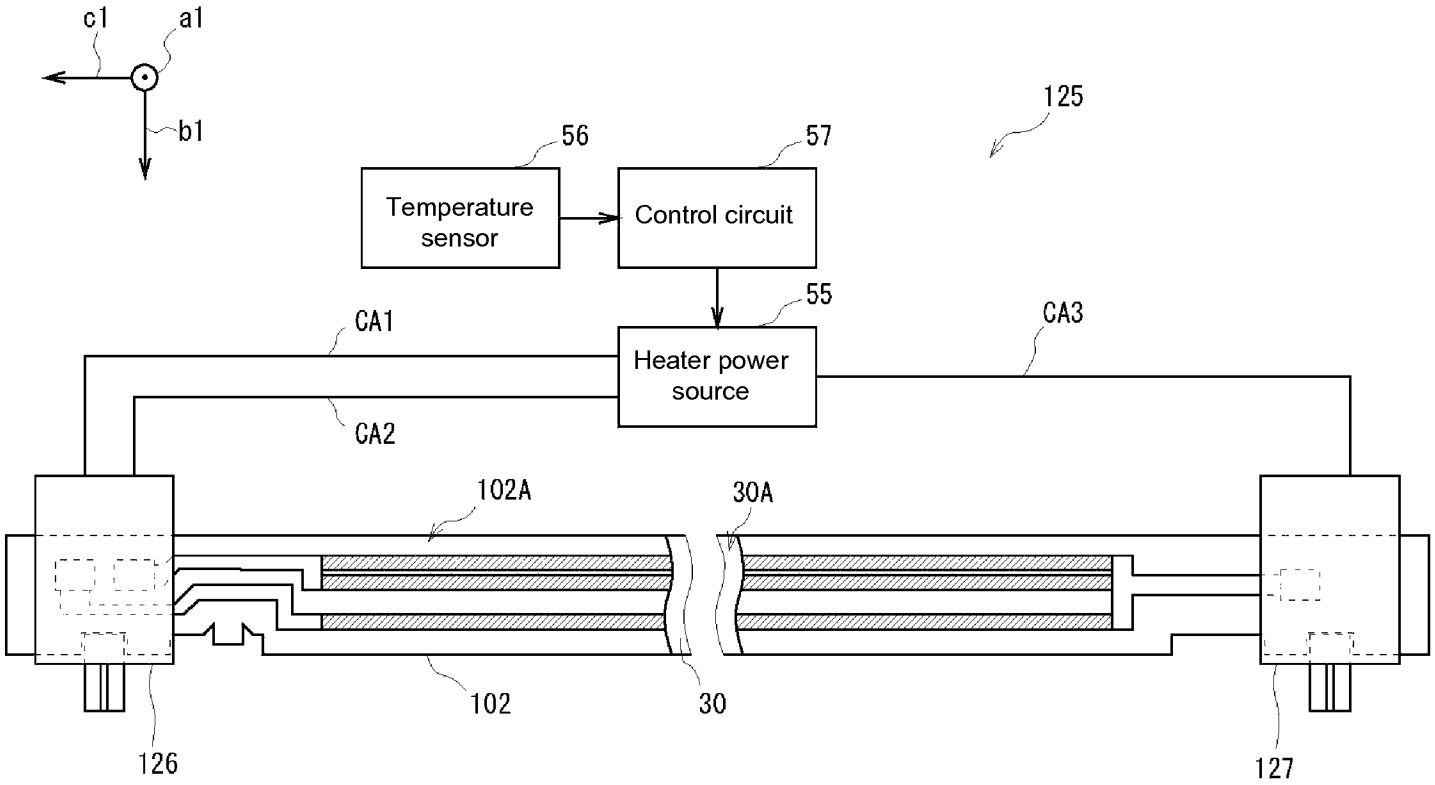
FIG. 23 is a schematic view showing a configuration of a heater unit of a printer according to a third embodiment of the present invention.

A configuration of the heater unit 125 will be explained next. FIG. 23 is a schematic view showing the configuration of the heater unit 125 of the printer 120 according to the third embodiment of the present invention. It should be noted that components shown in FIG. 23 and similar to the corresponding components in FIG. 13 are designated with the same reference numerals.

As shown in FIG. 23, the heater unit 125 includes the heater 102; a left side connector 126 and a right side connector 127 directly attached to a left end portion and a right end portion of the heater 102. It should be noted that the connector side engaging portions 108 and 109 are not provided. Other components of the heater unit 125 are similar to those of the heater unit 105 in the second embodiment.

Next, configurations of the left side connector 126 and the right side connector 127 will be explained. It should be noted that the left side connector 126 has a configuration similar to that of the right side connector 127. Accordingly, in the following description, the configuration of the left side connector 126 will be explained, and an explanation of the configuration of the right side connector 127 is omitted.

Figure 24:
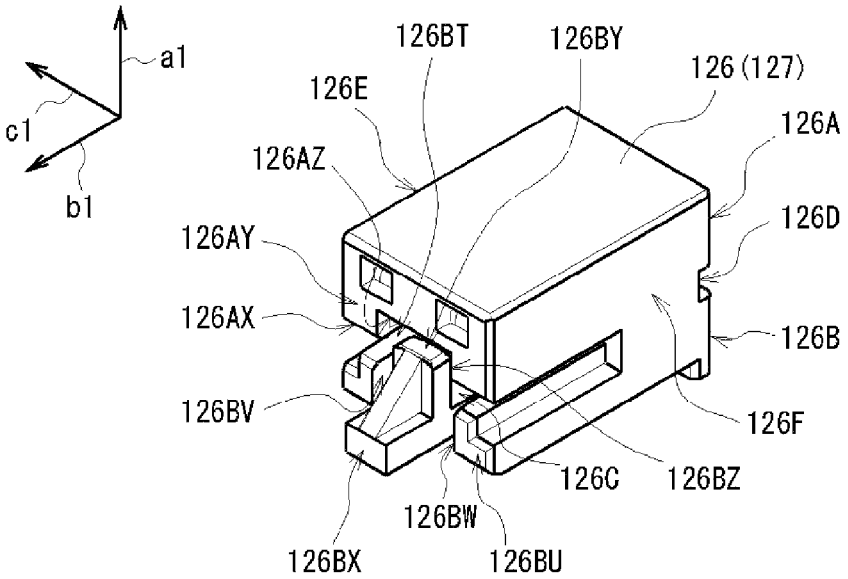
Figure 24:
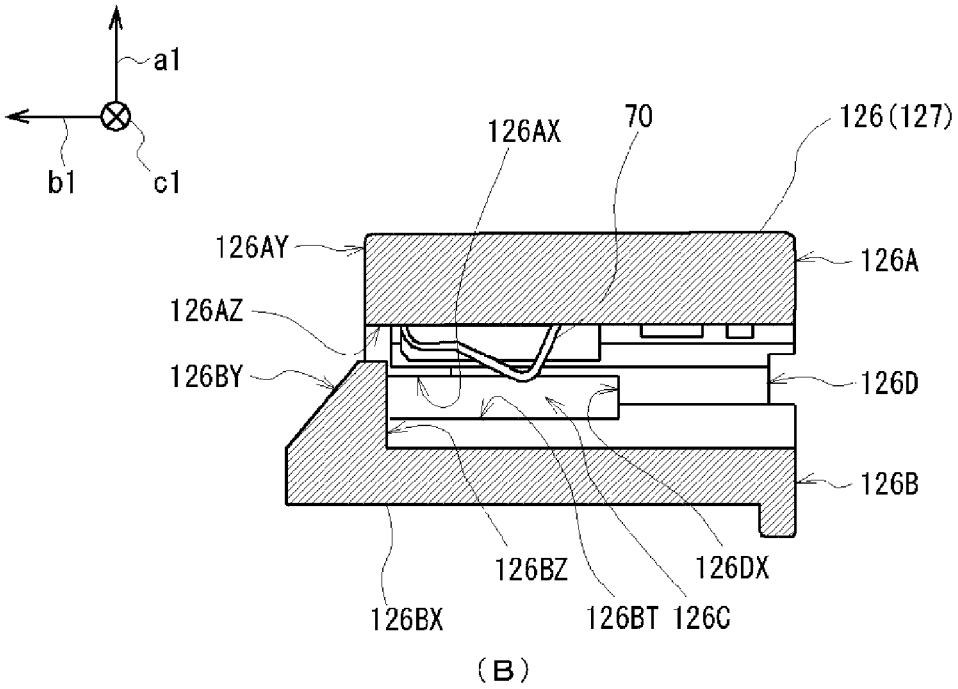

FIGS. 24(A) and 24(B) are schematic views showing the configuration of the left side connector 126 of the heater unit 125 of the printer 120 according to the third embodiment of the present invention. More specifically, FIG. 24(A) is a schematic perspective view showing the left side connector 126, and FIG. 24(B) is a schematic sectional view showing the left side connector 126.

As shown in FIGS. 24(A) and 24(B), the left side connector 126 is integrally formed in a substantially U-character shape as a whole, and is formed of a specific resin material. The left side connector 126 includes a terminal holding portion 126A having a substantially flat rectangular block shape and a terminal protecting portion 126B having a substantially flat rectangular block shape. The left side connector 126 further includes a connecting portion 126D having a column shape for connecting the terminal holding portion 126A and the terminal protecting portion 126B at one end portions of one surfaces 126AX and 126BT of the terminal holding portion 126A and the terminal protecting portion 126B, so that the one surfaces 126AX and 126BT face with each other at the other end portions thereof with a connector groove portion 126C in between.

In the third embodiment, the connector groove portion 126C of the left side connector 126 has a specific depth substantially equal to the heater width of the heater 102 at the wide width portion thereof. Further, the connector groove portion 126C of the left side connector 126 has a specific width between one side surface 126E thereof (also referred to as a connector side surface 126E) and the other side surface 126F (also referred to as a connector other side surface 126F) greater than the cut portion lateral width.

In the third embodiment, similar to the left side connector 53 in the first embodiment, the left side connector 126 further includes the connection terminal 70 and the connection terminal 71 in the terminal holding portion 126A (one thereof is shown, and the other one thereof is not shown in FIG. 24(B)). The connection terminals 70 and 71 are electrically connected to the power supply terminals of the heater power source 55 through the cables CA1 and CA2. Further, similar to the right side connector 54 in the first embodiment, the right side connector 127 includes two connection terminals in the terminal holding portion. Only one of the connection terminals is electrically connected to the power supply terminal of the heater power source 55 through the cable CA3.

In the third embodiment, in addition to the configuration described above, the left side connector 126 further includes a claw retaining recess portion 126AV on a one end surface 126AY of the terminal holding portion 126A at a central portion thereof contacting with the one surface 126AX. Further, the left side connector 126 includes a first slit 126BV and a second slit 126BW at a specific location near the connector side surface 126E and a specific location near the connector other side surface 126F, respectively. The first slit 126BV and the second slit 126BW are arranged to cover from the one end surface 126BU to a specific location of the other end portion, and extend in parallel to the connector side surface 126E and the connector other side surface 126F.

In the third embodiment, the left side connector 126 further integrally includes a connector side engaging portion 126BX having a substantially L-character shape between the first slit 126BV and the second slit 126BW. The connector side engaging portion 126BX includes a claw portion 126BY having a rectangular block shape disposed on a distal end portion thereof on a side of the one end surface 126BU such that the claw portion 126BY protrudes toward the terminal holding portion 126A. Further, the connector side engaging portion 126BX includes a base portion as a fixed end fixed to the other end of the terminal protecting portion 126B, so that the claw portion 126BY becomes a free end thereof.

Accordingly, in the third embodiment, the claw portion 126BY has a spring property, so that the claw portion 126BY can be inserted into the claw portion retaining recess portion 126AZ, or can be pulled out from the claw portion retaining recess portion 126AZ of the terminal holding portion 126A.

In the third embodiment, the connector side engaging portion 126BX further includes an end surface 126BZ adjacent to the claw portion 126BY. The end surface 126BY faces a connecting portion inner surface 126DX of the connecting portion 126D, and extends in parallel to the one end surface 126BU such that a distance between the end surface 126BY and the connecting portion inner surface 126DX is set to be substantially equal to the heater width of the narrowed portion of the heater 102. Further, the connector side engaging portion 126BX has a specific width substantially equal to the cut portion lateral width.

A process of attaching the left side connector 126 and the right side connector 127 to the heater 102 and the pressing plate 30 of the heater unit 125 will be explained with reference to FIGS. 25 to 31. As described above, the left side connector 126 has the configuration similar to that of the right side connector 127. Accordingly, the right side connector 127 is attached to the heater 102 and the pressing plate 30 in a process similar to that of the left side connector 126. Therefore, in the following description, only the process of attaching the left side connector 126 to the left end portions of the heater 102 and the pressing plate 30 will be explained, and an explanation of the process of attaching the right side connector 127 to the right end portions of the heater 102 and the pressing plate 30 is omitted.

Figure 25:
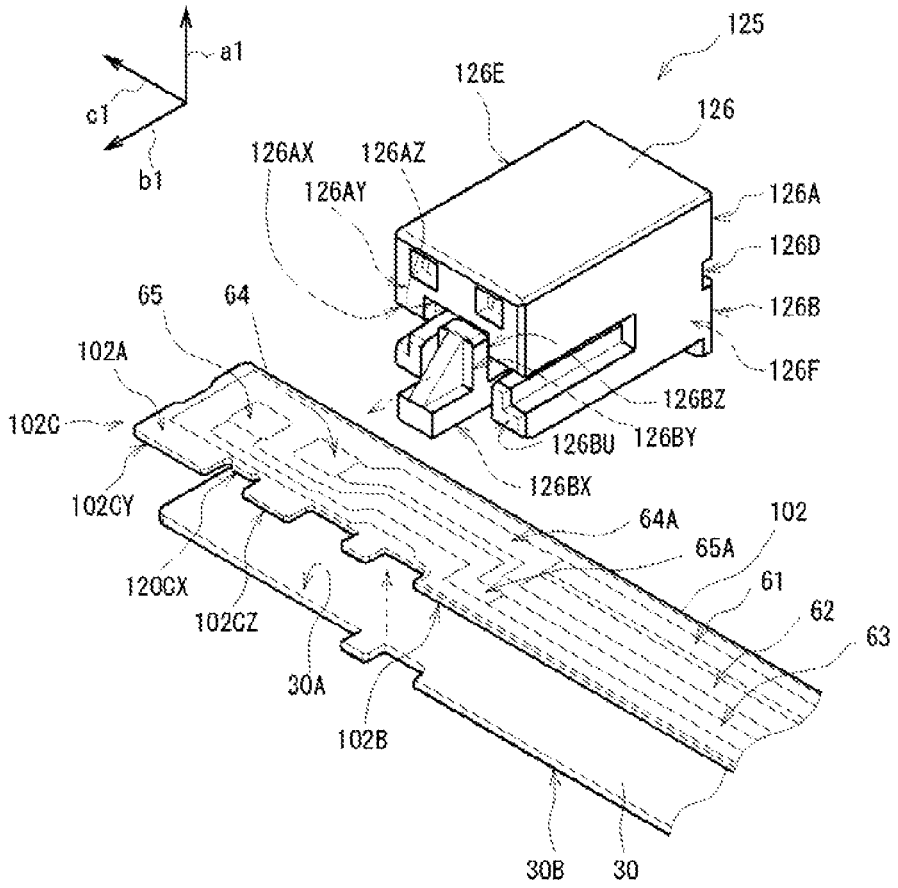
FIG. 25 is a schematic perspective view No. 1 showing the left side connector attached to left end portions of a heater and a pressing plate of the heater unit of the printer according to the third embodiment of the present invention.
Figure 26:
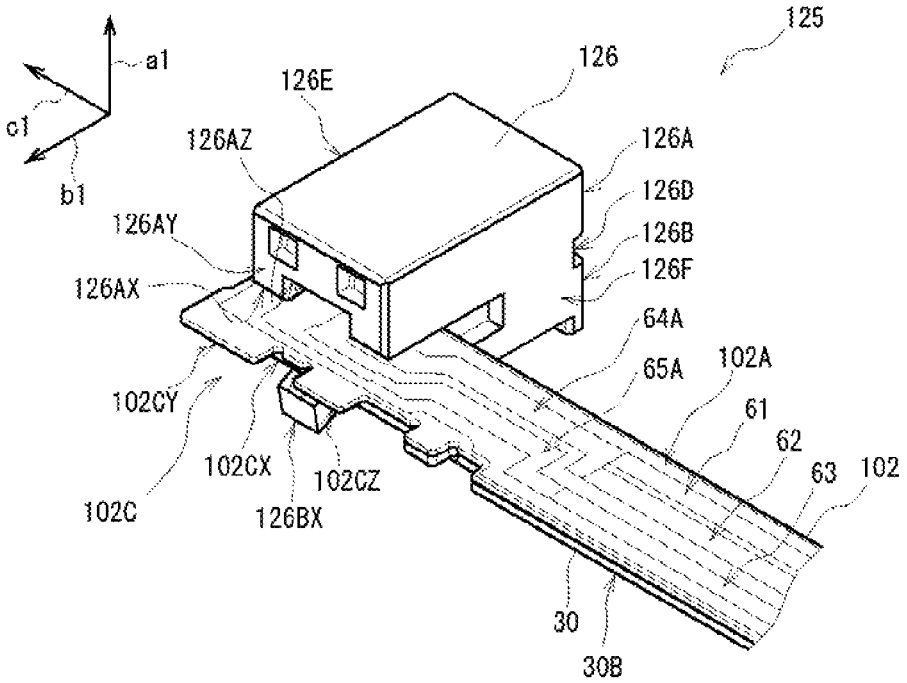
FIG. 26 is a schematic perspective view No. 2 showing the left side connector attached to the left end portions of the heater and the pressing plate of the heater unit of the printer according to the third embodiment of the present invention.
Figure 27:
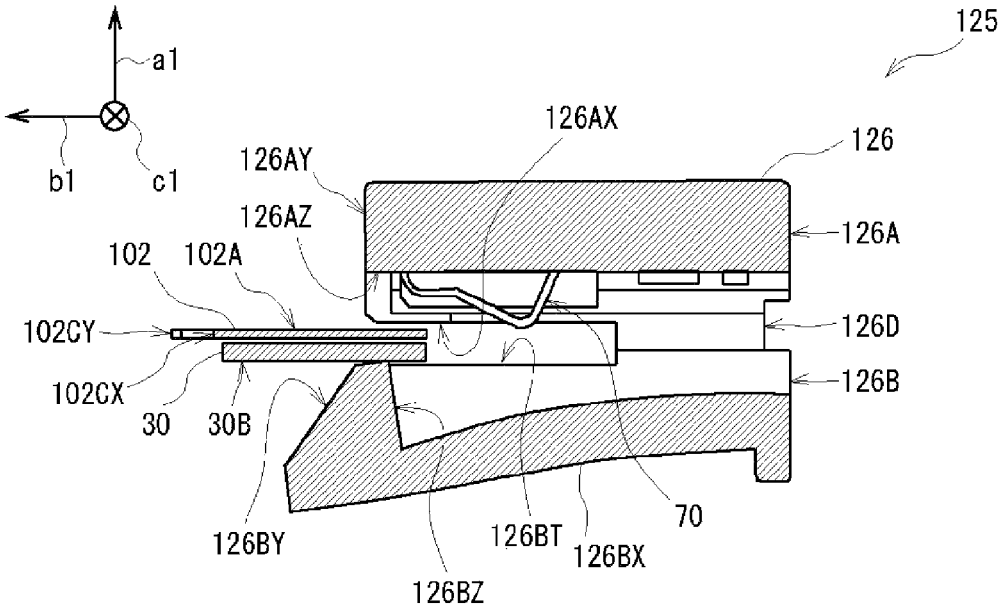
FIG. 27 is a schematic perspective view No. 3 showing the left side connector attached to the left end portions of the heater and the pressing plate of the heater unit of the printer according to the third embodiment of the present invention.

FIG. 25 is a schematic perspective view No. 1 showing the left side connector 126 attached to the left end portions of the heater 102 and the pressing plate 30 of the heater unit 125 of the printer 120 according to the third embodiment of the present invention. FIG. 26 is a schematic perspective view No. 2 showing the left side connector 126 attached to the left end portions of the heater 102 and the pressing plate 30 of the heater unit 125 of the printer 120 according to the third embodiment of the present invention. FIG. 27 is a schematic perspective view No. 3 showing the left side connector 126 attached to the left end portions of the heater 102 and the pressing plate 30 of the heater unit 125 of the printer 120 according to the third embodiment of the present invention.

Figure 28:
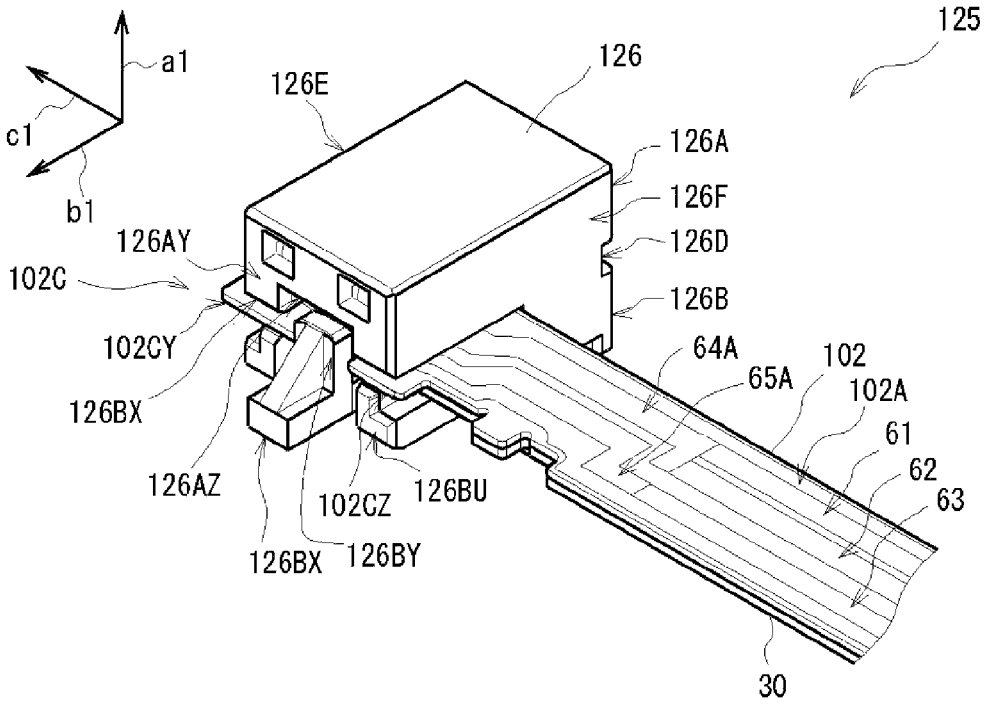
FIG. 28 is a schematic perspective view No. 4 showing the left side connector attached to the left end portions of the heater and the pressing plate of the heater unit of the printer according to the third embodiment of the present invention.
Figure 29:
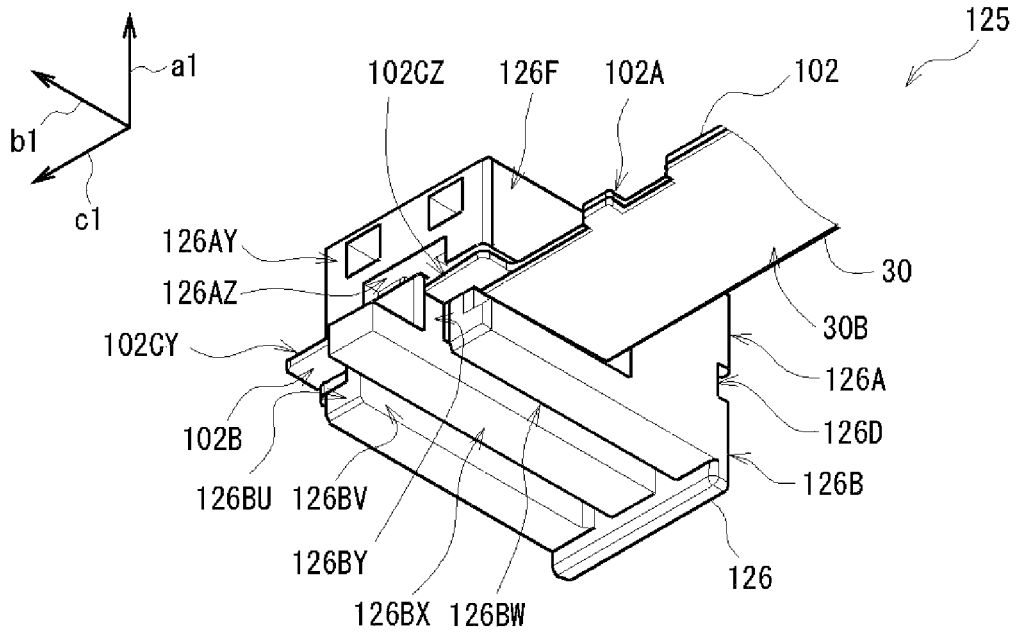
FIG. 29 is a schematic perspective view No. 5 showing the left side connector attached to the left end portions of the heater and the pressing plate of the heater unit of the printer according to the third embodiment of the present invention.

FIG. 28 is a schematic perspective view No. 4 showing the left side connector 126 attached to the left end portions of the heater 102 and the pressing plate 30 of the heater unit 125 of the printer 120 according to the third embodiment of the present invention. FIG. 29 is a schematic perspective view No. 5 showing the left side connector 126 attached to the left end portions of the heater 102 and the pressing plate 30 of the heater unit 125 of the printer 120 according to the third embodiment of the present invention.

Figure 30:
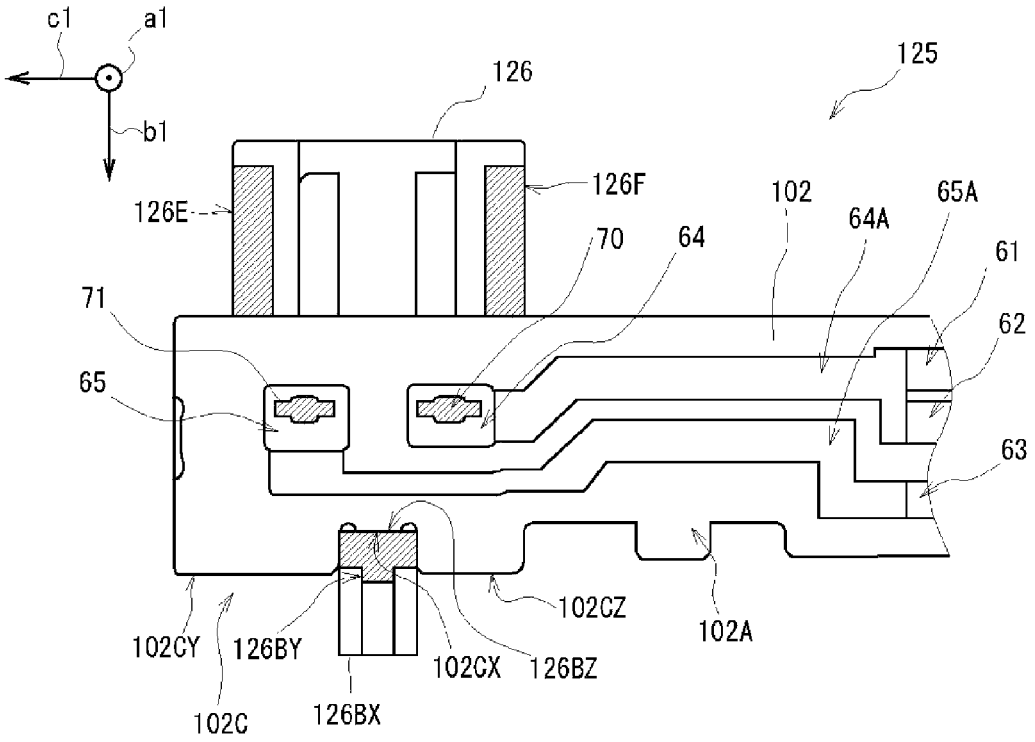
FIG. 30 is a schematic sectional view showing the left side connector attached to the left end portions of the heater and the pressing plate of the heater unit of the printer according to the third embodiment of the present invention.
Figure 31:
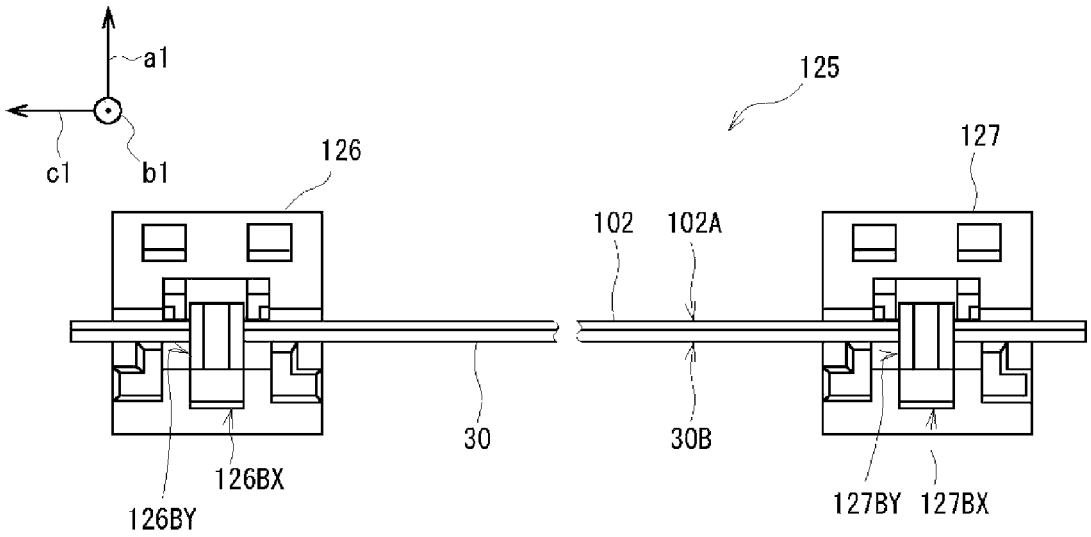
FIG. 31 is a schematic front view showing a right side connector and the left side connector attached to the heater and the pressing plate of the heater unit of the printer according to the third embodiment of the present invention.

FIG. 30 is a schematic sectional view showing the left side connector 126 attached to the heater 102 and the pressing plate 30 of the heater unit 125 of the printer 120 according to the third embodiment of the present invention. FIG. 31 is a schematic front view showing the left side connector 126 and the right side connector 127 attached to the heater 102 and the pressing plate 30 of the heater unit 125 of the printer 120 according to the third embodiment of the present invention.

First, as shown in FIG. 25, when the heater 102 and the pressing plate 30 of the heater unit 125 are held on the heat conducting portion 28 of the fixing portion 121 in the overlapped state in which the heater longitudinal direction and the plate longitudinal direction are aligned in parallel to the printer left right direction, the left end portions and the right end portions of the heater 102 and the pressing plate 30 protrude outside the frame 11 (that is, outside the left side plate and the right side plate of the frame 11). In the next step, in this state, the left side connector 126 of the heater unit 125 is guided toward the left end portions of the heater 102 and the pressing plate 30 from the rear side along the heater width direction such that the end surfaces 126AY and 126BU of the left side connector 126 face the left end portions of the heater 102 and the pressing plate 30.

Accordingly, as shown in FIGS. 26 and 27, the left end portions of the heater 102 and the pressing plate 30 are inserted into the connector groove portion 126C of the left side connector 126 of the heater unit 125, so that the claw portion 126BY of the left side connector 126 is deformed and slipped into below the other surface 30B of the pressing plate 30 while sliding against the other surface 30B.

In the next step, as shown in FIGS. 28 and 29, when the left end portions of the heater 102 and the pressing plate 30 are inserted into the back side of the connector groove portion 126C of the left side connector 126 of the heater unit 125, the distal end portion of the claw portion 126BY is inserted into the claw portion retaining recess portion 126AV of the terminal holding portion 126A such that the connector side engaging portion 126BX of the left side connector 126 thus deformed is returned to the original shape.

Accordingly, the claw portion 126BY of the left side connector 126 of the heater unit 125 is engaged with the cut portion 102CX of the heater 102 while the end surface 126BZ of the claw portion 126BY of the connector side engaging portion 126A is abutting against the bottom of the cut portion 102CX of the heater 102. Through the process described above, it is possible to attach the left side connector 126 to the left end portion of the heater 102 at the connector attaching position thereof, so that the left side connector 126 does not easily come off.

As shown in FIG. 30, when the left side connector 126 of the heater unit 125 is attached to the left end portion of the heater 102 at the connector attaching position thereof, the contact portions of the connection terminal 70 and the connection terminal 71 of the left side connector 126 contact with the first electrode 64 and the second electrode 65 of the heater 102 on the left end portion thereof.

Further, as shown in FIG. 31, in the heater unit 125, after the left side connector 126 is attached to the left end portions of the heater 102 and the pressing plate 30, the right side connector 127 is attached to the right end portions of the heater 102 and the pressing plate 30 through a process similar to that of attaching the left side connector 126 to the left end portions of the heater 102 and the pressing plate 30. More specifically, it is possible to attach the right side connector 127 of the heater unit 125 to the right end portion of the heater 102 at the connector attaching position thereof. Accordingly, in the heater unit 125, the contact portion of the connection terminal of the right side connector 127 contacts with the third electrode 66 of the heater 102 on the right end portion thereof.

In the third embodiment, in the heater unit 125, in the state that the left side connector 126 is attached to the left end portions of the heater 102 and the pressing plate 30, when the claw portion 126BY of the connector side engaging portion 126B of the left side connector 126 is pushed down, it is possible to disengage the claw portion 126BY of the connector side engaging portion 126B from the cut portion 102CX of the heater 102. Then, when the left side connector 126 is pulled out from the left end portions of the heater 102 and the pressing plate 30, it is possible to disengage the left side connector 126 from the heater 102 and the pressing plate 30. Further, in the heater unit 125, in the state that the right side connector 127 is attached to the right end portions of the heater 102 and the pressing plate 30, it is possible to disengage the right side connector 127 from the heater 102 and the pressing plate 30 through a process similar to the process described above.

In the third embodiment, in the heater unit 125, when the left side connector 126 and the right side connector 127 are attached to the heater 102 and the pressing plate 30, the control circuit 57 of the heater unit 125 is capable of performing the heating control process similar to that of the control circuit 57 of the heater unit 50 in the first embodiment.

As described above, in the third embodiment, the left side connector 126 (refer to FIG. 30) has the distance between the end surface 126BZ of the claw portion 126BY of the connector side engaging portion 126BX and the connecting portion inner surface 126DX substantially equal to the heater width of the narrowed portion of the heater 102. Accordingly, when the left end portions of the heater 102 and the pressing plate 30 are inserted into the connector groove portion 126C of the left side connector 126, and the rear edge of the heater 102 is pressed against the connecting portion inner surface 126DX of the connecting portion 126D, the claw portion 126BY of the connector side engaging portion 126BX is closely fitted into the cut portion 102CX of the heater 102 without any space in between.

Accordingly, in the heater unit 125 in the third embodiment, the first protruding portion 102CY and the second protruding portion 102CZ of the heater side left engaging portion 102C sandwich the claw portion 126BY of the connector side engaging portion 126BX in the heater longitudinal direction, so that the connector side engaging portion 126BX is engaged with the heater side left engaging portion 102C. As a result, even when the total length of the heater 102 is changed due to thermal expansion, or an external impact is applied to the printer 120, and the connector attaching position on the left end portion of the heater 102 is shifted, it is possible to prevent the left side connector 126 from being shifted from the connector attaching position on the left end portion of the heater 102 in the heater longitudinal direction.

Further, in the heater unit 125 in the third embodiment, the narrowed portion of the heater 102 on the left end portion thereof is sandwiched between the claw portion 126BY of the connector side engaging portion 126BX and the connecting portion inner surface 126DX in the heater width direction. Accordingly, it is possible to prevent the heater 102 from being shifted in the heater width direction within the connector groove portion 126C of the left side connector 126, and to prevent the cut portion 102CX of the heater side left engaging portion 102C from being disengaged from the claw portion 126BY of the connector side engaging portion 126BX.

Accordingly, in the heater unit 125 in the third embodiment, it is possible to securely prevent the left side connector 126 from being shifted from the connector attaching position on the left end portion of the heater 102 in the heater longitudinal direction. As a result, in the heater unit 125, even when the total length of the heater 102 is changed due to thermal expansion, or an external impact is applied to the printer 120, and the connector attaching position on the left end portion of the heater 102 is shifted, it is possible to prevent the connection terminal 70 and the connection terminal 71 from being poorly contacted with the first electrode 64 and the second electrode 65 of the heater 102.

Further, in the heater unit 125 in the third embodiment, when the right side connector 127 is attached to the right end portion of the heater 102 at the connector attaching position thereof, similar to the left side connector 126, the first protruding portion 102DY and the second protruding portion 102DZ of the heater side right engaging portion 102D sandwich the claw portion 126BY of the connector side engaging portion 126BX in the heater longitudinal direction, so that the connector side engaging portion 126BX is engaged with the heater side right engaging portion 102D.

Accordingly, in the heater unit 125 in the third embodiment, even when the total length of the heater 102 is changed due to thermal expansion, or an external impact is applied to the printer 120, and the connector attaching position on the left end portion of the heater 102 is shifted, it is possible to prevent the right side connector 127 from being shifted from the connector attaching position on the right end portion of the heater 102 in the heater longitudinal direction. As a result, in the heater unit 125, even when the total length of the heater 102 is changed due to thermal expansion, or an external impact is applied to the printer 120, and the connector attaching position on the right end portion of the heater 102 is shifted, it is possible to prevent the connection terminal of the right side connector 127 from being poorly contacted with the third electrode 66 of the heater 102.

An effect of the third embodiment will be explained next. As described above, in the printer 120, the heater unit 125 of the fixing portion 121 includes the left side connector 126 and the right side connector 127. Further, the left side connector 126 and the right side connector 127 include the connector side engaging portion 126BX and the connector side engaging portion 127BX, respectively. Further, in the printer 120, when the left side connector 126 is attached to the left end portion of the heater 102, the first protruding portion 102CY and the second protruding portion 102CZ of the heater side left engaging portion 102C sandwich the claw portion 126BY of the connector side engaging portion 126BX in the heater longitudinal direction, so that the connector side engaging portion 126BX is engaged with the heater side left engaging portion 102C. Accordingly, the contact portions of the connection terminal 70 and the connection terminal 71 of the left side connector 126 contact with the first electrode 64 and the second electrode 65 of the heater 102 on the left end portion thereof.

Further, in the printer 120 in the third embodiment, when the right side connector 127 is attached to the right end portion of the heater 102, the first protruding portion 102DY and the second protruding portion 102DZ of the heater side right engaging portion 102D sandwich the claw portion 127BY of the connector side engaging portion 127BX in the heater longitudinal direction, so that the connector side engaging portion 127BX is engaged with the heater side left engaging portion 102D. Accordingly, in the heater unit 125, the contact portion of the connection terminal of the right side connector 127 contacts with the third electrode 66 of the heater 102 on the right end portion thereof.

Accordingly, in the printer 120 in the third embodiment, in addition to the effects of the printer 1 in the first embodiment, it is possible to simplify the configuration of the heater unit 125 as compared with that of the heater unit 105 in the second embodiment. Further, in the printer 120, as compared with the heater unit 105 in the second embodiment, it is possible to simplify the operation of attaching the left side connector 126 and the right side connector 127 to the left and right end portions of the heater 102. Further, in the printer 120, the left side connector 126 and the right side connector 127 are directly attached to the left and right end portions of the heater 102 at the connector attaching positions thereof without using a separate component. Accordingly, it is possible to improve assembly accuracy.

As described above, in the heater unit 125 of the fixing portion 121 of the printer 120 in the third embodiment, when the left side connector 126 is attached to the left end portion of the heater 102, the first protruding portion 102CY and the second protruding portion 102CZ of the heater side left engaging portion 102C sandwich the claw portion 126BY of the connector side engaging portion 126BX in the heater longitudinal direction, so that the connector side engaging portion 126BX is engaged with the heater side left engaging portion 102C. Accordingly, the contact portions of the connection terminal 70 and the connection terminal 71 of the left side connector 126 contact with the first electrode 64 and the second electrode 65 of the heater 102 on the left end portion thereof.

Further, in the printer 120 of the fixing portion 121 of the printer 120 in the third embodiment, when the right side connector 127 is attached to the right end portion of the heater 102, the first protruding portion 102DY and the second protruding portion 102DZ of the heater side right engaging portion 102D sandwich the claw portion 127BY of the connector side engaging portion 127BX in the heater longitudinal direction, so that the connector side engaging portion 127BX is engaged with the heater side left engaging portion 102D. Accordingly, in the heater unit 125, the contact portion of the connection terminal of the right side connector 127 contacts with the third electrode 66 of the heater 102 on the right end portion thereof.

Accordingly, in the printer 120 in the third embodiment, it is possible to simplify the configuration of the heater unit 125 as compared with that of the heater unit 105 in the second embodiment. Further, in the printer 120, as compared with the heater unit 105 in the second embodiment, it is possible to simplify the operation of attaching the left side connector 126 and the right side connector 127 to the left and right end portions of the heater 102. Accordingly, it is possible to improve the operability of the heater unit 125 as compared with the heater unit 105 in the second embodiment.

Fourth Embodiment

A fourth embodiment of the present invention will be explained next. As described above, in the first embodiment, the left side holder 51 and the right side holder 52 of the heater unit 50 are engaged with the left and right end portions of the heater 29. Alternatively, it may be configured such that the left side connector 53 and the right side connector 54 are engaged with the left and right end portions of the heater 29. In the fourth embodiment, a heater unit 130 is configured to realize such a configuration.

Figure 32:
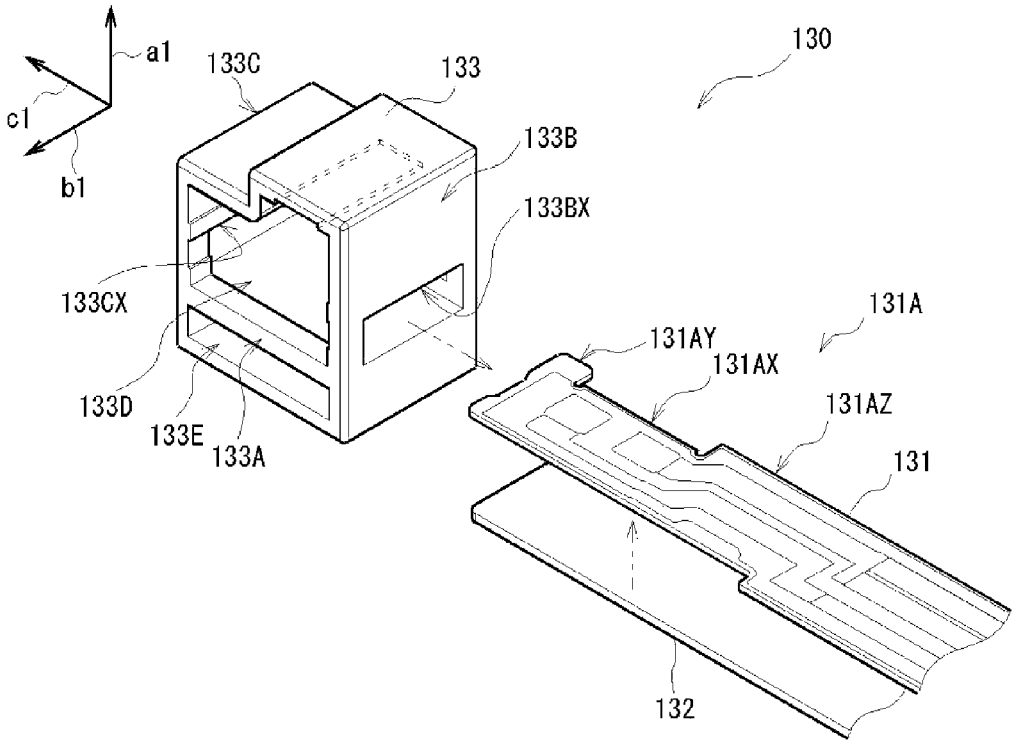
FIG. 32 is a schematic perspective view No. 1 showing a left side connector and a left side holder attached to left end portions of a heater and a pressing plate of a heater unit of a printer according to a fourth embodiment of the present invention.
Figure 33:
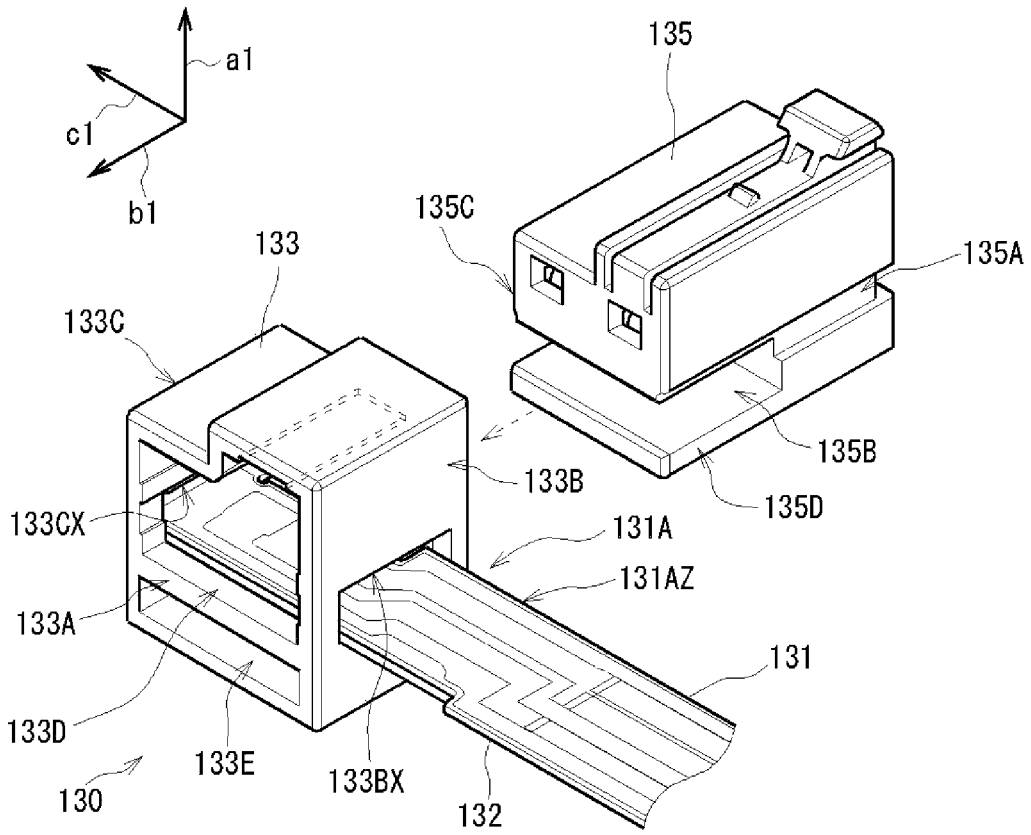
FIG. 33 is a schematic perspective view No. 2 showing the left side connector and the left side holder attached to the left end portions of the heater and the pressing plate of the heater unit of the printer according to the fourth embodiment of the present invention.
Figure 34:
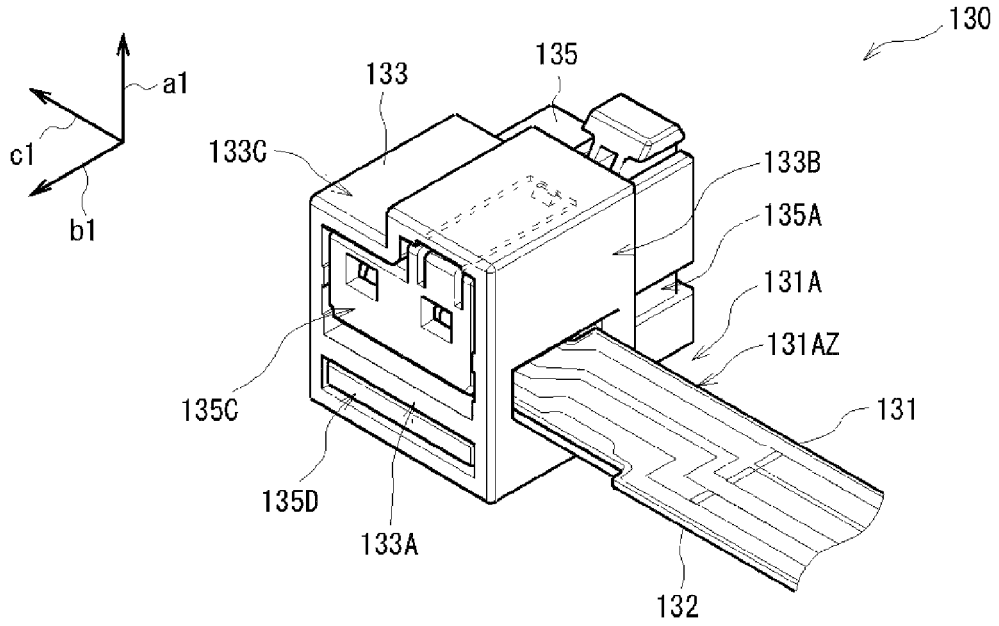
FIG. 34 is a schematic perspective view No. 3 showing the left side connector and the left side holder attached to the left end portions of the heater and the pressing plate of the heater unit of the printer according to the fourth embodiment of the present invention.

FIG. 32 is a schematic perspective view No. 1 showing a left side connector 135 and a left side holder 133 attached to left end portions of a heater 131 and a pressing plate 132 of the heater unit 130 of a printer according to the fourth embodiment of the present invention. FIG. 33 is a schematic perspective view No. 2 showing the left side connector 135 and the left side holder 133 attached to the left end portions of the heater 131 and the pressing plate 132 of the heater unit 130 of the printer according to the fourth embodiment of the present invention. FIG. 34 is a schematic perspective view No. 3 showing the left side connector 135 and the left side holder 133 attached to the left end portions of the heater 131 and the pressing plate 132 of the heater unit 130 of the printer according to the fourth embodiment of the present invention.

Figure 35:
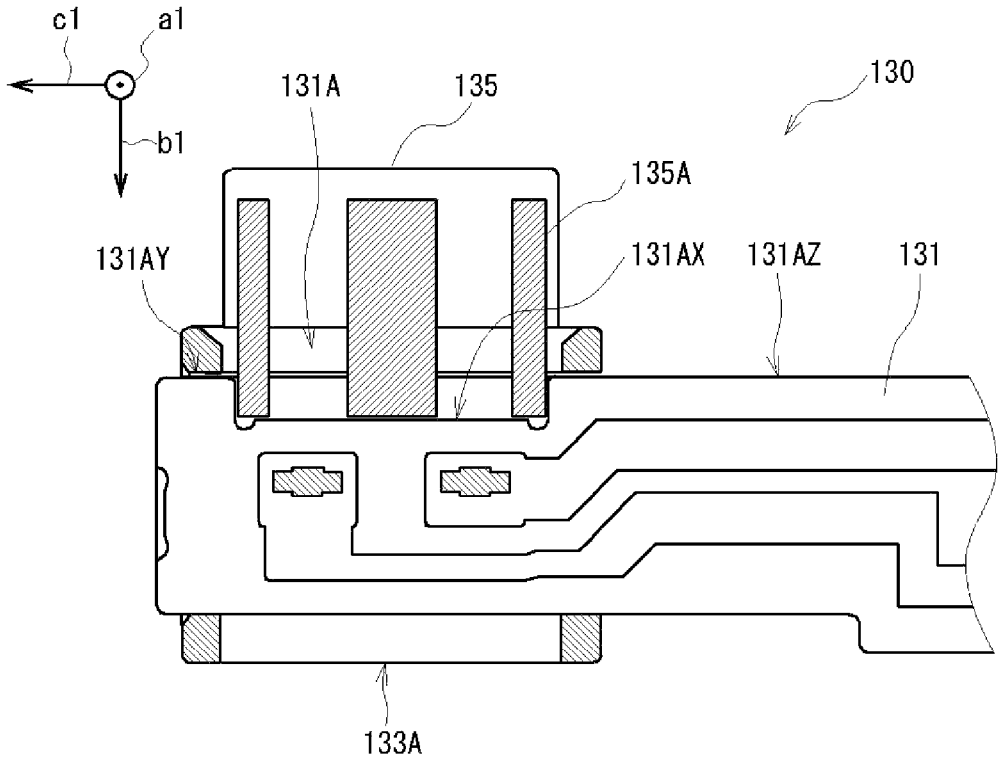
FIG. 35 is a schematic sectional view showing the left side connector and the left side holder attached to the left end portions of the heater and the pressing plate of the heater unit of the printer according to the fourth embodiment of the present invention.
Figure 36:
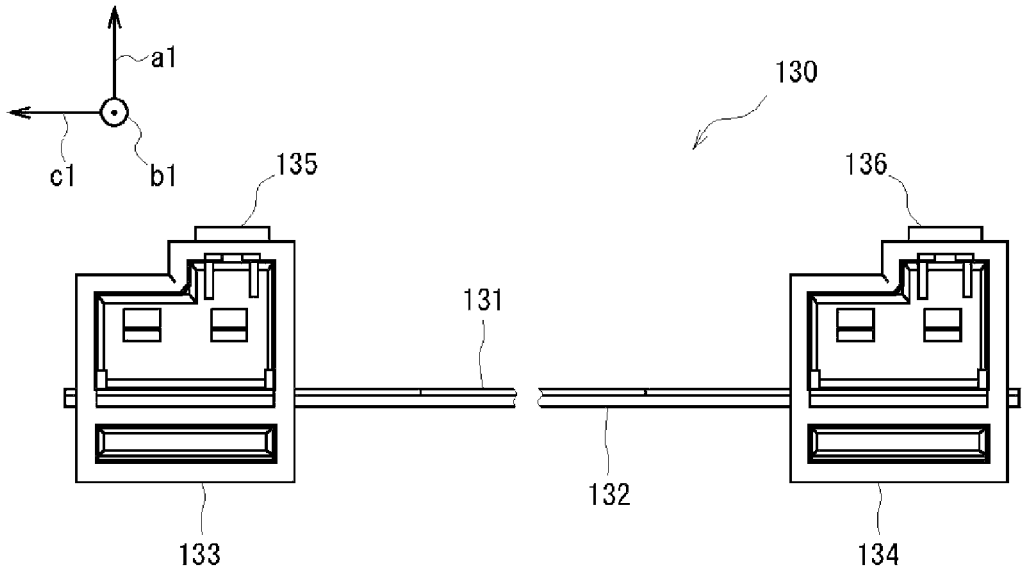
FIG. 36 is a schematic front view showing a right side connector, a right side holder, the left side connector, and the left side holder attached to the heater and the pressing plate of the heater unit of the printer according to the fourth embodiment of the present invention.

FIG. 35 is a schematic sectional view showing the left side connector 135 and the left side holder 133 attached to the left end portions of the heater 131 and the pressing plate 132 of the heater unit 130 of the printer according to the fourth embodiment of the present invention. FIG. 36 is a schematic front view showing a right side connector 136, a right side holder 134, the left side connector 135, and the left side holder 133 attached to the heater 131 and the pressing plate 132 of the heater unit 130 of the printer according to the fourth embodiment of the present invention.

As shown in FIGS. 32 to 36, the heater unit 130 includes the heater 131 having the left and right end portions having a similar configuration; the pressing plate 132; the left side holder 133 and the right side holder 134 having a similar configuration; and the left side connector 135 and the right side connector 136 having a similar configuration.

In the fourth embodiment, the heater 131 has a cut portion 131AX on the left end portion thereof at a specific location on a rear edge thereof, and the cut portion 131AX has a length in the heater longitudinal direction substantially equal to a width of a connecting portion of the left side connector 135. A first protruding portion 131AY and a second protruding portion 131AZ are formed on both sides of the cut portion 131AX to protrude toward the heater width direction (that is, toward the rear side). Accordingly, the heater 131 includes a heater side left engaging portion 131A formed of the cut portion 131AX, the first protruding portion 131AY, and the second protruding portion 131AZ on the left end portion thereof.

Further, in the fourth embodiment, the left side connector 135 includes the connecting portion as a connector side engaging portion 135A. Further, the left side holder 133 is configured such that a distance from one opening portion thereof to the other opening portion thereof is greater than a depth of a connector groove portion 135B of the left side connector 135. Further, the left side holder 133 includes a dividing plate 133A having a length substantially equal to a length of the connector groove portion 135B.

In the fourth embodiment, as shown in FIG. 32, when the left side holder 133 is attached to the heater 131 and the pressing plate 132, first, the left side holder 133 of the heater unit 130 is guided toward the left end portions of the heater 131 and the pressing plate 132 from the left side along the heater longitudinal direction such that one side plate 133B of the left side holder 133 faces the left end portions of the heater 131 and the pressing plate 132. Then, the left end portions of the heater 131 and the pressing plate 132 are inserted into a heater plate insertion hole 133BX formed in the one side plate 133B and a heater plate insertion hole 133CX formed in the other side plate 133C of the left side holder 133.

In the next step, as shown in FIG. 33, after the cut portion 131AX of the heater 131 on the left end portion thereof and the left end portion of the pressing plate 132 are inserted into a holding portion insertion hole 133D of the left side holder 133, the left side connector 135 of the heater unit 130 is guided toward the one opening portion of the left side holder 133 from the rear side along the heater width direction such that one end surface of a terminal holding portion 135C and one end surface of a terminal protecting portion 135D of the left side connector 135 face the one opening portion of the left side holder 133.

In the next step, as shown in FIG. 34, in the heater unit 130, the terminal holding portion 135A and the terminal protecting portion 135B of the left side connector 135 are inserted into the holding portion insertion hole 133D and the protecting portion insertion hole 133E of the left side holder 133 up to a specific standard position. Accordingly, the left side connector 135 is engaged with the left side holder 133 so that the left side connector 135 does not easily come off.

As shown in FIG. 35, in the heater unit 130, when the terminal holding portion 135C of the left side connector 135 and an end portion of the connector side engaging portion 135A are inserted into the holding portion insertion hole 133D of the left side holder 133, the connector side engaging portion 135A is closely fitted in the cut portion 131AX of the heater side engaging portion 131A without any space. Accordingly, the connector side engaging portion 135A of the left side connector 135 is sandwiched between a first protruding portion 131AY and a second protruding portion 131AZ of a heater side engaging portion 131A in the heater longitudinal direction, so that the connector side engaging portion 135A is engaged with the heater side engaging portion 131A.

Further, as shown in FIG. 36, in the heater unit 130, after the left side holder 133 and the left side connector 135 are attached to the left end portions of the heater 131 and the pressing plate 132 at the connector attaching positions thereof, the right side holder 134 and the right side connector 136 are attached to the right end portions of the heater 131 and the pressing plate 132 at the connector attaching positions thereof through a process similar to that of attaching the left side holder 133 and the left side connector 135 to the left end portions of the heater 131 and the pressing plate 132.

As described above, in the fourth embodiment, the left side connector 135 and the right side connector 136 are engaged with the left and right end portions of the heater 131. As a result, even when the total length of the heater 131 is changed due to thermal expansion, or an external impact is applied to the printer, and the connector attaching positions on the left and right end portions of the heater 131 are shifted, it is possible to prevent the left side holder 133 and the right side holder 134 as well as the left side connector 135 and the right side connector 136 held with the left side holder 133 and the right side holder 134 at the connector attaching positions on the left and right end portions of the heater 131 from being shifted from the connector attaching positions on the left and right end portions of the heater 131 in the heater longitudinal direction. Accordingly, it is possible to obtain an effect similar to that in the first embodiment.

Fifth Embodiment

A fifth embodiment of the present invention will be explained next. As described above, in the first embodiment to the third embodiment, in the heater unit 50, the heater unit 105, and the heater unit 125, the left side connector 53, the left side connector 106, and the left side connector 126 as well as the right side connector 54, the right side connector 107, and the right side connector 127 are attached to the left and right end portions of the heater 29 and the heater 102 at the connector attaching positions thereof in the heater width direction. Alternatively, it may be configured such that in the heater unit 50, the heater unit 105, and the heater unit 125, the left side connector 53, the left side connector 106, and the left side connector 126 as well as the right side connector 54, the right side connector 107, and the right side connector 127 are attached to the left and right end portions of the heater 29 and the heater 102 at the connector attaching positions thereof in the heater longitudinal direction. In the fifth embodiment, a heater unit 140 is configured to realize such a configuration.

Figure 37:
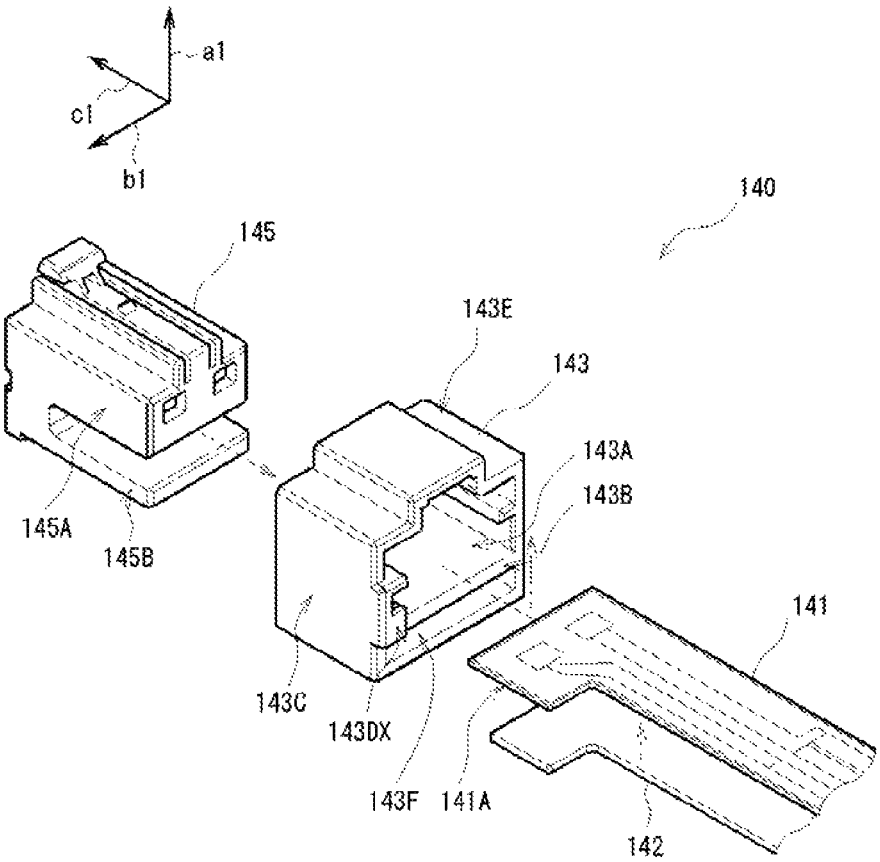
FIG. 37 is a schematic perspective view No. 1 showing a left side connector and a left side holder attached to left end portions of a heater and a pressing plate of a heater unit of a printer according to a fifth embodiment of the present invention.
Figure 38:
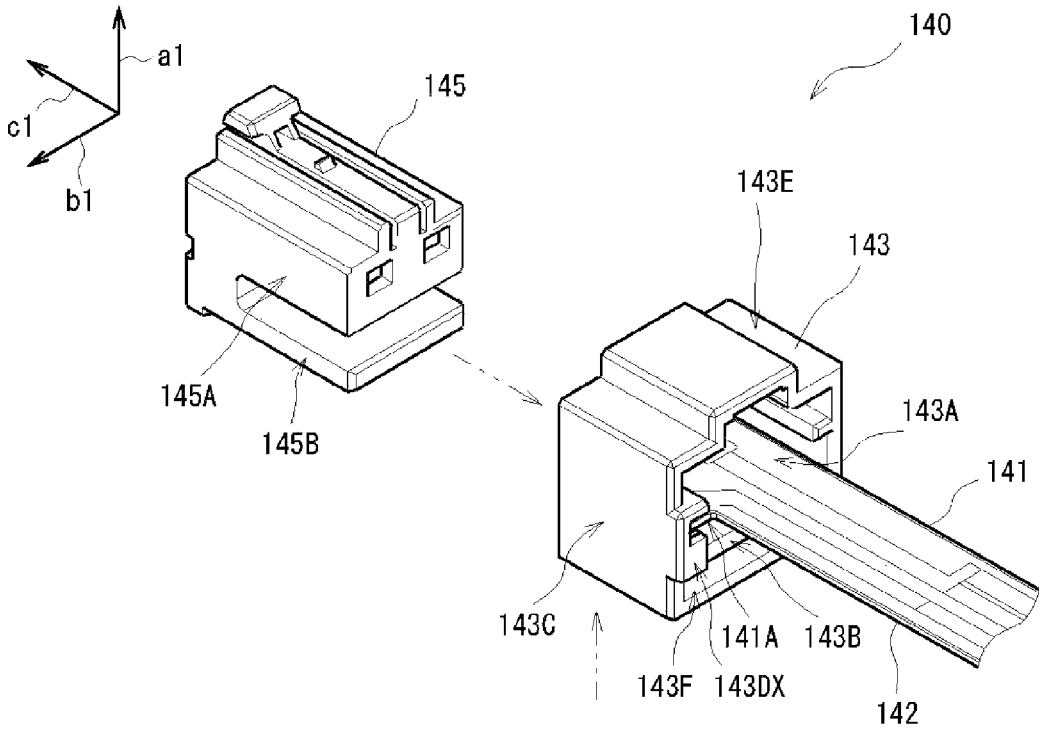
FIG. 38 is a schematic perspective view No. 2 showing the left side connector and the left side holder attached to the left end portions of the heater and the pressing plate of the heater unit of the printer according to the fifth embodiment of the present invention.
Figure 39:
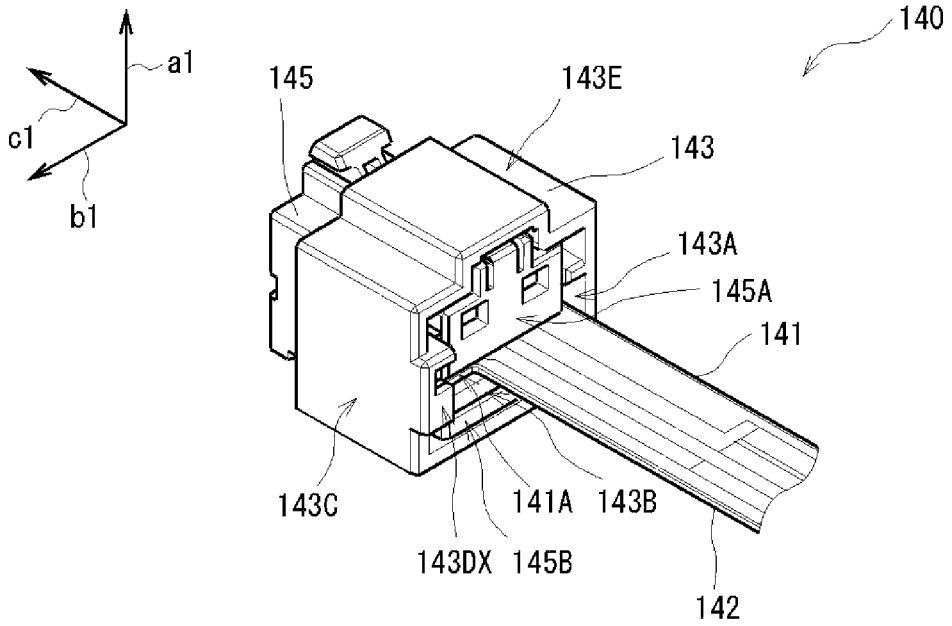
FIG. 39 is a schematic perspective view No. 3 showing the left side connector and the left side holder attached to the left end portions of the heater and the pressing plate of the heater unit of the printer according to the fifth embodiment of the present invention.

FIG. 37 is a schematic perspective view No. 1 showing a left side connector 145 and a left side holder 143 attached to left end portions of a heater 141 and a pressing plate 142 of the heater unit 140 of a printer according to the fifth embodiment of the present invention. FIG. 38 is a schematic perspective view No. 2 showing the left side connector 145 and the left side holder 143 attached to the left end portions of the heater 141 and the pressing plate 142 of the heater unit 140 of the printer according to the fifth embodiment of the present invention. FIG. 39 is a schematic perspective view No. 3 showing the left side connector 145 and the left side holder 143 attached to the left end portions of the heater 141 and the pressing plate 142 of the heater unit 140 of the printer according to the fifth embodiment of the present invention.

Figure 40:
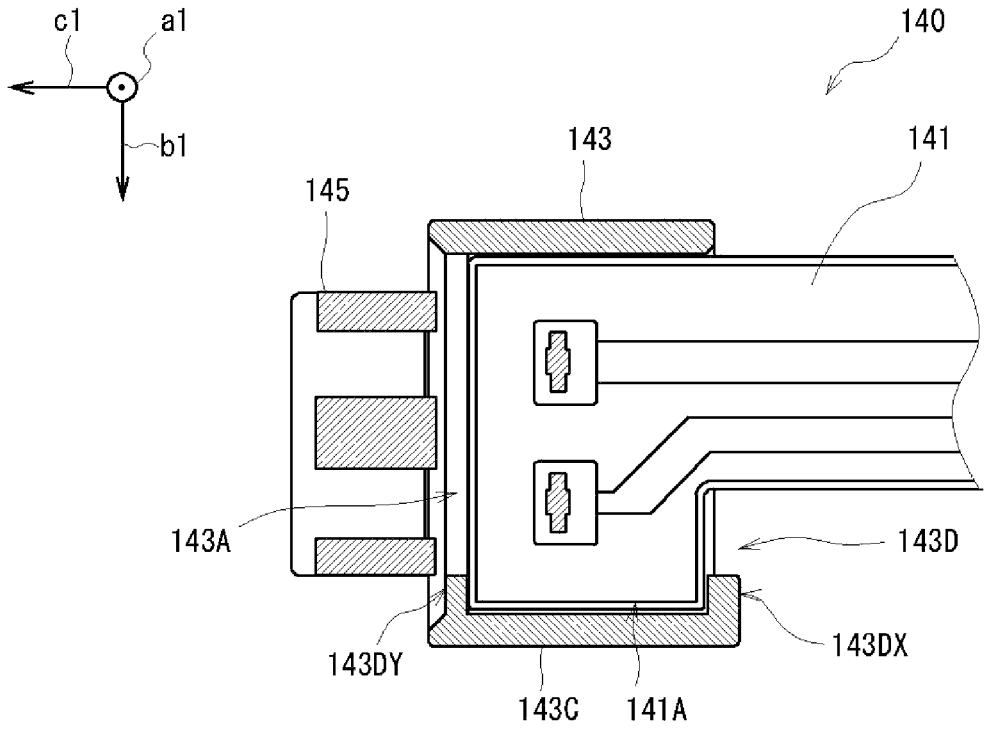
FIG. 40 is a schematic sectional view showing the left side connector and the left side holder attached to the left end portions of the heater and the pressing plate of the heater unit of the printer according to the fifth embodiment of the present invention.
Figure 41:
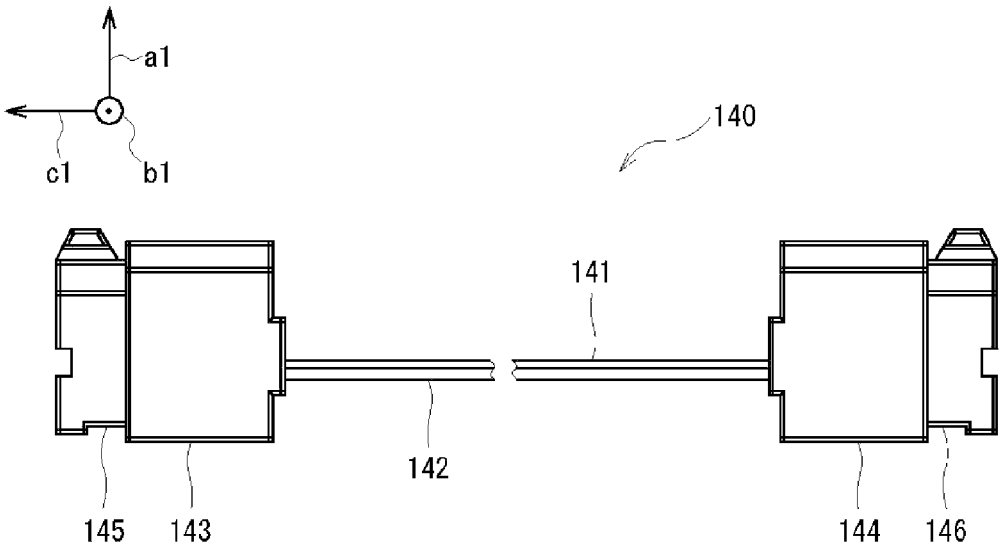
FIG. 41 is a schematic front view showing a right side connector, a right side holder, the left side connector, and the left side holder attached to the heater and the pressing plate of the heater unit of the printer according to the fifth embodiment of the present invention.

FIG. 40 is a schematic sectional view showing the left side connector 145 and the left side holder 143 attached to the left end portions of the heater 141 and the pressing plate 142 of the heater unit 140 of the printer according to the fifth embodiment of the present invention. FIG. 41 is a schematic front view showing a right side connector 146, a right side holder 144, the left side connector 145, and the left side holder 143 attached to the heater 141 and the pressing plate 142 of the heater unit 140 of the printer according to the fifth embodiment of the present invention.

As shown in FIGS. 37 to 41, the heater unit 140 includes the heater 141 having the left and right end portions having a similar configuration; the pressing plate 142; the left side holder 143 and the right side holder 144 having a similar configuration; and the left side connector 145 and the right side connector 146 having a similar configuration.

In the fifth embodiment, the heater 141 has a heater side left engaging portion 141A on the left end portion thereof on a front edge thereof, and the heater side left engaging portion 141A is formed in a substantially rectangular plate shape. A first protruding portion 143DX and a second protruding portion 143DY are formed on an inner surface of a one side plate 143C of the left side holder 143 at one opening portion and the other opening portion of a holding portion insertion hole 143A of the left side holder 143 on the side of a dividing plate 143B of the left side holder 143 to protrude toward inside the holding portion insertion hole 143A. Accordingly, the left side holder 143 includes a connector side engaging portion 143D formed of the first protruding portion 143DX, and the second protruding portion 143DY.

In the fifth embodiment, as shown in FIG. 37, when the left side holder 143 is attached to the heater 141 and the pressing plate 142, first, the left side holder 143 of the heater unit 140 is guided toward the left end portions of the heater 141 and the pressing plate 142 from the left side along the heater longitudinal direction such that the one opening portion of the left side holder 143 faces the left end portions of the heater 131 and the pressing plate 132. Then, the left end portions of the heater 141 and the pressing plate 142 are inserted into the holding portion insertion hole 143A near a top plate 143E of the left side holder 143.

In the next step, as shown in FIG. 38, after the heater side engaging portion 141A of the heater 141 on the left end portion thereof and the left end portion of the pressing plate 142 are inserted into the holding portion insertion hole 143A of the left side holder 143, the left side holder 143 is lifted, so that the other surface of the pressing plate 142 is pressed against one surface of the dividing plate 143B. Accordingly, the heater side engaging portion 141A is closely fitted between the first protruding portion 143DX and the second protruding portion 143DY without any space. Then, the left side connector 145 of the heater unit 140 is guided toward the other opening portion of the left side holder 143 from the left side along the heater width direction such that one end surface of a terminal holding portion 145A and one end surface of a terminal protecting portion 145B of the left side connector 145 face the one opening portion of the left side holder 143.

In the next step, as shown in FIG. 39, in the heater unit 140, the terminal holding portion 145A and the terminal protecting portion 145B of the left side connector 145 are inserted into the holding portion insertion hole 143A and the protecting portion insertion hole 143F of the left side holder 133 up to a specific standard position. Accordingly, the left side connector 145 is engaged with the left side holder 143 so that the left side connector 145 does not easily come off.

As shown in FIG. 40, in the heater unit 140, the heater side left engaging portion 141A of the heater 141 is sandwiched between the first protruding portion 143DX and the second protruding portion 143DY of the connector side engaging portion 143A of the left side holder 143 in the heater longitudinal direction, so that the heater side left engaging portion 141A is engaged with the connector side engaging portion 143A.

Further, as shown in FIG. 41, in the heater unit 140, after the left side holder 143 and the left side connector 145 are attached to the left end portions of the heater 141 and the pressing plate 142 at the connector attaching positions thereof, the right side holder 144 and the right side connector 146 are attached to the right end portions of the heater 141 and the pressing plate 142 at the connector attaching positions thereof through a process similar to that of attaching the left side holder 143 and the left side connector 145 to the left end portions of the heater 141 and the pressing plate 142.

In the fifth embodiment, even when the total length of the heater 141 is changed due to thermal expansion, or an external impact is applied to the printer, and the connector attaching positions on the left and right end portions of the heater 141 are shifted, it is possible to prevent the left side holder 143 and the right side holder 144 as well as the left side connector 145 and the right side connector 146 held with the left side holder 143 and the right side holder 144 at the connector attaching positions on the left and right end portions of the heater 141 from being shifted from the connector attaching positions on the left and right end portions of the heater 141 in the heater longitudinal direction.

Sixth Embodiment

A sixth embodiment of the present invention will be explained next with reference to FIGS. 42 to 47.

Figure 42:
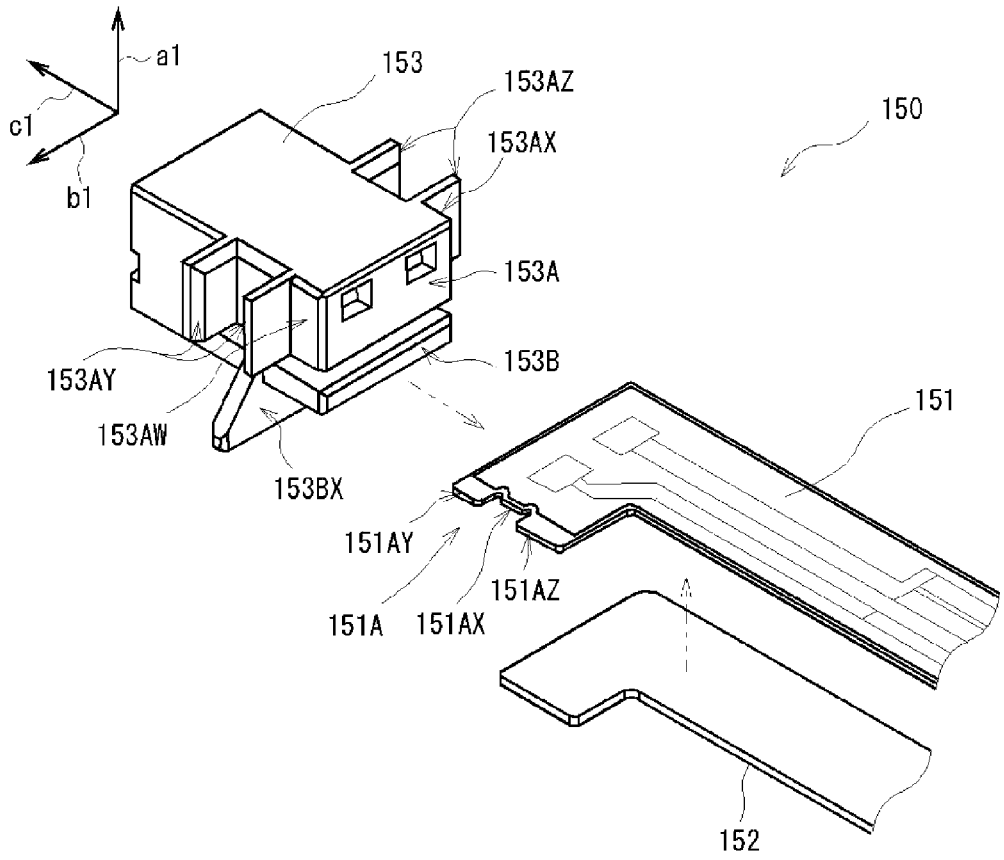
FIG. 42 is a schematic perspective view No. 1 showing a left side connector and a connector side engaging portion attached to left end portions of a heater and a pressing plate of a heater unit of a printer according to a sixth embodiment of the present invention.
Figure 43:
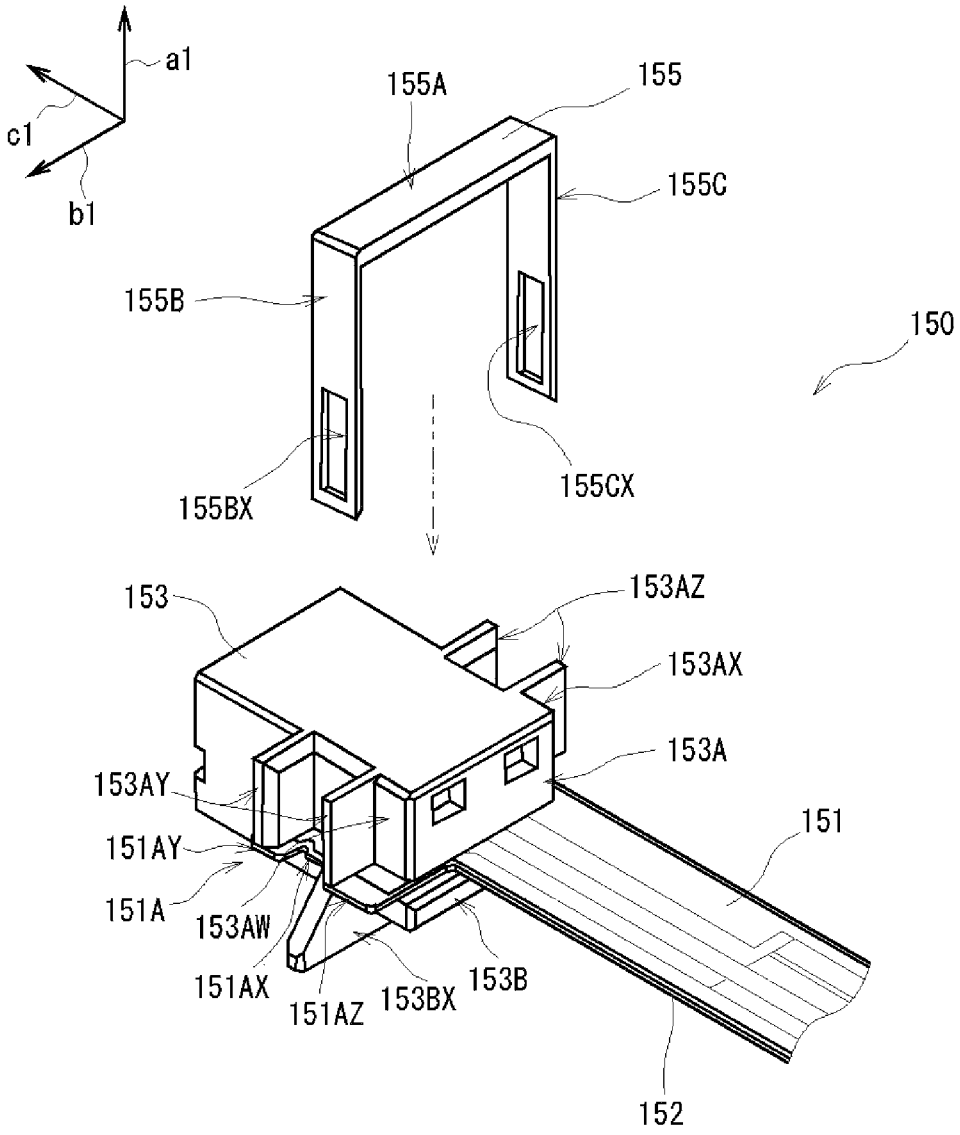
FIG. 43 is a schematic perspective view No. 2 showing the left side connector and the connector side engaging portion attached to the left end portions of the heater and the pressing plate of the heater unit of the printer according to the sixth embodiment of the present invention.
Figure 44:
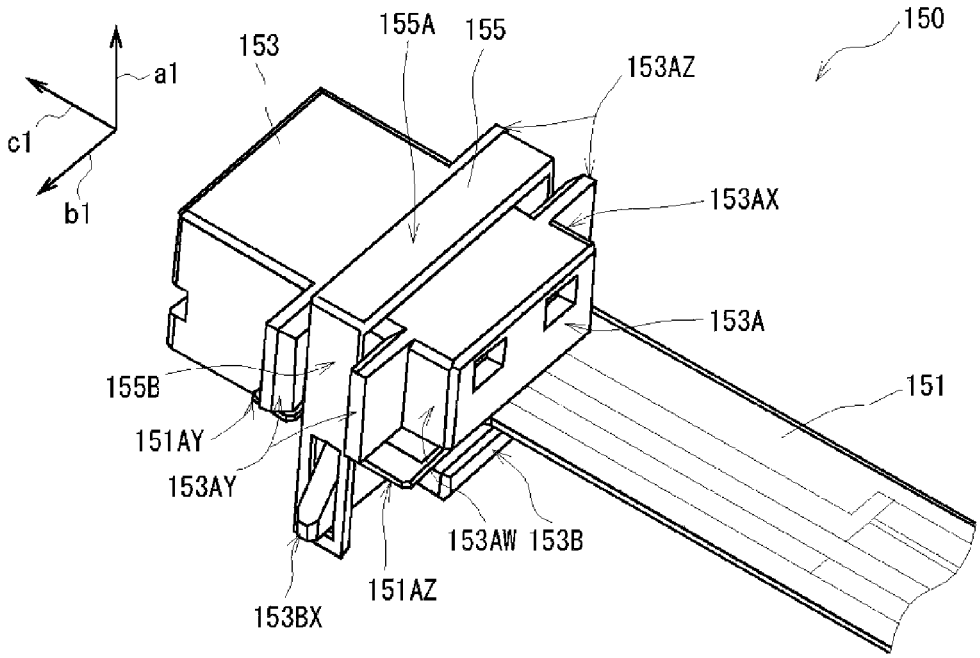
FIG. 44 is a schematic perspective view No. 3 showing the left side connector and the connector side engaging portion attached to the left end portions of the heater and the pressing plate of the heater unit of the printer according to the sixth embodiment of the present invention.
Figure 45:
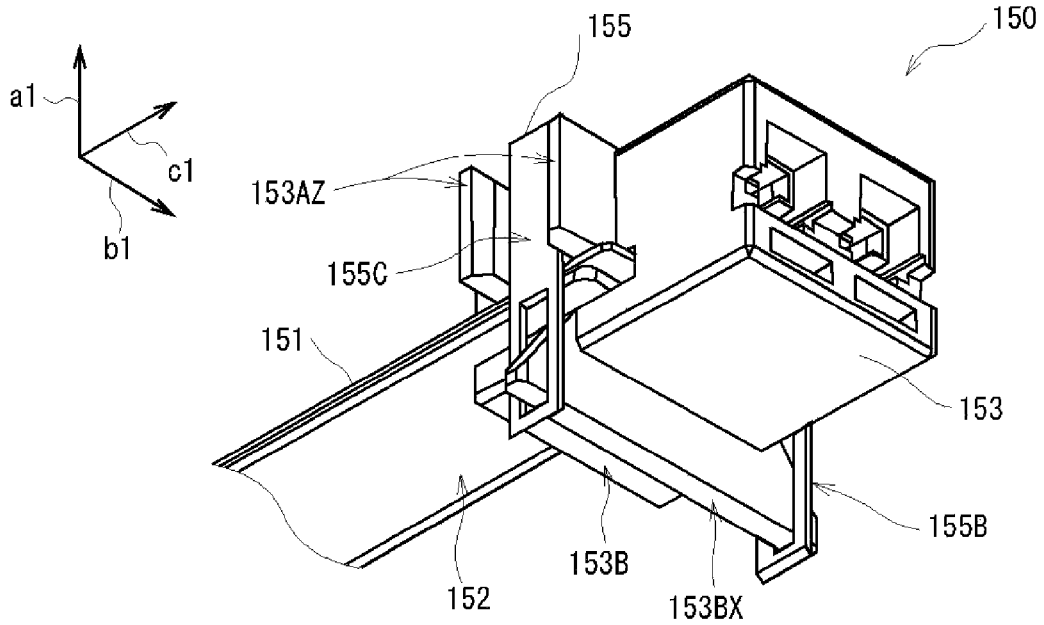
FIG. 45 is a schematic perspective view No. 4 showing the left side connector and the connector side engaging portion attached to the left end portions of the heater and the pressing plate of the heater unit of the printer according to the sixth embodiment of the present invention.

FIG. 42 is a schematic perspective view No. 1 showing a left side connector 153 and a connector side engaging portion 155 attached to left end portions of a heater 151 and a pressing plate 152 of a heater unit 150 of a printer according to the sixth embodiment of the present invention. FIG. 43 is a schematic perspective view No. 2 showing the left side connector 153 and the connector side engaging portion 155 attached to the left end portions of the heater 151 and the pressing plate 152 of the heater unit 150 of the printer according to the sixth embodiment of the present invention. FIG. 44 is a schematic perspective view No. 3 showing the left side connector 153 and the connector side engaging portion 155 attached to the left end portions of the heater 151 and the pressing plate 152 of the heater unit 150 of the printer according to the sixth embodiment of the present invention. FIG. 45 is a schematic perspective view No. 4 showing the left side connector 153 and the connector side engaging portion 155 attached to the left end portions of the heater 151 and the pressing plate 152 of the heater unit 150 of the printer according to the sixth embodiment of the present invention.

Figure 46:
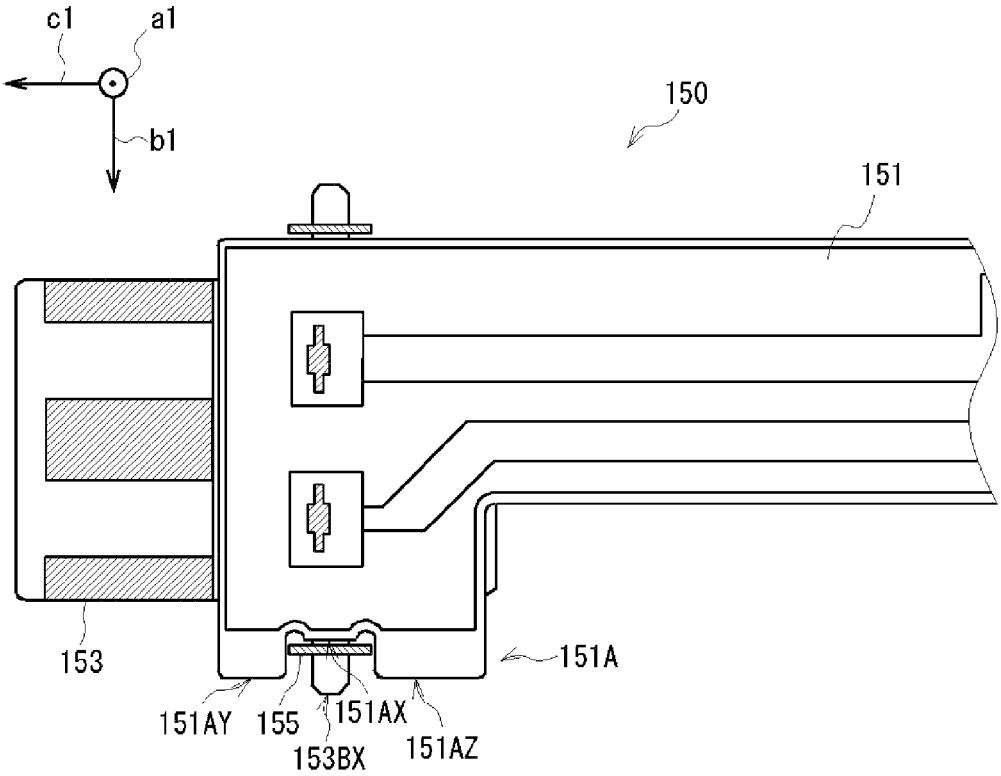
FIG. 46 is a schematic sectional view showing the left side connector and the connector side engaging portion attached to the left end portions of the heater of the heater unit of the printer according to the sixth embodiment of the present invention.
Figure 47:
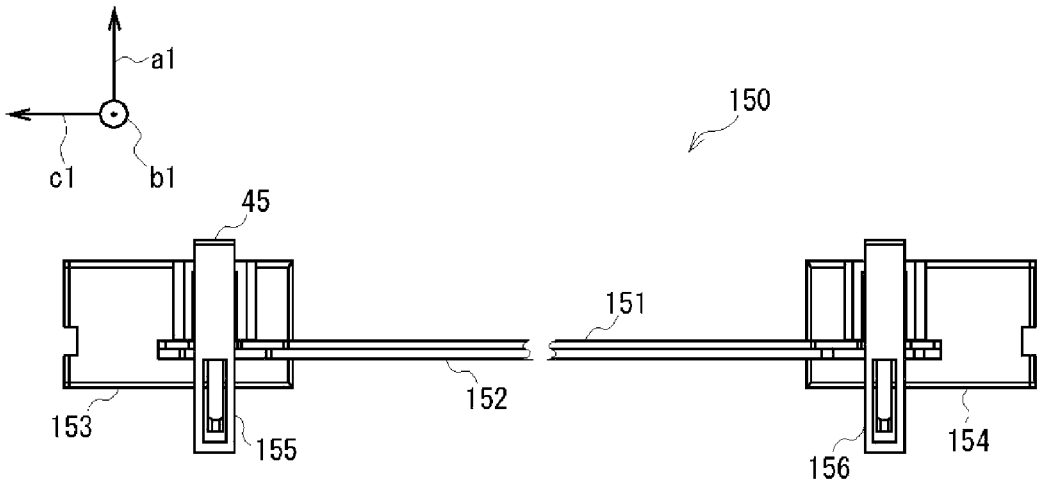
FIG. 47 is a schematic front view showing a right side connector, the left side connector, and the connector side engaging portion attached to the heater and the pressing plate of the heater unit of the printer according to the sixth embodiment of the present invention.

FIG. 46 is a schematic sectional view showing the left side connector 153 and the connector side engaging portion 155 attached to the left end portions of the heater 151 and the pressing plate 152 of the heater unit 150 of the printer according to the sixth embodiment of the present invention. FIG. 47 is a schematic front view showing a right side connector 154, the left side connector 153, the connector side engaging portion 155, and a connector side engaging portions 156 attached to the heater 151 and the pressing plate 152 of the heater unit 150 of the printer according to the sixth embodiment of the present invention.

As shown in FIGS. 42 to 47, the heater unit 150 includes the heater 151 having the left and right end portions having a similar configuration; the pressing plate 152; the left side connector 153 and the right side connector 154 having a similar configuration; and the connector side engaging portion 155 and the connector side engaging portions 156 having a similar configuration.

In the sixth embodiment, the heater 151 has the left end portion formed in a substantially L-character shape having the heater width greater than that of the central portion thereof. Further, the heater 151 includes a cut portion 151AX having a substantially rectangular shape at a distal end portion of the left end portion thereof protruding in the heater width direction. A first protruding portion 151AY and a second protruding portion 151AZ are formed on both sides of the cut portion 151AX to protrude toward in the heater width direction (that is, the front side). Accordingly, the heater 151 includes a heater side left engaging portion 151A formed of the cut portion 151AX, the first protruding portion 151AY, and the second protruding portion 151AZ on the left end portion thereof.

In the sixth embodiment, as shown in FIG. 42, when the left side connector 153 is attached to the heater 151 and the pressing plate 152, first, the left side connector 153 of the heater unit 150 is guided toward the left end portions of the heater 151 and the pressing plate 152 from the left side along the heater longitudinal direction such that one end surface of the terminal holding portion 153A and one end surface of the terminal protecting portion 153B face the left end portions of the heater 151 and the pressing plate 152. Then, the left end portions of the heater 151 and the pressing plate 152 are inserted into the connector groove portion 153C of the left side connector 153.

In the next step, as shown in FIG. 43, the connector side engaging portion 155 of the heater unit 150 is guided toward the other end surface of the terminal holding portion 153A of the left side connector 153 from the upper side such that an inner surface of the shoulder portion 155A of the connector side engaging portion 155 faces the other end surface of the terminal holding portion 153A.

In the next step, as shown in FIGS. 44 and 45, in the heater unit 150, the first arm portion 155B and the second arm portion 155C of the connector side engaging portion 155 are inserted up to the engaging plate portion 153BX of the left side connector 153 through the first engaging portion attaching guide 153AY and the second engaging portion attaching guide 153AZ. Accordingly, one end portion and the other end portion of the engaging plate portion 153BX are inserted into and engaged with the first engaging hole portion 155BX and the second engaging hole portion 155CX formed in the first arm portion 155B and the second arm portion 155C of the connector side engaging portion 155.

As shown in FIG. 46, in the heater unit 130, when the connector side engaging portion 155 is attached to the left side connector 153, the first arm portion 155B of the connector side engaging portion 155A is closely fitted in the cut portion 151AX of the heater 151 without any space. Accordingly, the first arm portion 155B of the connector side engaging portion 155 is sandwiched between the first protruding portion 151AY and the second protruding portion 151AZ of the heater side engaging portion 151A in the heater longitudinal direction, so that the connector side engaging portion 155 is engaged with the heater side engaging portion 151A.

Further, as shown in FIG. 47, in the heater unit 150, after the left side connector 153 and the connector side engaging portion 155 are attached to the left end portions of the heater 151 and the pressing plate 152 at the connector attaching positions thereof, the right side connector 154 and the connector side engaging portions 156 are attached to the right end portions of the heater 151 and the pressing plate 152 at the connector attaching positions thereof through a process similar to that of attaching the left side connector 153 and the connector side engaging portion 155 to the left end portions of the heater 151 and the pressing plate 152.

In the sixth embodiment, even when the total length of the heater 151 is changed due to thermal expansion, or an external impact is applied to the printer, and the connector attaching positions on the left and right end portions of the heater 151 are shifted, it is possible to prevent the left side connector 153 and the right side connector 154 at the connector attaching positions on the left and right end portions of the heater 151 from being shifted in the heater longitudinal direction.

Seventh Embodiment

A seventh embodiment of the present invention will be explained next with reference to FIGS. 48 to 53.

Figure 48:
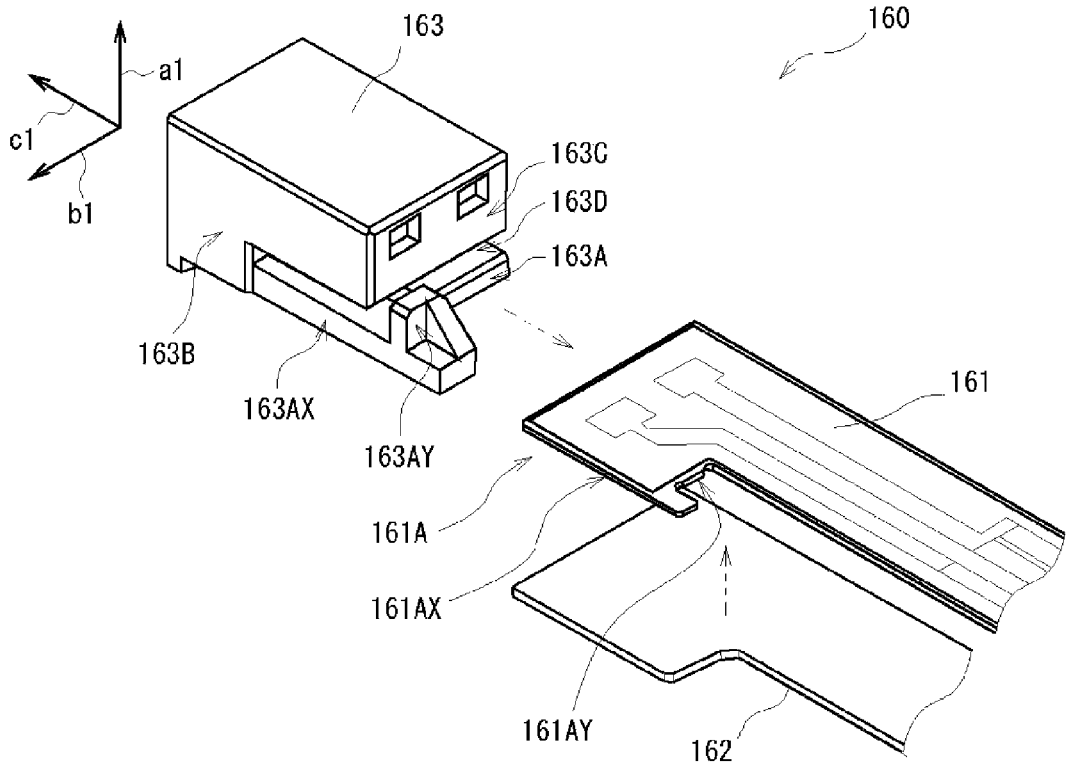
FIG. 48 is a schematic perspective view No. 1 showing a left side connector attached to left end portions of a heater and a pressing plate of a heater unit of a printer according to a seventh embodiment of the present invention.
Figure 49:
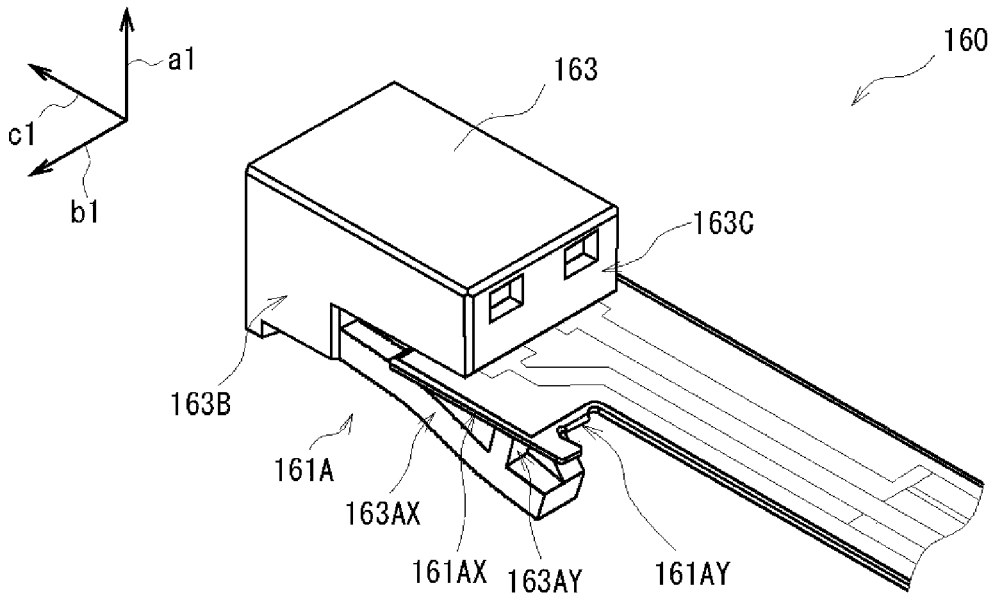
FIG. 49 is a schematic perspective view No. 2 showing the left side connector attached to the left end portions of the heater and the pressing plate of the heater unit of the printer according to the seventh embodiment of the present invention.
Figure 50:
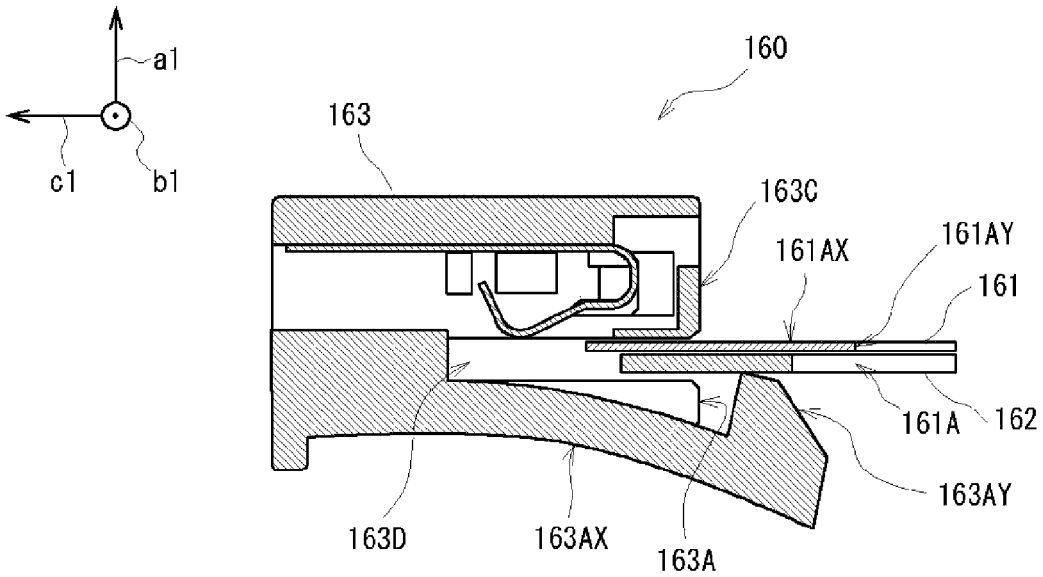
FIG. 50 is a schematic perspective view No. 3 showing the left side connector attached to the left end portions of the heater and the pressing plate of the heater unit of the printer according to the seventh embodiment of the present invention.
Figure 51:
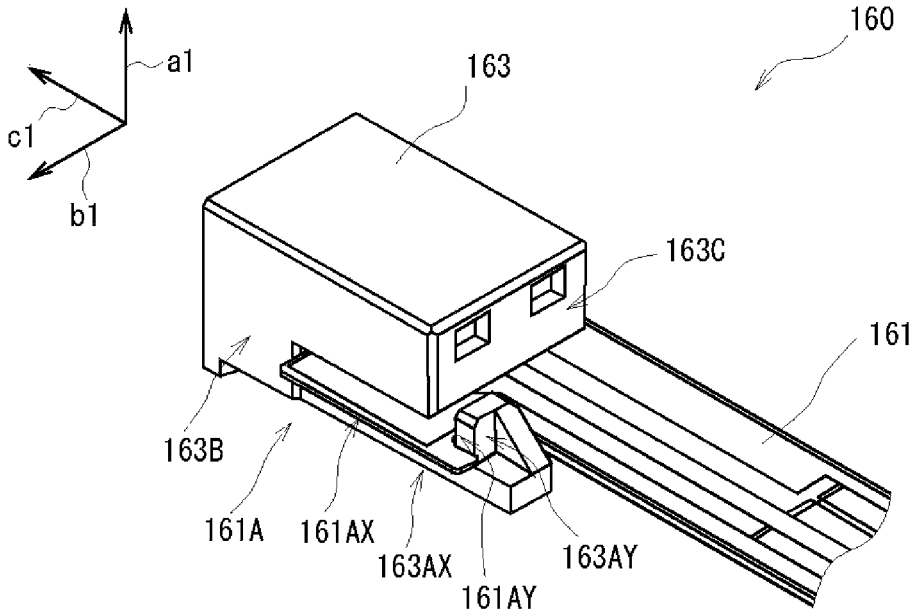
FIG. 51 is a schematic perspective view No. 4 showing the left side connector attached to the left end portions of the heater and the pressing plate of the heater unit of the printer according to the seventh embodiment of the present invention.

FIG. 48 is a schematic perspective view No. 1 showing a left side connector 163 attached to left end portions of a heater 161 and a pressing plate 162 of a heater unit 160 of a printer according to the seventh embodiment of the present invention. FIG. 49 is a schematic perspective view No. 2 showing the left side connector 163 attached to the left end portions of the heater 161 and the pressing plate 162 of the heater unit 160 of the printer according to the seventh embodiment of the present invention. FIG. 50 is a schematic perspective view No. 3 showing the left side connector 163 attached to the left end portions of the heater 161 and the pressing plate 162 of the heater unit 160 of the printer according to the seventh embodiment of the present invention. FIG. 51 is a schematic perspective view No. 4 showing the left side connector 163 attached to the left end portions of the heater 161 and the pressing plate 162 of the heater unit 160 of the printer according to the seventh embodiment of the present invention.

Figure 52:
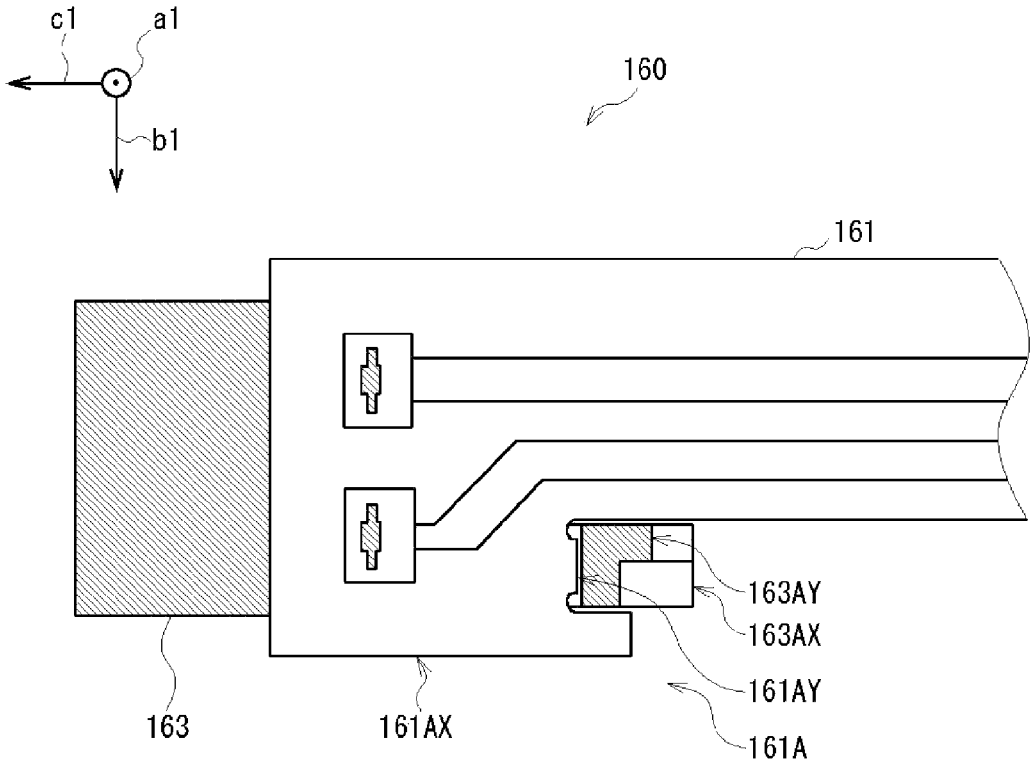
FIG. 52 is a schematic sectional view showing the left side connector attached to the left end portions of the heater of the heater unit of the printer according to the seventh embodiment of the present invention.
Figure 53:
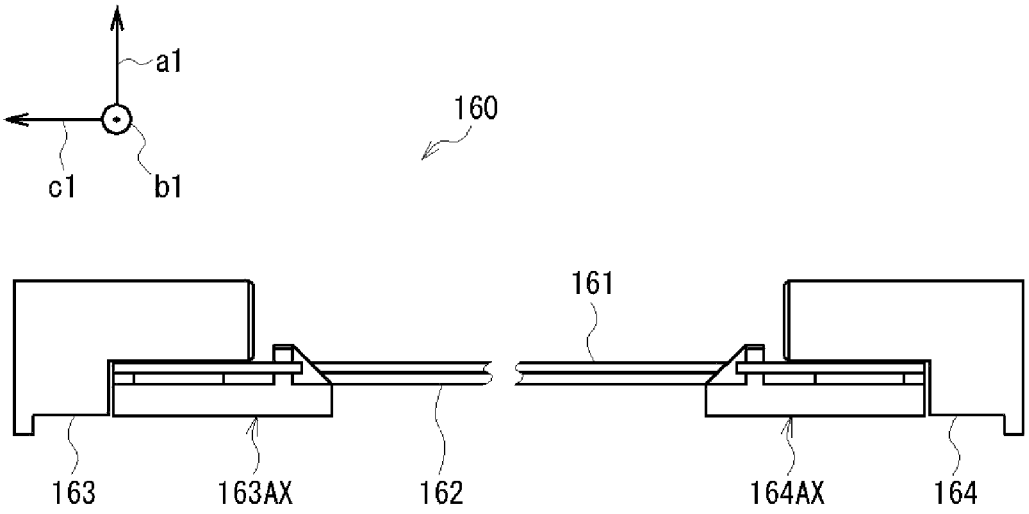
FIG. 53 is a schematic front view showing a right side connector and the left side connector attached to the heater and the pressing plate of the heater unit of the printer according to the seventh embodiment of the present invention.

FIG. 52 is a schematic sectional view showing the left side connector 163 attached to the left end portions of the heater 161 and the pressing plate 162 of the heater unit 150 of the printer according to the seventh embodiment of the present invention. FIG. 53 is a schematic front view showing a right side connector 164 and the left side connector 163 attached to the heater 161 and the pressing plate 162 of the heater unit 160 of the printer according to the seventh embodiment of the present invention.

As shown in FIGS. 48 to 53, the heater unit 160 includes the heater 161 having the left and right end portions having a similar configuration; the pressing plate 162; and the left side connector 163 and the right side connector 164 having a similar configuration.

In the seventh embodiment, the heater 161 includes a protruding portion 161AX on the left end portion thereof having a substantially rectangular shape and protruding from a front edge thereof. Further, the heater 161 includes a cut portion 161AY having a substantially rectangular shape at a base portion of a right edge of the protruding portion 161AX. Accordingly, the heater 161 includes a heater side left engaging portion 161A formed of the protruding portion 161AX and the cut portion 161AY.

In the seventh embodiment, the left side connector 163 includes a connector side engaging portion 163AX with a spring property having a substantially L-character arm shape. The connector side engaging portion 163AX is disposed on a terminal protecting portion 163A near one side surface 153B of the left side connector 163. The connector side engaging portion 163AX includes a claw portion 163AY at a distal end portion thereof, so that the claw portion 163AY protrudes on the front side of one end surface of the terminal protecting portion 163A.

In the seventh embodiment, as shown in FIG. 48, when the left side connector 163 is attached to the heater 161 and the pressing plate 162, first, the left side connector 163 of the heater unit 160 is guided toward the left end portions of the heater 161 and the pressing plate 162 from the left side along the heater longitudinal direction such that one end surface of the terminal holding portion 163C and one end surface of the terminal protecting portion 163A face the left end portions of the heater 161 and the pressing plate 162. Then, the left end portions of the heater 161 and the pressing plate 162 are inserted into the connector groove portion 163D of the left side connector 163.

In the next step, as shown in FIGS. 49 and 50, the left end portions of the heater 161 and the pressing plate 162 are inserted into the connector groove portion 163D of the left side connector 163 such that the claw portion 163AY of the connector side engaging portion 163AX of the left side connector 163 is deformed and slid under the other surface of the pressing plate 162 while sliding against the other surface of the pressing plate 162.

In the next step, as shown in FIGS. 51 and 52, when the left end portions of the heater 161 and the pressing plate 162 are inserted into the connector groove portion 163D of the left side connector 163 up to the backside thereof, the connector side engaging portion 163AX of the left side connector 163 thus deformed is returned to the original state, so that the claw portion 163AY is fitted into the cut portion 161AY of the heater 161 without any space in between. Accordingly, the protruding portion 161AX of the heater side engaging portion 161A is sandwiched between the connecting portion inner surface of the left side connector 163 and the claw portion 163Ay of the connector side engaging portion 163AX in the heater longitudinal direction, so that the connector side engaging portion 163AX is engaged with the heater side engaging portion 161A.

Further, as shown in FIG. 53, in the heater unit 160, after the left side connector 163 is attached to the left end portions of the heater 161 and the pressing plate 162 at the connector attaching positions thereof, the right side connector 164 is attached to the right end portions of the heater 161 and the pressing plate 162 at the connector attaching positions thereof through a process similar to that of attaching the left side connector 163 to the left end portions of the heater 161 and the pressing plate 162.

In the sixth embodiment, even when the total length of the heater 161 is changed due to thermal expansion, or an external impact is applied to the printer, and the connector attaching positions on the left and right end portions of the heater 161 are shifted, it is possible to prevent the left side connector 163 and the right side connector 164 at the connector attaching positions on the left and right end portions of the heater 151 from being shifted in the heater longitudinal direction.

As described above, in the fifth to seventh embodiments, in the heater unit 140, the heater unit 150, and the heater unit 160, the left side connector 145, the left side connector 153, the left side connector 163, the right side connector 146, the right side connector 154, and the right side connector 164 are attached to the left and right end portions of the heater 141, the heater 151, and the heater 161, respectively. Accordingly, it is possible to obtain an effect similar to those in the first to third embodiments.

As described above, in the first to seventh embodiments, the present invention is applied to the image forming apparatus such as the printer 1, the printer 100, and the printer 120 with reference to FIGS. 1 to 53. The present invention is not limited thereto, and may be applicable to an image forming apparatus having various configurations including a multifunction printer, a facsimile, a multifunction product, a copier, and the like.

Further, in the first to seventh embodiments, the present invention is applied to the heater formed of the base board with the heating resistor members and the electrodes disposed thereon and electrically connected to each other and having the substantially rectangular shape such as the heater 29, the heater 102, the heater 131, the heater 141, the heater 151, and the heater 161 shown in FIGS. 1 to 53. The present invention is not limited thereto, and may be applicable to a heater having various configurations, for example, formed of a base board having an oval shape or a U-character shape, or formed of a metal material other than stainless steel. Further, the present invention may be applicable to a heater with more than two electrodes arranged integrally at one location of one surface thereof, so that only one connector is attached to the heater.

Further, in the first to seventh embodiments, the present invention is applied to the connector having the connection terminal and attached to the specific connector attaching position of the heater so that the electrode contacts with the connection terminal such as the left side connector 53, the left side connector 106, the left side connector 126, the left side connector 135, the left side connector 145, the left side connector 153, and the left side connector 163 having the substantially U-character shape as shown in FIGS. 1 to 53. The present invention is not limited thereto, and may be applicable to a connector having various configurations. For example, a connector may be formed in a rectangular shape or a substantially L-character shape including at least the terminal holding portion. Alternatively, a connector may have the terminal holding portion and the terminal protecting portion having different lengths, and an engaging portion attaching groove of a connector side engaging portion is formed only in one end surface thereof for attaching the connector.

Further, in the first to seventh embodiments, the present invention is applied to the heater having the heater side engaging portion such as the heater side engaging portion 29C, the heater side engaging portion 102C, the heater side engaging portion 131A, the heater side engaging portion 141A, the heater side engaging portion 151A, and the heater side engaging portion 161A as shown in FIGS. 1 to 53. The present invention is not limited thereto, and may be applicable to a heater side engaging portion having various configurations.

For example, a heater side engaging portion may be formed to have a first cut portion and a second cut portion in a front edge portion and a rear edge portion thereof at opposite locations along the heater width direction so that the heater width is narrowed from both sides. Then, it is configured such that a connector side engaging portion sandwich the narrowed portion at the first cut portion and the second cut portion in the heater width direction, so that the heater side engaging portion is engaged with the connector side engaging portion. Accordingly, it is possible to prevent the connector from being shifted from the connector attaching position of the heater.

Further, in the first to seventh embodiments, the present invention is applied to the heater having the connector side engaging portion such as the connector side engaging portion 51FG, the connector side engaging portion 108, the connector side engaging portion 109, the connector side engaging portion 126AX, the connector side engaging portion 135A, the connector side engaging portion 143D, the connector side engaging portion 155, the connector side engaging portion 156, and the connector side engaging portion 163AX as shown in FIGS. 1 to 53. When the connector is attached to the heater, the connector side engaging portion is engaged with the heater side engaging portion, so that the connector is restricted from being shifted relative to the connector attaching position. The present invention is not limited thereto, and may be applicable to a connector side engaging portion having various configurations.

For example, a connector side engaging portion may be disposed in the holder. Further, a connector side engaging portion may be configured to have a first protruding portion and a second protruding portion. Then, it is configured such that a heater side engaging portion may be formed to have a first cut portion and a second cut portion in a front edge portion and a rear edge portion thereof at opposite locations along the heater width direction so that the heater width is narrowed from both sides, so that the heater side engaging portion is engaged with the first protruding portion and the second protruding portion of the connector side engaging portion. Accordingly, it is possible to prevent the connector from being shifted from the connector attaching position of the heater.

Further, in the first to seventh embodiments, the present invention is applied to the holder for holding the connector such as the left side holder 51, the left side holder 133, the left side holder 143, the right side holder 52, the right side holder 134, and the right side holder 144 as shown in FIGS. 1 to 53. The present invention is not limited thereto, and may be applicable to a holder having various configurations. For example, a holder may be configured to hold a connector including only the terminal holding portion and having a rectangular shape or a substantially L-character shape, so that the holder has the protecting function relative to the connection terminal.

The disclosure of Japanese Patent Application No. 2014-066791, filed on Mar. 27, 2014, is incorporated in the application.

While the invention has been explained with reference to the specific embodiments of the invention, the explanation is illustrative and the invention is limited only by the appended claims.

What is claimed is:

1. A heater unit comprising:

a heater including a board on which a heating resistor member and an electrode electrically connected to the heating resistor member are disposed;

a connector having a connection terminal for abutting against the electrode;

a holder for holding the connector;

a heater side engaging portion disposed on the heater; and a connector side engaging portion for engaging with the heater side engaging portion, wherein said holder includes an insertion hole for receiving the heater, said holder further includes a first restricting portion for restricting the heater in a heater longitudinal direction, said holder further includes a second restricting portion for restricting the heater in a heater width direction perpendicular to the heater longitudinal direction, and said heater includes a protruding portion held with the second restricting portion.

2. The heater unit according to claim 1, wherein said heater includes the heating resistor member arranged on the board along the heater longitudinal direction, said heater includes the electrode arranged on an end portion thereof in the heater longitudinal direction, said connector is attached to the heater at the connector attaching position on the end portion, and said heater side engaging portion is configured to restrict the connector from shifting from the connector attaching position in the heater longitudinal direction.

3. The heater unit according to claim 1, wherein said connector is attached to the board at the connector attaching position in a state that the holder holds the connector.

4. The heater unit according to claim 3, wherein said heater side engaging portion is arranged on an end portion of the heater in the heater longitudinal direction, said connector is attached to the heater at the connector attaching position on the end portion, said connector side engaging portion is disposed on the holder, and said connector side engaging portion is configured to engage with the heater side engaging portion when the holder is attached to the heater at the connector attaching position.

5. The heater unit according to claim 1, wherein said heater side engaging portion includes a protruding portion protruding in the heater width direction, and said connector side engaging portion includes a sandwiching portion for sandwiching the protruding portion in the heater longitudinal direction.

6. The heater unit according to claim 3, wherein said holder is attached to the heater at the connector attaching position along the heater longitudinal direction of the heater, and said heater is attached to and held with the holder along the heater width direction.

7. The heater unit according to claim 1, wherein said heater side engaging portion is arranged on an end portion of the heater in the heater longitudinal direction, said connector is attached to the heater at the connector attaching position on the end portion, said connector side engaging portion is disposed on the connector attached to the heater at the connector attaching position, and said connector side engaging portion is configured to engage with the heater side engaging portion.

8. The heater unit according to claim 1, wherein said connector includes a terminal holding portion for holding the connection terminal so that a contact portion of the connection terminal protrudes from the terminal holding portion to contact with the electrode, said connector further includes a terminal protecting portion for protecting the contact portion of the connection terminal, and said connector further includes a connecting portion for connecting the terminal holding portion and the terminal protecting portion so that the terminal protecting portion faces the contact portion of the connection terminal.

9. The heater unit according to claim 8, wherein said connector further includes an engaging portion attaching groove formed in at least one of the terminal holding portion and the terminal protecting portion so that the connector side engaging portion is fitted in the engaging portion attaching groove.

10. The heater unit according to claim 9, wherein said heater side engaging portion includes a cut portion, and said cut portion is configured to receive the connector side engaging portion when the connector side engaging portion is attached to the connector through the engaging portion attaching groove.

11. The heater unit according to claim 1, wherein said connector is configured to be attached to the heater at the connector attaching position along the heater width direction of the heater, and said connector engaging portion is attached to the connector along the heater width direction.

12. The heater unit according to claim 1, wherein said heater side engaging portion is arranged on an end portion of the heater in the heater longitudinal direction of the heater, said connector is attached to the heater at the connector attaching position on the end portion, and said connector side engaging portion is disposed on the connector so that the connector side engaging portion is engaged with the heater side engaging portion when the connector is attached to the heater at the connector attaching position.

13. The heater unit according to claim 1, wherein said connector side engaging portion is configured to engage with the heater side engaging portion when the connector is attached to the heater at the connector attaching position along the heater width direction of the heater.

14. A fixing device comprising the heater unit according to claim 1 so that developer on a surface of a print medium is heated and an image formed of the developer is fixed to the surface of the print medium.

15. An image forming apparatus comprising the heater unit according to claim 1 so that a print image is formed on a surface of a print medium.

16. A heater unit comprising:

a board including an electrode;

a connector having a connection terminal for abutting against the electrode;

a holder for holding the connector;

a board side engaging portion disposed on the board; and a connector side engaging portion for engaging with the board side engaging portion, wherein said holder includes an insertion hole for receiving the board, said holder further includes a first restricting portion for restricting the board in a board longitudinal direction, said holder further includes a second restricting portion for restricting the board in a board width direction perpendicular to the board longitudinal direction, and said board includes a protruding portion held with the second restricting portion.

17. The board unit according to claim 16, wherein said board includes a heating resistor member electrically connected to the electrode.

* * * * *